US006382777B1

(12) United States Patent
Yamaguchi et al.

(10) Patent No.: US 6,382,777 B1
(45) **Date of Patent: *May 7, 2002**

(54) LIQUID JET RECORDING HEAD

(75) Inventors: Yukuo Yamaguchi; Keizou Naganuma; Syunichi Watanabe, all of Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/334,680

(22) Filed: Jun. 17, 1999

(30) Foreign Application Priority Data

| | | |
|---|---|---|
| Jun. 19, 1998 | (JP) | 10-173390 |
| Jun. 19, 1998 | (JP) | 10-173391 |
| Jun. 19, 1998 | (JP) | 10-173392 |
| Jul. 15, 1998 | (JP) | 10-200574 |

(51) Int. Cl.[7] ..... B41J 2/05

(52) U.S. Cl. ..... 347/63; 347/45

(58) Field of Search ..... 29/890.1; 216/27; 347/63, 65, 56, 54, 20, 44, 47, 45; 430/320

(56) References Cited

U.S. PATENT DOCUMENTS

| | | | | | |
|---|---|---|---|---|---|
| 4,320,406 | A | * | 3/1982 | Heinzl | 347/43 |
| 4,434,430 | A | * | 2/1984 | Koto | 347/70 |
| 4,688,052 | A | * | 8/1987 | Inamoto et al. | 347/65 |
| 5,255,022 | A | * | 10/1993 | Burolla | 347/85 |
| 5,389,957 | A | * | 2/1995 | Kimura et al. | 347/20 |
| 5,588,597 | A | * | 12/1996 | Reinecke et al. | 347/47 |

OTHER PUBLICATIONS

Hawley, Gessner, Hawley's Condensed Chemical Dictionary 13th ed., 1997 by John Wiley & Sons, Inc. pp. 437 and 906.*

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

A liquid jet recording head includes a substrate member provided with discharge energy generating elements for generating ink discharge energy corresponding to a plurality of ink flow paths, a plurality of grooves corresponding to the plurality of ink flow paths, an orifice plate provided with ink discharge ports for discharging ink each communicated with each one end of the grooves, an ink liquid chamber communicated with each of the grooves at the other end thereof for supplying ink to each of the grooves, and an ink supply port for supplying ink to the ink liquid chamber. Then, a ceiling plate member, which is formed integrally with the grooves, the orifice plate, the ink liquid chamber, and the ink supply port, and the substrate member are bonded to form a plurality of ink discharge paths. For this ink jet recording head, the ceiling plate member is structured with a first substrate that includes the grooves and the orifice plate, and a second substrate that includes the ink liquid chamber and the ink supply port, and then, the first substrate and the second substrate are bonded by means of bicolor molding to be integrally molded.

125 Claims, 23 Drawing Sheets

LIQUID JET RECORDING HEAD

BACKGROUND OF THE INVENTION

1. Field of the Invention

The present invention relates to a liquid jet recording head used for a liquid jet recording apparatus that records on a recording sheet by discharging ink from the discharge ports of the orifice plate thereof.

2. Related Background Art

The liquid jet recording apparatus performs its recording on a recording sheet by discharging ink (recording liquid) as liquid droplets from the discharge ports arranged for the orifice plate of the liquid jet recording head. In accordance with the driving signals transmitted from the main body of the liquid jet recording apparatus, ink in each of the liquid flow paths is heated by each of the discharge energy generating elements which is arranged in each of the liquid flow paths so as to create the changes of state of ink for the formation of bubbles. Then, on the basis of the voluminal changes at the time of the bubble formation, ink is discharged from each of the discharge ports.

More specifically, as the discharge energy generating elements, the electrothermal transducing devices are used to generate heat when energized in accordance with the recording signals. The discharge energy generating elements are formed on a silicon substrate by the application of the thin film formation technologies and techniques in semiconductor field.

In general, the liquid jet recording head comprises a substrate having a plurality of discharge energy generating elements on it, and a ceiling plate that covers the upper part of the substrate. The ceiling plate comprises an orifice plate having the liquid flow paths (nozzles) that face the discharge energy generating elements, respectively, and the ink discharge ports; an ink liquid chamber for supplying ink to each of the liquid flow paths; and ink supply port through which ink is supplied to the ink liquid chamber.

The orifice plate is a sheet-type member of several tens to several hundreds of $\mu$m. For this sheet type member, a number of fine holes are formed as ink discharge ports. Then, as the method to form these fine holes efficiently in high precision, there are utilized a laser processing, an electroforming, a precision press work, a precision molding, or the like.

On the other hand, each liquid flow path (nozzle) is formed by means of a groove having a width of several tens of $\mu$m and a depth of several tens of $\mu$m. Many numbers of such grooves are formed at pitches of several tens of $\mu$m. In order to arrange these fine grooves to face the discharge energy generating elements in high precision, respectively, there is used for the manufacture thereof, precision molding, such as an injection molding, a transfer molding, an compression molding, an extrusion molding, an injection mold, ceramics injection; the fine laser processing, such as the excimer laser, the YAG laser; or the semiconductor thin film formation technologies and techniques, such as the silicon anisotropic etching, the photolithography, among others.

The ceiling plate is formed by means of the precision processing as described above. Particularly, the method that adopts the precision molding is extremely effective in that the member can be manufactured at lower costs, and in that the complicated configuration can be molded easily. So far, the ceiling plates are formed in various modes.

As the molding resin material, the resin material used, such as polysulfone, polyether sulfone, polyphenylene sulfide, denatured polyphenylene oxide, polypropylene, polyimide, or liquid crystal polymer (LCP) has an excellent resistance to ink.

For the molding of the ceiling plate, the most difficult techniques are to fill in the thinner thickness portion of the orifice plate, and transfer the fine portions of the liquid flow path walls stable as well. Therefore, the highly precise molding of the ceiling plate is performed by adopting various simulation techniques, such as the flow analysis or the precise mold machining techniques, at the same time, using a precise high-speed injection molding machine or a material having the high flowability for that purpose.

The injection molding is the most popular precision formation method. However, it is possible to implement the molding of a precise ceiling plate by the adoption of this method with the thorough control of the injection molding condition, such as the injection speed, the injection pressure, the dwell, the temperature adjustment of the metallic molds, the temperature adjustment of the resin, as well as with the structural devices of the metallic molds, such as degassing, the adjustment of dowel positions, or gate configuration, and further, by the positive utilization of the modern injection molding techniques, such as the pressure control in the interior of the metallic molds, the localized heating of the metallic molds, the vibration molding by use of the ultrasonic waves, or the injection molding using the compression in the interior of the metallic molds.

In this respect, the orifice plate may be molded integrally with the ceiling plate or molded separately from the ceiling plate. The structure of the ceiling plate in these cases may be selected arbitrarily depending on the component structure of the entire body, the structure of assembling apparatus, the method of laser processing, or the like. In either case, however, it is required to adopt a highly precise molding technique.

For example, the most difficult part of the ceiling molding is the filling of the molding resin into the fine portions such as the flow path walls. It is generally impossible to perform the sufficient filling in this portion just by the adoption of the injection processing step. In other words, for the injection processing step, the resin viscosity is made lower by the utilization of the temperature adjustment or sealing heat generation, and the flowability of the resin is enhanced. Then, before the resin is cooled down, it is filled in the metallic molds as quickly as possible. At this juncture, however, the condition of resin filling is still incomplete in the location where the resin flow is stagnated or at the corners, in the minute portions, or the like. Then, if the process proceeds to the step of dwelling, the pressure thus dwelled tends to act upon all the places in the interior of the metallic molds, and the transfer is performed to the portion where the filling has been insufficient in the injection step. As a result, if the filling is insufficient in the injection step, the pressure thus held tends to be concentrated on the locations where the filling is not sufficient, hence making it impossible to allow the pressure thus held to act upon the entire area of the interior of the metallic molds.

FIG. 1 is a view which schematically shows the conventional liquid jet recording head as described above. In FIG. 1, this liquid jet recording head comprises the substrate (hereinafter referred to as a heater board) 100 having the ink discharge pressure generating elements arranged on it, and the ceiling plate 500 having the irregular portion which constitutes the ink liquid chamber 600 that contains recording liquid (hereinafter referred to as ink) and the liquid flow paths (nozzles) 700 when the ceiling plate is bonded to the heater board 100. Then, above the ink liquid chamber 600, the ink supply port 1000 is arranged to be communicated with the ink liquid chamber 600.

Also, in front of the liquid flow paths (nozzles) 700, the orifice plate 400 having the ink discharge ports on it for discharging ink is integrally formed with the ceiling plate 500 or bonded to or coupled with the ceiling plate 500 so that the ink discharge ports are communicated with the liquid flow paths 700.

The heater board 100 is adhesively fixed to the supporting substrate (hereinafter referred to as a base plate) 300 by the application of the bonding agent 306 or the like. The ceiling plate 500 is positioned and bonded so that the liquid flow paths (nozzles) 700 of the ceiling plate 500 are in agreement with the heater units 100*a* of the ink discharge pressure generating elements arranged on the heater board 100, respectively. The orifice plate 400 is arranged like an apron on the front edge of the base plate 300. Also, the ink chamber 600 of the ceiling plate 500 receives the ink supply from an ink tank (not shown) through the ink supply port 1000.

For a liquid jet recording head of the kind, when the liquid flow paths (nozzles) 700 and the heater board 100 are bonded to form the ink flow paths, the bonding agent may enter the interior of the liquid flow paths (nozzles) 700 if the sealing agent, the adhesive agent, or some other bonding agent is used for bonding the liquid flow paths (nozzles) 700 and the heater board 100 together. Thus, the configuration of the liquid flow paths (nozzles) 700 is subjected to the deformation or there is a fear that the liquid flow paths (nozzles) 700 are partly clogged. Therefore, the bonding is made by mechanically compressing at least the liquid flow path portion in order to preclude the possibility of such imperfection.

Now, hereunder, this structure will be described. The heater board 100 and the ceiling plate 500 are positioned in the direction (indicated by arrows E in FIG. 1) which is in parallel to the ink discharge direction by allowing the front end surface of the heater board 100 to abut upon the orifice plate 400. Then, the heater board 100 and the ceiling plate 500 are bonded. Subsequently, the nails 507 each arranged on the lower part of each end of the pressure spring 900 are inserted into the holes 307 provided for the base plate 300. Thus, the folded portions 507*a* of the nails 507 are hooked to the lower end of the base plate 300. In this way, the pressure spring 900 is allowed to exert its mechanical pressure to the contacted portion from above the liquid flow path walls of the ceiling plate 500.

Therefore, the liquid flow path walls of the ceiling plate 500 and the heater board 100 are closely in contact by the application of the mechanical compression as described above.

However, in such case of the mechanical compression, the compressive force thus exerted does not act upon the outer walls of the ink liquid chamber 600 and other bonded portions sufficiently, although it is good enough to allow the heater board 100 to be in close contact, because the liquid flow path walls receive the direct weighting from above. Therefore, it is extremely difficult to allow all of these components to be in close contact with the heater board 100 exactly.

On the other hand, there is a method for retaining the outer wall portion of the ink liquid chamber to be in close contact by arranging pressure means separately to compress the outer wall portion of the ink liquid chamber. However, with this method, the repulsive force of the compression exerted on the ink liquid chamber tends to act upon the liquid flow path walls, and there is a fear that the close contactness of the liquid flow path walls is impeded. Hence, this method cannot be regarded as an effective one.

Under the circumstances, there are created fine steps in general on the lower faces of the liquid flow path walls and the outer wall portion of the ink liquid chamber, and when the lower face of the liquid flow path walls is in close contact with the heater board 100, a gap is formed between the lower face of the outer wall portion of the ink liquid chamber and the heater board 100. Then, sealant is applied to this gap to secure the airtightness between the outer walls of the ink liquid chamber and the heater board 100.

Here, as a matter of course, if this gap becomes larger, it may cause the defective sealing. If, on the other hand, if the gap is made smaller, the lower face of the ink liquid chamber and the heater board 100 are in contact to impede the close contactness between the liquid flow path walls and the heater board 100.

Therefore, in order to apply the sealant exactly to the gap formed between the lower face of the outer wall of the ink liquid chamber and the heater board 100, the molding process should be controlled so that the steps between the lower faces of the liquid flow path walls and the outer walls of the ink liquid chamber are formed in the desired value.

The sealant is used for the bonded portion between the units of the liquid jet head that should be in contact with ink for the prevention of external ink leakage. More specifically, such bonded portions are the one between the back face of the orifice plate 400 and the front end face of the heater board 100, the back face of the orifice plate 400 and the front end face of the base plate 300, and the bonded portion between the ceiling plate 500 and the heater board 100, among some others. The sealant between each of them is caused to flow over within a specific area by means of the capillary force generated between each of the gaps and the sealant. The configuration of each component is devised so as not to allow the sealant to flow over into any other regions than those specifically designed, and the sealing is effectuated with the careful control of the part dimensions, the viscosity of sealant, and some others.

FIG. 2 is a cross-sectional view which shows the bonded state of the ceiling plate 500 and the heater board 100. As shown in FIG. 2, the pitches of the liquid flow paths (nozzles) 700 of the ceiling plate 500 and the pitches of the heater units 100*a* on the heater board 100 are set equally, and the machining of both components and the positioning thereof are made in high precision to enable each of the liquid flow paths (nozzles) 700 and each heater unit 100*a* to face each other in high precision for the enhancement of ink discharge accuracy.

Also, if a part of ink drops and flows to adhere to the circumference of the discharge ports when ink is discharged from the liquid jet recording head, it may cause the deviation of ink discharge direction or if the adhesion of ink is left intact for a long time, it is solidified to cause the ink clogging. In general, therefore, it is practiced to give the water repellent treatment to the entire surface of the orifice plate or to the circumference of the discharge ports locally. In this way, it is attempted to prevent ink from remaining on the circumference of the ink discharge ports. A water repellent treatment of the kind is given by injection or coating on the surface of the ceiling plate after the molding thereof or by the eutectoid plating, among some others.

As described above, the ceiling plate is molded integrally with the liquid flow path walls, the orifice plate, the ink liquid chamber, the ink supply port, and others to present a complicated configuration having minute portions and thinner thickness portions as well. Thus, in order to mold the ceiling plate, it is required to exercise the molding accuracy, such as dimensional accuracy, dimensional stability, transfer precision, fine deformation, as well as the filling capability with respect to the thinner thickness portions. To meet such requirement, the thorough control is needed for the molding environment, molding condition, material quality, and some others, which makes it very difficult to obtain the stably finished products.

Also, the ink liquid chamber is molded with the largely recessed portion on the contact surface thereof, which is open to the heater board, while the ink supply port is the through hole which is communicated with the ink liquid chamber. By the presence of these ink paths which serve as the ink supply means, there are provided a largely recessed portion and the through hole for the ceiling plate. As a result, when the ceiling plate is molded, several welds are naturally created in some locations.

Here, resin generates gas from inside when heated at a high molding temperature. In general, some method is adopted to enable the gas thus generated to escape to the outside of the metallic mold with the gas vents arranged at joints of the mold dowels or at the corners thereof. However, in the vicinity of each weld, a gas of the kind is not released to the outside of the metallic mold, but it may be stagnated there in some cases. In other words, the gas pushed by the fused resin that flows from behind joins the gas residing in the portion where the weld has been formed, and being sandwiched by the skin layers of resin approaching bidirectionally, the gas thus joined may lose the place to escape, and stagnated in that area eventually. As a result, the gas is confined inside completely. In this manner, the probability is high that the gas generated from inside the resin is confined in the weld portions without being released outside the metallic mold entirely, and that it remains residing in such portion.

Likewise, the same description may be made of the air residing in the interior of the metallic mold beforehand. In other words, the air deposited in the interior of the metallic mold before resin is filled is expelled from the gas vents by the pressure of resin which is injected at the time of filling. However, a part of the air should remain inside the metallic mold by being enclosed by the resin thus injected. In the weld portions, in particular, the probability is high that the air is enclosed more inside the resin that approaches bidirectionally as in the case of the gas as described earlier.

Thus, the gas and the air that are stagnated in the welds or the like are highly pressurized when receiving the filling pressure of resin, and this condition may impede the resin filling eventually. As a result, the transferability of the finished product is affected to make its precision inferior. For the conventional ceiling plate molding, the consideration should be given to these aspects carefully, and the molding condition should be controlled as to the gate arrangements, the gate sizes, the sprue sizes, and the runner sizes, the injection speeds, the injection pressures, the dwell, the molding temperatures, the inner pressures of the metallic mold, and each cycle time among various others.

However, for the liquid jet recording apparatus used as the output equipment for a personal computer, a copying machine, a facsimile equipment, or the like, it is now a prerequisite that the apparatus provides a resolution that matches the silver salt film. Along with this requirement, the size of the discharge ports, the width of liquid flow paths, the size of the heaters, and the arrangement pitches therefor should become more minute.

For example, when the ceiling plate that has a highly densified nozzles capable of performing the 1,200 dpi discharge at a time should be formed, there is a possibility that it becomes difficult not only to carry out the control of the forming conditions as described above, but also, it becomes impossible to remove the gas and the air residing in the vicinity of the welds. This incapability of gas or air removal may become a critical problem in the ceiling plate molding.

The portion of the finished ceiling plate that requires the highest precision is the flatness of the lower face of the liquid flow path walls. Usually, however, there occurs a warping of approximately several $\mu$m on the lower face of the liquid flow path walls of the ceiling plate. Therefore, this warping of the lower face of the liquid flow path walls are corrected by means of the pressure spring that compresses the liquid flow path walls downward from above it. At the same time, the lower face of the liquid flow path walls are kept in close contact with the heater board. Consequently, the ceiling plate which is in close contact with the heater board is not allowed to exert the inner stress or the inner distortion.

Then, if such inner distortion of the ceiling plate becomes greater, the adverse effect is produced on the ink discharges. In other words, if the warping of the lower face of the liquid flow path walls is corrected to keep them in close contact, the orifice plate is also warped accordingly by being influenced by the distortion of the circumference of the liquid flow path walls.

If the orifice plate warps, there is a possibility that the relative orientations and the relative positions of the discharge ports which are arranged in plural numbers are caused to change, hence degrading the accuracy in which ink droplets are impacted to lower the print quality eventually.

To counteract this phenomenon, there is a method in which the ceiling plate is molded by a material whose elasticity is greater so that the robustness of the ceiling plate is enhanced to make the inner distortion smaller when it is kept in close contact. If the robustness of the ceiling plate is made greater, it becomes difficult to correct the warping of the lower face of the liquid flow path walls. Then, there is a fear that defective contactness takes place with respect to the heater board. On the other hand, there is a method in which the compression of the pressure spring is made greater so that the entire region of the liquid flow path walls may be corrected. However, if the compressive force becomes greater, the inner stress of the ceiling plate is increased to make the inner distortion greater still.

If the contactness between the liquid flow path walls and the heater board is insufficient, the adjacent liquid flow path walls themselves are allowed to provide a gap with the heater board among a plurality of the liquid flow paths molded by bonding the liquid flow path walls and the heater board. As a result, the discharge pressure exerted on the heater board tends to be dispersed to the adjacent liquid flow paths to make the ink discharge speed unstable when recording is performed, and the ink droplets are twisted or ink is not discharged from the intended discharge ports when the recording signals are applied, but discharged from the adjacent discharge ports instead. Consequently, printing disturbance may take place to invite the degradation of the quality of recorded images.

Therefore, in order to effectuate the close contact between the lower face of the liquid flow path walls and the heater board exactly, there is a need for the molding of the ceiling plate with the liquid flow path walls whose warping is kept as small as possible.

In accordance with the conventional example, the ceiling plate is molded with a material whose elastic modulus is comparatively small so that the consideration is given to making the warping correction smoother for the liquid flow path walls. Here, in the conventional case, it is arranged to keep the amount of warping of the lower face of the liquid flow path walls at approximately 5 μm against the length of 13 mm of the liquid flow paths (closely contact surface) in the arrangement direction.

However, there is almost no influence to be exerted on the print quality even if the warping of approximately 5 μm is corrected for the close contact, but if it is intended to make the robustness of the ceiling plate greater, the warping of 5 μm on the lower face of the liquid flow path walls becomes a greater value, thus making it difficult to keep the liquid flow path walls in close contact.

Also, for the intended development of the ceiling plate which is provided with nozzles in a higher density, the 5 μm warping of the lower face of the liquid flow path walls, which has not presented a problem in accordance with the conventional art, becomes a problem which should be solved. In other words, the amount of the inner distortion of the ceiling plate that takes place after the close contact, which has not presented any problem conventionally, may exert a greater influence on the ink flow path unit if the liquid flow paths should be arranged in a higher density. Then, the ink discharge characteristics are degraded after all.

Therefore, it is necessary to overcome the problems existing in the conventional art along with the development of the liquid jet recording apparatus which is capable of recording in a high image quality. More specifically, it is preferable to form the ceiling plate having a greater rigidity in a better forming precision with the better surface precision of the lower face of the liquid flow path walls, with a smaller inner distortion after close contact. Then, to implement the ceiling plate in this mode, the level of the production technologies and techniques should be enhanced still more.

On the other hand, for the resin molding, it becomes more important to select the material which is excellent in presenting the dimensional stability in higher precision, without which it is not easy to enhance the level of the precision molding techniques, of thinner thickness portions. There is naturally a limit to the molding by the adoption of pure materials which do not contain any fillers. Then, to achieve these objectives, it is necessary to improve the properties of the material by filling the ceramics or metallic fillers.

Now, however, there are the following problems encountered in forming the ceiling plate by use of resin filled with the fillers or the like.

Now, firstly, there is a problem with respect to the laser processing. When the orifice plate is molded with resin, the fine holes provided therefor are made by the ablation process using the excimer laser. Now, with the excimer laser processing, the filler portion cannot be ablated. As a result, on the inner surface of each fine hole, fillers remain as extrusions or there is a fear that the fillers fall off from the surface to form recessed portions. The inner surface of each fine hole cannot be made smooth to cause the defective ink discharges.

Secondly, there is a problem concerning the production of metallic molds. Since the liquid flow path walls of the ceiling plate is each in a fine configuration, the mold dowel needed for transferring this configuration should be machined in an extremely high precision. Also, this mold dowel cannot be easily machined by use of a general machine tool, making it necessary to use a specially built machine tool with a special material. It also takes a long time to carry out such highly precise machining. Then, a mold dowel of the kind used for the transfer of the liquid flow path walls increases the manufacturing costs of the molds considerably as a whole. Moreover, this mold dowel is caused to slidably rub the fused resin at the time of injection, and to slidably move along the finished product when removed from the mold. Consequently, if the ceiling plate is molded by a material which is filled with fillers or the like, the mold dowel is quickly worn out to reduce the durability of the molds, which leads to the reduction of the ceiling plate productivity after all.

Thirdly, there is a problem concerning the flowability of the material to be used. For the ceiling molding, the selected material should present a good flowability in order to transfer the fine portions thereof exactly. In general, however, if resin filled with fillers, it tends to be subjected to the inferior flowability. This tendency is disadvantageous in transferring the thinner thickness portions and fine portions.

Fourthly, there is a problem concerning the fillers that impede the flow and transfer of resin. Since the width of each of the liquid flow path walls is as fine as several μm to tens and several μm in its , dimension, there is a possibility that the dimension of each of fibers, beads, or some other filler grains becomes larger than the thickness of each liquid flow path wall. If the ceiling plate is molded with resin filled with fillers, there is a possibility that not only the fillers are not transferred to the inside of the liquid flow path walls, but the fillers are stagnated in such a state of being bridged over the entrance portion of each groove so as to block the flow of fused resin that follows to run. As a result, the flow of resin is disturbed. Also, if the molding is made with resin filled with fillers, there is a case where the fillers are educed on the surface of the finished product. The fillers thus educed slidably rub the metallic mold at the time of removing it. As a result, the fillers may fall off from the surface layer of the finished product. Further, the fillers are not filled in the liquid flow path wall portions, the intended improvement of the performance of the liquid flow path wall portions does not act as effectively as anticipated.

To counter act this tendency, it may be possible to fill resin with the ultrafine filler particles of several μm to several nm which is smaller than the thickness of each liquid flow path for the molding of the ceiling plate. However, it is extremely difficult to disperse such ultrafine filler particles uniformly in the base resin. For that matter, it is extremely difficult to supply the stably prepared material.

Also, there is a need for the adoption of a special dispersion technique to disperse the ultrafine filler particles uniformly in the base resin, and at the same time, the surface treatment is needed for use of the ultrafine filler particles with the application of silane coupling agent or the like. Therefore, it costs extremely high to obtain the resin material which is filled with the ultrafine filler particles of the kind.

As described above, if the ceiling plate is molded by the resin whose physical property is enforced by the fillers thus filled in it, the enhancement of the forming precision is possible. However, due to the hindrance to the laser processing, the lowered quality of the finished product, the reduced durability of the metallic mold, and the inevitable use of higher cost molding material, this means is not necessarily an effective one for the purpose.

Therefore, in accordance with the conventional molding method, it is difficult to enhance the forming precision of the ceiling plate, the surface precision of the lower face of the liquid flow path walls, the robustness of the ceiling plate, and the like. To overcome such difficulty is the subject which should be dealt with to develop a highly densified liquid jet recording head.

Now, hereunder, the description will be made of the problems concerning the environments under which a liquid jet recording head is used and reserved.

If the temperature changes are great in the environment under which the liquid jet recording head is used, the voluminal expansion or contraction takes place with respect to various parts that constitute the liquid jet recording head. Then, there is a possibility that the positions of the bonded portions of the head are caused to deviate correlatively. The liquid flow path walls which are molded by the close contact between the ceiling plate and the heater board may produce an adverse effect on the ink discharge performance if the relative positions between them should be deviated greatly, because the configuration of the liquid flow path walls is extremely fine having the pitches of several tens of $\mu$m between each of them.

Now that the materials that form the heater board and the ceiling plate are different, a force tends to act upon them to deviate the relative positions between them. In other words, due to the inner stresses generated by the thermal expansion corresponding to the temperature changes, the heater board and the ceiling plate present the voluminal changes individually, which may bring about the deviation of the relative positions of the liquid flow path walls and the heater board, which are arranged to face each other and bonded.

On the other hand, the liquid flow path walls are compressed mechanically as described earlier. Due to this compression, a friction force is allowed to act upon between the liquid flow path walls and the heater board. With this friction force and the mechanical strength of the liquid flow path walls themselves, it is arranged to prevent the deviation of the relative positions between them.

Now, however, the action of this mechanical compression becomes less effective at the leading end portion of the discharge ports. As a result, although extremely minute, the relative positions between them may take place at the leading end portion of the discharge ports in some cases.

Further, for the liquid jet recording head which is provided with the discharge ports capable of obtaining the resolution of 1,200 dpi per discharge, for example, the nozzles are arranged in higher density with the extremely smaller dimension of the thickness of each liquid flow path wall, such as approximately several $\mu$m to several tens of $\mu$m. As a result, the friction force and the mechanical strength of the liquid flow path walls are made lower. Then, there is a possibility that the deviation of the relative positions between the liquid flow path walls and the heater board takes place, making it difficult to suppress such deviation of the relative positions.

In order to suppress such deviation of the relative positions, there is a method in which the compression of the pressure spring is increased or the friction force is increased on the contact surface of the liquid flow path walls. However, the greater the compression of the pressure spring, the greater becomes the inner distortion of the ceiling plate when the ceiling plate is in close contact. Then, the print quality is allowed to become inferior. Further, under the high temperature environment, the liquid flow path walls receive the thermal stress and weight of the pressure spring. Eventually, therefore, there is a possibility that the liquid flow path walls may present buckling, bending, or some other plastic deformation. For that matter, it is not advisable to increase the compression of the pressure spring too much.

Also, it may be possible to adopt the method whereby to form the ceiling plate with resin having a smaller linear expansion coefficient as another counter measure.

For example, it may be possible to contain fibers, beads, or some other fillers in polysulfone, polyether sulfone, denatured polyphenylene oxide, polyphenylene sulfide, polypropylene, polyimide, polyamide-imide, epoxy, polyethylene, LCP or some other resin which has an excellent property to resist ink (chemical resistance) so as to make its linear expansion coefficient smaller which matches metal. In this way, the LCP or resin material or pure material can be used for the molding of the ceiling plate.

When the ceiling plate is molded with the resin material which is enforced by fillers, there is an effect that the linear expansion coefficient of the finished product is lowered as described earlier. However, this method is accompanied by the drawback such as the inferior flowability, the inferior laser processing, the higher material costs. Thus, this means is not necessarily regarded as effective.

Here, therefore, the description will be made of a method for forming a ceiling plate by use of the resin whose linear expansion coefficient is smaller such as LCP.

The LCP is a resin that provides a good molding flowability even as its pure material grade, while it has a smaller linear expansion coefficient that matches that of metal.

On the other hand, polymer is not easily intermingled with this resin when it joins with the resin fused in the metallic mold. As a result, the weld strength is lower than the general polymer by a half or a quarter approximately. Also, this resin material has a drawback that its molding shrinkage coefficient or linear expansion coefficient is subjected to a greater anisotropy.

When the ceiling plate is molded with the LCP, it is important to pay careful attention to the gate positions to control the weld forming positions so that the mechanical performance and product capability are not spoiled due to the weld positions. Also, in some cases, it may be necessary to modify the product shape in order to control the weld forming positions.

Also, if the gate position control, the product shape modification, or some other control are not effective enough in dealing with the welds, there is a need for pushing out the welds from the finished product by devising the metallic mold in order to shift resin to a specific location compulsorily or to control orientation of resin or to operate the weld forming portions.

As specific examples, a resin pool may be installed on the outer side of the finished product but in the vicinity of the weld forming portions so that the structure is arranged to enable the mold dowel to advance to or retract from this resin pool. In other words, the mold dowel which has advanced into the resin pool is retracted from the resin pool at given timing during the filling of the fused resin. Thus, resin on the weld portion and the circumference thereof is allowed to flow in this resin pool for disposing thereof. In this respect, the mold dowel that advances to and retracts from the resin pool is controlled to shift by the driving means which is individually arranged. Also, the resin in the resin pool for its disposition is cut off together with the gate portion at the time of mold removal or after the removal.

In this way, the weld lines are partly removed from the finished product, hence making it possible to suppress the reduction of the mechanical strength of the finished product.

Also, as described above, the method for controlling the movement of the mold dowel by arranging the resin pool in the metallic mold is an effective means not only for the weld molding control, but for the resin anisotropy control and the resin orientation control as well. Then, this method is applicable to enhancing the forming precision, and also, to controlling the linear expansion coefficient, and the like.

Along with the provision of the higher resolution required for the liquid jet recording apparatus from now on as described above, the kind of the resin material that can be used suitably for the ceiling plate thereof is considerably limited. Also, even with the material that can be applied to the ceiling plate suitably, it becomes more difficult to control the molding thereof, and to improve the forming precision further still. Also, the structure of the metallic mold should become more complicated in order to control the resin orientation and perform the weld control as well. The molding apparatus should be specially arranged for the purpose, which requires more investment in facilities. There is also a problem that the higher molding techniques should obviously be required.

SUMMARY OF THE INVENTION

The present invention is designed with a view to making the overall improvement of the formability of the ceiling plate, including the structure of the ceiling plate, the forming precision and the dimensional stability thereof in order to attain the higher resolution technologies and techniques required for the liquid jet recording apparatus to be put on the market from now on. Then, it is an object of the invention to minimize the warping of the lower face of the liquid flow path walls, and at the same time, to overcome the weak points in the performance of the conventional ceiling plate, such as the thermal expansion and robustness, and some other related problems.

Now, with a view to solving the problems discussed above, the liquid jet recording head of the present invention is structured as given below.

The liquid jet recording head comprises a substrate member provided with discharge energy generating elements for generating ink discharge energy corresponding to a plurality of ink flow paths; a plurality of grooves corresponding to the plurality of ink flow paths; an orifice plate provided with ink discharge ports for discharging ink each communicated with each one end of the grooves; an ink liquid chamber communicated with each of the grooves at the other end thereof for supplying ink to each of the grooves; and an ink supply port for supplying ink to the ink liquid chamber. Then, a ceiling plate member, which is formed integrally with the grooves, the orifice plate, the ink liquid chamber, and the ink supply port, and the substrate member are bonded to form a plurality of ink discharge paths. For this ink jet recording head, the ceiling plate member is structured with a first substrate comprising the grooves and the orifice plate, and a second substrate comprising the ink liquid chamber and the ink supply port, and then, the first substrate and the second substrate are bonded by means of the bicolor molding to be integrally molded.

Also, the liquid jet recording head comprises a substrate member provided with discharge energy generating elements for generating ink discharge energy corresponding to a plurality of ink flow paths; a plurality of grooves corresponding to the plurality of ink flow paths; an orifice plate provided with ink discharge ports for discharging ink each communicated with each one end of the grooves; an ink liquid chamber communicated with each of the grooves at the other end thereof for supplying ink to each of the grooves; and an ink supply port for supplying ink to the ink liquid chamber. Then, a ceiling plate member, which is formed integrally with the grooves, the orifice plate, the ink liquid chamber, and the ink supply port, and the substrate member are bonded to form a plurality of ink discharge paths. For this ink jet recording head, the ceiling plate member is structured with an ink contact unit substrate provided with portions to be in contact with ink, and a non-ink contact unit substrate provided with portions not to be in contact with ink, and then, the ink contact unit substrate and the nonink contact unit substrate are integrally molded by means of the polychromatic molding.

Also, the liquid jet recording head comprises a substrate member provided with discharge energy generating elements for generating ink discharge energy corresponding to a plurality of ink flow paths; a plurality of grooves corresponding to the plurality of ink flow paths; an orifice plate provided with ink discharge ports for discharging ink each communicated with each one end of the grooves; an ink liquid chamber communicated with each of the grooves at the other end thereof for supplying ink to each of the grooves; and an ink supply port for supplying ink to the ink liquid chamber. Then, a ceiling plate member, which is formed integrally with the grooves, the orifice plate, the ink liquid chamber, and the ink supply port, and the substrate member are bonded to form a plurality of ink discharge paths. For this liquid jet recording head, the ceiling plate member comprises a first substrate provided with the grooves, the orifice plate, and a part of the outer wall of the ink liquid chamber to be generating elements for generating ink discharge energy corresponding to a plurality of ink flow paths; a plurality of grooves corresponding to the plurality of ink flow paths; an orifice plate provided with ink discharge ports for discharging ink each communicated with each one end of the grooves; an ink liquid chamber communicated with each of the grooves at the other end thereof for supplying ink to each of the grooves; and an ink supply port for supplying ink to the ink liquid chamber. Then, a ceiling plate member, which is formed integrally with the grooves, the orifice plate, the ink liquid chamber, and the ink supply port, and the substrate member are bonded to form a plurality of ink discharge paths. For this liquid jet recording head, the ink liquid chamber is separated into plural divisions by the separation walls integrally formed with the ceiling plate member, and the ceiling plate member comprises a first substrate provided with the grooves, the orifice plate, a part of the outer wall of the ink liquid chamber to be in close contact with the substrate member, and a part of the separation walls to be in close contact with the substrate member, and a second substrate provided with the portion of the ink liquid chamber with the exception of the first substrate, the separation walls with the exception of the first substrate, and the ink supply port, and then, the first substrate and the second substrate are bonded by means of the bicolor molding to be integrally molded.

Also, the liquid jet recording head comprises a substrate member provided with discharge energy generating elements for generating ink discharge energy corresponding to a plurality of ink flow paths; a plurality of grooves corresponding to the plurality of ink flow paths; an orifice plate provided with ink discharge ports for discharging ink each communicated with each one end of the grooves; an ink liquid chamber communicated with each of the grooves at the other end thereof for supplying ink to each of the grooves; and an ink supply port for supplying ink to the ink liquid chamber. Then, a ceiling plate member, which is formed integrally with the grooves, the orifice plate, the ink liquid chamber, and the ink supply port, and the substrate member are bonded to form a plurality of ink discharge paths. For this liquid jet recording head, the orifice plate is divided into the orifice plate lower part having the discharge ports, and the orifice plate upper part excluding the discharge port with above the discharge ports as the boundary, and the ceiling plate member comprises a first substrate provided with the grooves and the orifice plate lower part, and a second substrate provided with. the orifice plate upper part, the ink liquid chamber, and the ink supply port, and then, the first substrate and, the second substrate are integrally molded by means of the bicolor molding.

Also, the liquid jet recording head comprises a substrate member provided with discharge energy generating elements for generating ink discharge energy corresponding to a plurality of ink flow paths; a plurality of grooves corresponding to the plurality of ink flow paths; an orifice plate provided with ink discharge ports for discharging ink each communicated with each one end of the grooves; an ink liquid chamber communicated with each of the grooves at the other end thereof for supplying ink to each of the grooves; and an ink supply port for supplying ink to the ink liquid chamber. Then, a ceiling plate member, which is formed integrally with the grooves, the orifice plate, the ink liquid chamber, and the ink supply port, and the substrate member are bonded to form a plurality of ink discharge paths. For this liquid jet recording head, the orifice plate is divided into the orifice plate lower part having the discharge ports, and the orifice plate upper part excluding the discharge port with above the discharge ports as the boundary, and the ceiling plate member comprises a first substrate provided with the grooves and the orifice plate lower part, and a part of the portion of the outer wall of the ink liquid chamber to be in close contact with the substrate member, and a second substrate provided with the orifice plate upper part, the ink liquid chamber with the exception of the first substrate, and the ink supply port, and then, the first substrate and the second substrate are bonded means of the bicolor molding to be integrally molded.

Also, the liquid jet recording head comprises a substrate member provided with discharge energy generating elements for generating ink discharge energy corresponding to a plurality of ink flow paths; a plurality of grooves corresponding to the plurality of, ink flow paths; an orifice plate provided with ink discharge ports for discharging ink each communicated with each one end of the grooves; an ink liquid chamber communicated with each of the grooves at the other end thereof for supplying ink to each of the grooves; and an ink supply port for supplying ink to the ink liquid chamber. Then, a ceiling plate member, which is formed integrally with the grooves, the orifice plate, the ink liquid chamber, and the ink supply port, and the substrate member are bonded to form a plurality of ink discharge paths. For this liquid jet recording head, the ink liquid chamber is separated into plural divisions by the separation walls integrally molded with the ceiling plate member, and the orifice plate is divided into the orifice plate lower part having the discharge ports, and the orifice plate upper part excluding the discharge port with above the discharge ports as the boundary, and the ceiling plate member comprises a first substrate provided with the grooves and the orifice plate lower part, and a part of the portion of the outer wall of the ink liquid chamber to be in close contact with the substrate member, and the separation walls with the exception of the first substrate, and a second substrate provided with the orifice plate upper part, the ink liquid chamber with the exception of the first substrate, the separation walls with the exception of the first substrate, and then, the ink supply port, and the first substrate and the second substrate are bonded by means of the bicolor molding to be integrally molded.

Also, the liquid jet recording head comprises a substrate member provided with discharge energy generating elements for generating ink discharge energy corresponding to a plurality of ink flow paths; a plurality of grooves corresponding to the plurality of ink flow paths; an orifice plate provided with ink discharge ports for discharging ink each communicated with each one end of the grooves; an ink liquid chamber communicated with each of the grooves at the other end thereof for supplying ink to each of the grooves; and an ink supply port for supplying ink to the ink liquid chamber. Then, a ceiling plate member, which is formed integrally with the grooves, the orifice plate, the ink liquid chamber, and the ink supply port, and the substrate member are bonded to form a plurality of ink discharge paths. For this liquid jet recording head, the orifice plate is divided into the orifice plate lower part having the discharge ports, and the orifice plate upper part excluding the discharge port with above the discharge ports as the boundary, and the ceiling plate member comprises an ink contact unit substrate provided with the portions to be in contact with ink, and a non-ink contact unit substrate provided with the portions not to be in contact with ink, and then, the ink contact unit substrate and the non-ink contact unit substrate are bonded by means of the polychromic molding to be integrally molded.

Also, the liquid jet recording head comprises a substrate member provided with discharge energy generating elements for generating ink discharge energy corresponding to a plurality of ink flow paths; a plurality of grooves corresponding to the plurality of ink flow paths; an orifice plate provided with ink discharge ports for discharging ink each communicated with each one end of the grooves; an ink liquid chamber communicated with each of the grooves at the other end thereof for supplying ink to each of the grooves; and an ink supply port for supplying ink to the ink liquid chamber. Then, a ceiling plate member, which is formed integrally with the grooves, the orifice plate, the ink liquid chamber, and the ink supply port, and the substrate member are bonded to form a plurality of ink discharge paths. For this liquid jet recording head, the surface of the orifice plate is formed in the uniform plane or the uniform curve, and the ceiling plate is structured with a first substrate comprising the orifice plate including at least the circumferential portion of the discharge ports, and the grooves, and a second substrate comprising the portions with the exception of the portions becoming the first substrate, and then, the first substrate and the second substrate are bonded by means of the bicolor molding to be integrally molded.

In accordance with the present invention, the complicatedly configured ceiling plate member is divisionally molded, and integrally molded by means of the polychromic molding. Particularly, the thinner thickness portion of the orifice plate and the minute portion of the ink flow path walls are separated to be in a simple configuration. Therefore, it becomes possible to mold these portions in good precision. In other words, the portions that require high molding precision are simply configured, and then, the portions thus simplified in its configuration, and the other portions are integrally molded by means of the polychromic molding. The ceiling plate member thus completed becomes a highly precise finished product. Also, with the polychromic molding combined with various resins, fillers, metallic alloys, and the like, it becomes possible to mold a highly functional ceiling plate member in high precision, which has never been implement by means of the monochromatic molding.

The orifice plate and the ink flow path walls of the ceiling plate member, which are most important portions, require the high precise transfer, the smaller warping, the laser processibility, the durability of metallic mold, and the like for the molded surface thereof. Also, for the performance aspect, the high robustness, the lower linear expansion coefficient are required, among some others. If the ceiling plate member is molded with resin that contains fillers or the like, it becomes difficult to satisfy the condition of the molded surface, although the aforesaid aspect of the performance can be satisfied. As a result, the material that contains fillers cannot be used in accordance with the conventional art.

Therefore, if the ceiling plate member is divided into a first substrate formed with the orifice plate and the ink flow path walls, and a second substrate formed with all the other portions, and then, integrally molded by means of the bicolor molding, the condition of the molded surface can be satisfied for the first substrate even by molding it with the conventional material. Here, meanwhile, the second substrate should be molded with the material that improves the performance aspect of the ceiling plate member.

Also, with the first substrate having a simple configuration having a uniform thickness, the transferability, the molding precision, and the surface precision of the ink flow path wall lower face are enhanced. Then, when these substrates are bonded by means of the polychromic molding, it becomes possible to implement the enhancement of the performance aspects of the completed ceiling plate member, such as the elastic modulus, the linear expansion coefficient, which have been the drawback of the conventional art without sacrificing the requirement of the molded surface.

Now, in order to effectively improve the performance of the first substrate (the orifice plate and the ink flow path walls) by the application of the property of the material used for the second substrate, it become important to configure both the first and second substrates and arrange the configuration of the bonded portion accordingly. In other words, among some others, the second substrate should embrace the circumference of the ink flow path portion; the first substrate should be molded as thin as possible; and the voluminal ratio of the second substrate should be larger than the first substrate. In this manner, the structural aspect should be developed, and then, if the second substrate is molded with the molding material that can implement the improvement of the performance of the first substrate, it becomes possible to complement the weakness of the first substrate.

It has been difficult to mold the ceiling plate member that can satisfy both functions of the molded surface and performance required for the orifice plate and ink flow path walls of the ceiling plate member by means of the monochromatic molding. However, with the complex molding of the ceiling plate member, such as the polychromatic molding using plural materials, it becomes possible to satisfy both functions, which are incompatible to each other, that is, the aspects of the molded surface and the performance thereof.

Therefore, for the first substrate, pure resin having a good flowability and transferability is used to mold it in high precision. For the second substrate, the resin (or metallic alloy) filled with fillers is used, and if both of them are integrally molded by means of the bicolor molding. Then, it is made possible to complete the multiply functional ceiling plate member which has never been obtainable conventionally.

In this respect, since the first substrate is simply configured and molded with the material having a good flowability, the molding precision is enhanced. Meanwhile, although the configuration is complicated, the second substrate is molded with the material that contains fillers to make it possible to implement the precise molding, because the molding shrinkage, anisotropy, and other molding condition are improved. As a result, the integrally molded product by means of the polychromic molding becomes a ceiling plate member having high precision, high robustness, resistance to the thermal expansion, and the performance aspect thereof is enhanced significantly.

Also, since the first substrate is molded individually and separated from the ink liquid chamber and ink supply port, which cause the creation of welds, it becomes possible to prevent the gas generated from resin and the air in the metal mold from being stagnated in the interior of the metal mold, hence degrading the transferability of the molded product. As a result, it is possible to deal sufficiently with molding the ceiling plate provided with highly densified nozzles for use of the higher resolution liquid jet recording head which should be made available from now on. On the other hand, the welds may be created for the second substrate, but having no minute portions, the molding precision is not required for it as in the case of the first substrate. With the selection of material having high elastic modulus, and lower linear expansion coefficient for the second substrate, it is attempted to improve the performance of the ceiling plate as a whole.

Also, when the resin that contains fillers or the like is used for the second substrate, the first and second substrates can be bonded firmly by means of the bicolor molding if the base resin of the second substrate is the same as the pure material used for the first substrate. Then, the second substrate can implement the first substrate structurally with respect to the thermal expansion, the elastic modulus, and some other aspects of its performance. In this way, the weakness of the first substrate is improved effectively.

Also, on the bonded interface between the first and second substrates, the irregular lines are arranged in the form of ribs, bellows, bosses, seats, rectangles, or the like to make the bonding area greater and bonding stronger between them.

Also, with the irregular lines arranged on the bonded surface between the first and second substrates, while the second substrate is bonded with resin having a smaller linear expansion coefficient, it becomes possible to suppress the voluminal changes of the first substrate even when the ceiling plate member is placed under the environment having great temperature changes, because the second substrate can block it structurally with the irregular lines arranged on the boundary surface between them.

Furthermore, if the irregular lines should be formed to be undercut in the releasing direction of the first substrate and the second substrate, both of them are molded integrally even if both of them are molded with different materials or the bonding strength is smaller between them. As a result, the second substrate can implement the weakness of the first substrate.

Also, if the arrangement of the irregular lines are made in the same direction as the arrangement direction of the ink flow path walls, it becomes possible to suppress the deviation of the relative positions of the discharge heaters and the ink flow paths up to the ink discharge ports.

Also, if the ceiling plate member is divided into the ink contact unit substrate that is in contact with ink and the non-ink contact unit substrate that is not in contact with ink, and then, if it is molded by the polychromic molding, there is no need for the non-ink contact unit substrate to be provided with the ink resistive performance. As a result, it becomes possible to select various molding materials, and fillers, and to mold this substrate by use of an inexpensive base resin, a highly precise base resin, or the base resin which has an excellent mechanical strength with various fillers being contained in any one of them.

Also, if the ceiling plate is structured integrally by means of the three color molding with the ink discharge substrate formed by the orifice plate and ink flow path walls; the ink supply unit substrate formed by the inner wall of the ink liquid chamber, and the inner wall of the ink supply port; the outer circumferential portion substrate formed by the circumferential portions of the ceiling plate, each of the substrates can be molded with the optimal material, such as the material preferably suitable for the, precise molding of the ink supply unit substrate, the material which has a good resistance to ink for the ink supply unit substrate, and an inexpensive material for the outer circumferential portion substrate, respectively.

Also, if the structure is arranged so that the surface layer of the orifice plate is separated from the orifice plate main body, and that the orifice plate surface layer is molded with the material having a good water repellency. Then, this water-repellent surface layer is bonded with the ceiling plate member by means of the bicolor molding or polychromic molding to be integrally molded. In this manner, the water repellency treatment given to the orifice plate surface layer in the secondary process in the conventional art is now executed at the time of the bicolor or polychromic molding to simplify the manufacturing process of the ceiling plate member.

Also, when the polychromic molding is executed, the core portion of the metallic mold is processed to be the same configuration for the two locations in the case of the bicolor molding in general, for example. On the other hand, the two locations of the cavity portion of the metallic mold is given the processing that matches the molding configuration on the primary side and also, the one that matches the molding configuration on the secondary side, respectively. Now, if the groove (nozzle) portion should be transferred to the core side, two sets of the expensive mold dowels are needed for use of the groove transfer to increase the manufacturing costs of the metallic mold. Therefore, with the arrangement of the metallic mold structure so that the groove portion is transferred for molding on the cavity side, the manufacturing costs of the metallic mold for use of the bicolor molding become inexpensive. In this respect, the same statement is applicable to the polychromic molding where the third or more material injections are performed.

Also, the groove portion is molded on the primary side, the groove portion, which has been released once from the cavity on the primary side, this portion is in the released state (in the state where it is not in contact with the metallic mold) in the interior of the cavity on the secondary side, hence being easily influenced at the time of resin molding on the secondary side. In other words, since the resin on the secondary side is filled, while flowing on the boundary surface corresponding to the upper face of the groove portion, the thermal stress, the inertial force on the resin on the secondary side, the shearing force from the resin on the secondary side, and the like are caused to act to make the molding precision of the groove portion inferior. In order to avoid the groove, portion from being affected by the following continuous resin injection, the injection molding is arranged to be performed on the secondary side. Then, it becomes possible to secure the stabilized molding precision. Also, naturally, it is advisable to mold this portion lastly when the polychromic molding is performed.

Also, since the ink liquid chamber lower face portion and the groove portion are molded integrally, it is possible to form the step between the ink liquid chamber lower face and the ink flow path wall lower face in good precision even if the ceiling plate member is molded by means of the polychromic molding. In other words, the dowel portions that transfer the ink liquid chamber lower face and the ink flow path lower face are arranged in one and the same metal mold. As a result, it becomes easier to secure the step precision between them even at the time of manufacturing the metallic mold.

Further, for the ink jet recording head capable of discharging many kinds of ink with a plurality of ink liquid chambers, the separation wall lower part portion in the ink liquid chamber and the ink liquid chamber outer wall lower part portion are structured integrally with the groove portion. Then, it also becomes possible to mold the steps between the separation wall lower face, the ink liquid chamber lower face, and ink flow path wall lower face in good precision.

Therefore, the configuration of the substrate having the portions that require high precision is made as simple as possible, and such simply configured part and the other part are integrated by means of the polychromic molding. Then, the completed ceiling plate member is the product molded in high precision. Also, with the polychromic molding combined with various resins, ceramics, metals, fillers, and the like, it becomes possible to mold the multiply functional ceiling plate member in high precision that has never been implemented by means of the monochromatic molding.

For the ceiling plate member, the orifice plate and the ink flow path walls are most important portions, and the following aspects are important as to the molded surface. In other words, for the orifice plate, it is required to provide the highly precise flatness and the dimensional stability so as to form the discharge ports for which the desired shape and the desired length are secured. For the ink flow path walls, it is required to provide the highly precise transfer with the smallest possible warping in order to supply ink assuredly and execute the stabilized ink discharges. Also, if the discharge ports and ink flow path walls are formed by means of laser processing, the laser processibility of the molding resin is extremely important.

On the other hand, the higher robustness and lower linear expansion coefficient are required for the aspect of the performance. In order to satisfy such aspect of the performance, it is necessary to improve the ceiling plate molding material. Here, the compound resin that contains fillers is effective. However, if molding is executed with material that contains fillers, the condition of the molding surface described above is affected by the presence of fillers, although the performance is satisfied. As a result, it has been impossible to use the material which is filled with fillers up to now.

Therefore, if the ceiling plate member is structured to be divided into the first substrate provided with the orifice plate lower part including the discharge ports and the ink flow path walls, and the second substrate provided with the orifice plate upper part, the ink liquid chamber, and the ink supply port, and then, integrally by means of the bicolor molding, the first substrate is molded with the conventional material, hence satisfying the condition of the molded surface of the orifice plate (discharge ports) and the ink flow path wall portion. On the other hand, the second substrate is molded with the material prepared for the purpose of improving the performance of the ceiling plate member. Then, both of them is integrated by means of the bicolor molding to provide a higher performance for the ceiling plate member, which has never been implemented conventionally.

The portion whose thickness is extremely small, such as the orifice plate, has a large resistance to the resin flow, and if the thinner thickness portion of the kind is extended over the wide range, it becomes extremely difficult to fill resin. For that matter, the viscosity of resin should be lower, and the flowability thereof should be higher. As a result, the selection range becomes narrower for the resin to be used. On the other hand, it becomes severer to control the temperature of metallic mold, the resin temperature, the injection pressure, injection speed, and to adjust the metallic mold, among some other molding conditions required.

Now, therefore, the orifice plate is divided into the upper part and the lower part, and then, the molding is performed separately in two processing steps, such as the orifice plate lower part is molded at the time of the first substrate molding, and the orifice plate upper part is molded at the time of the second substrate molding. In this manner, the area of thinner thickness portion becomes smaller per molding process. Then, as compared with the case where the entire body of the orifice plate is molded at a time, the formability is enhanced significantly, and the molding precision is further enhanced as well.

Particularly, for the first substrate having the minute ink flow path walls and the thinner orifice plate, the orifice plate is divided, and then, when the upper part of the orifice plate is removed, the area of the thinner thickness portion is made smaller. Thus, the difficulty with which the first substrate should be molded is reduced significantly.

Also, if the structure is arranged so that the ceiling plate member is divided into the first substrate provided with the orifice plate lower part including the discharge ports, ink flow path walls, and a part of the ink liquid chamber outer wall portion which is in contact with the substrate member (heater board), and the second substrate provided with the orifice plate upper part, the ink liquid chamber portion excluding the first substrate, and the ink supply port, and that these substrates are integrated by means of the bicolor molding, the lower face portion of the ink liquid chamber outer wall, and the groove portion are molded in one and the same process. Therefore, the step between the ink liquid chamber lower face and the ink flow path wall lower face is molded in good precision even if the ceiling plate member is molded by means of the polychromic molding. In other words, the dowel portions, which transfer the ink liquid chamber lower face and the ink flow path wall lower face, are arranged in one and the same metallic mold to make it easier to secured step precision between them when the metallic mold is manufactured.

Furthermore, for the liquid jet recording head capable of discharging many kinds of ink with the arrangement of plural ink liquid chambers, the separation wall lower face of the ink liquid chamber, the lower face portion of the ink liquid chamber outer walls, and the groove portion are molded in one and the same process. Therefore, the step between the separation wall lower face, the ink liquid chamber lower face, and ink flow path wall lower face is also molded in good precision.

In this respect, the second substrate is complicatedly configured, but it is molded with the material that contains fillers or the like. As a result, the mold shrinkage, anisotropy, and some other molding condition are improved to make it possible to perform the highly precise molding. Therefore, the finished product having the second substrate and the first substrate integrated by means of the polychromic molding becomes the ceiling plate member provided with high precision, high robustness, resistance to thermal expansion, which has never been implemented conventionally, and its performance is enhanced significantly.

Also, the surface of the orifice plate is in the uniform plane or in the uniform curve. As a result, unlike the case where the step is formed on the surface of the orifice plate, it becomes possible to wipe off (carry out wiping) the remaining ink on the orifice plate reliably. Thus, the size of the capping member can be made smaller. Also, the blade can slidably move on the surface of the orifice plate to make it possible to enhance the durability of the blade accordingly. As a result, the blade can be produced with an inexpensive material. Furthermore, there is no step on the surface of the orifice plate completely or the step, if any, is extremely small. The resultant distance from the discharge ports to a recording medium becomes smaller to make it possible to enhance the impact accuracy of ink to be discharged from the discharge ports.

Particularly, the orifice plate is divided into the upper and lower parts, and the first substrate is arranged to contain the minute liquid flow path walls, and the lower part of the thinner orifice plate. In this manner, the area of the thinner thickness portions becomes smaller to facilitate the molding of the first substrate. Also, with the simple configuration having the uniform thickness, it becomes possible for the first substrate to enhance the transferability, the molding precision, and the surface precision of the liquid flow path wall lower face, among some others. Then, the first and second substrates are bonded by means of polychromic bonding, hence attempting the improvement of the elastic modulus, the linear expansion coefficient, and some other aspects of the performance of the completed ceiling plate.

Now, if the second substrate is molded with the material that contains fillers, the texture of the fillers is orientated in the arrangement direction of the groove line, provided that the gate is arranged to allow the molding material to flow to the vicinity above the groove line of the first substrate. The robustness, the thermal expansion ratio, and other properties, which are provided for the molding material, are made available to the maximum in the arrangement direction of the groove line.

Also, for the first substrate, the area where the molding material should be filled becomes narrower than the case where the entire body of the ceiling plate member is molded at a time, and at the same time, the distance from the gate portion to the liquid flow path walls is shortened, hence allowing the molding material to arrive at the liquid flow path wall portion without any excessive detoured passages. As a result, it becomes possible to fill the molding material into the metallic mold quickly and effectively at the time of the injection process. Then, during the dwelling process, the pressure thus swelled acts upon in all the directions in the metallic mold to make it possible to significantly enhance the transferability of the liquid flow path walls which present the minute portions. As a result, an easier implementation is possible from now on for the transfer of the liquid flow path wall portions than the conventional art even if the discharge ports are arranged in density higher still.

Also, the gate is positioned at the end face of the orifice plate for the first substrate to enable the molding material injected from the gate to advance straightly up to the discharge port circumferential portion. Therefore, the pressure loss of the molding material is made extremely smaller to facilitate filling the molding material in the metallic mold when the first substrate is molded. In this manner, the stepped portions are removed from the surface of the orifice plate to make the entire body of the orifice plate thinner, hence implementing the transfer of the thinner thickness portion of the orifice plate and minute portions of the liquid flow path walls.

Further, the second substrate is molded with the material enforced with fillers or the like, and at the same time, a part of the orifice plate is molded by the second substrate. Then, it becomes possible to make the strength of the orifice plate greater.

As described above, The configuration of the first substrate is simplified to make it possible to arrange the gates efficiently. Therefore, the higher filling and the highly precise molding are possible when the first substrate is molded. Furthermore, there is no need for the provision of any steps for the orifice plate, hence facilitating the cleaning operation and the capping, among some others. On the other hand, if the second substrate is molded with the material filled with fillers or the like (resin, metal, ceramics, or the like), it becomes possible to obtain a higher robustness, a lower thermal expansion coefficient, a higher molding precision, and the like. In other words, with the first and second substrates integrated by means of the bicolor molding, it becomes possible to complete the multiply functional ceiling plate member in high precision, which has never been obtainable conventionally.

DETAILED DESCRIPTION OF THE PREFERRED EMBODIMENTS (First Embodiment)

In conjunction with FIG. 3 to FIG. 7, the description will be made of the liquid jet recording head in accordance with a first embodiment of the present invention.

Figure 3:
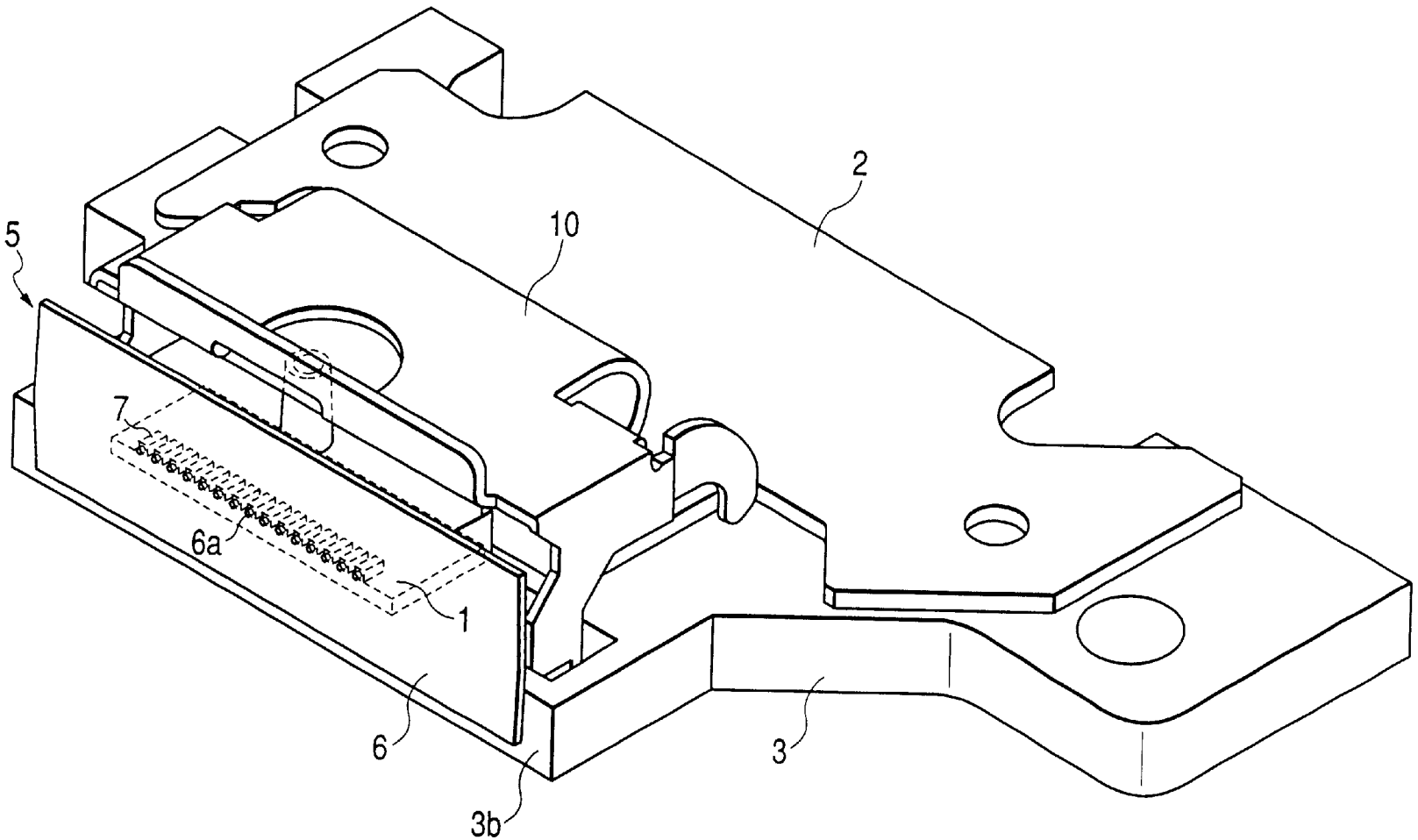
FIG. 3 is a perspective view which shows the outer appearance of one example of the chip structure of a liquid jet recording head in accordance with a first embodiment of the present invention.
Figure 4:
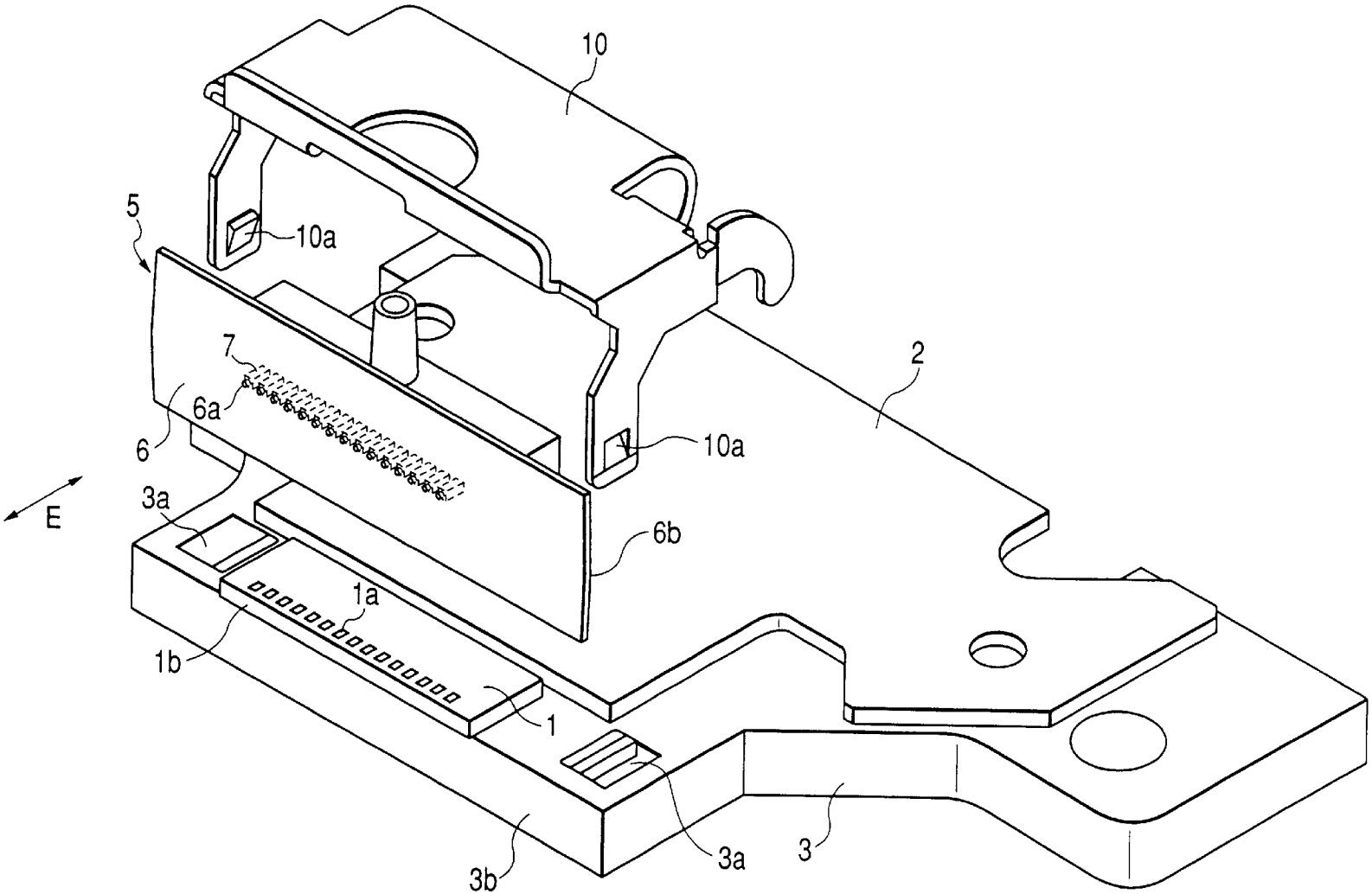
FIG. 4 is an exploded perspective view which shows the liquid jet recording head represented in FIG. 3.
Figure 5:
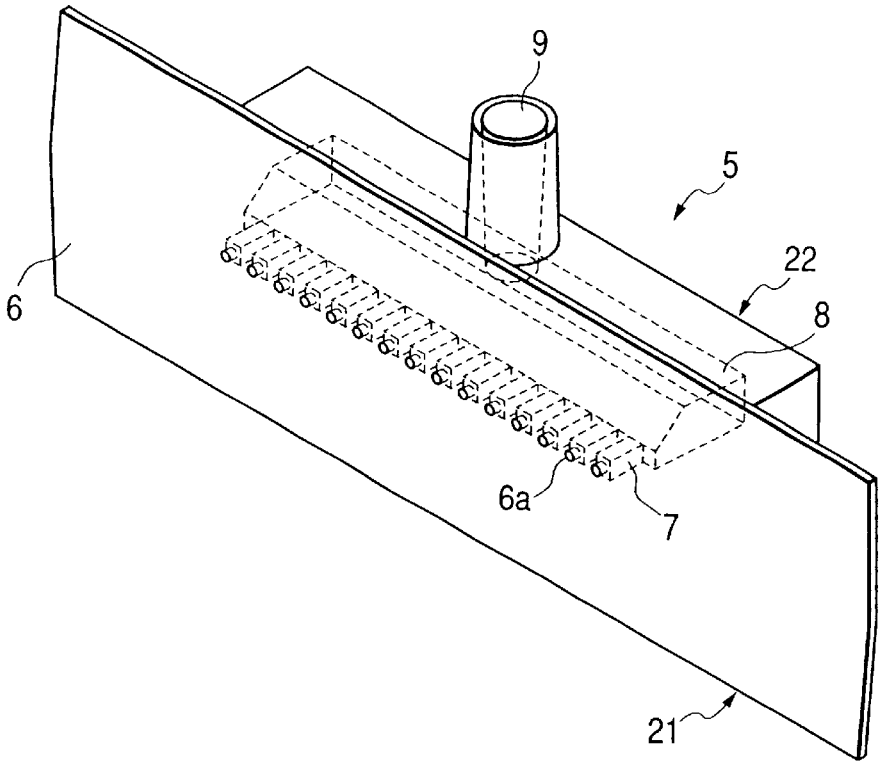
FIG. 5 is a perspective view which shows the ceiling plate represented in FIG. 3, observed from the front face side.
Figure 6:
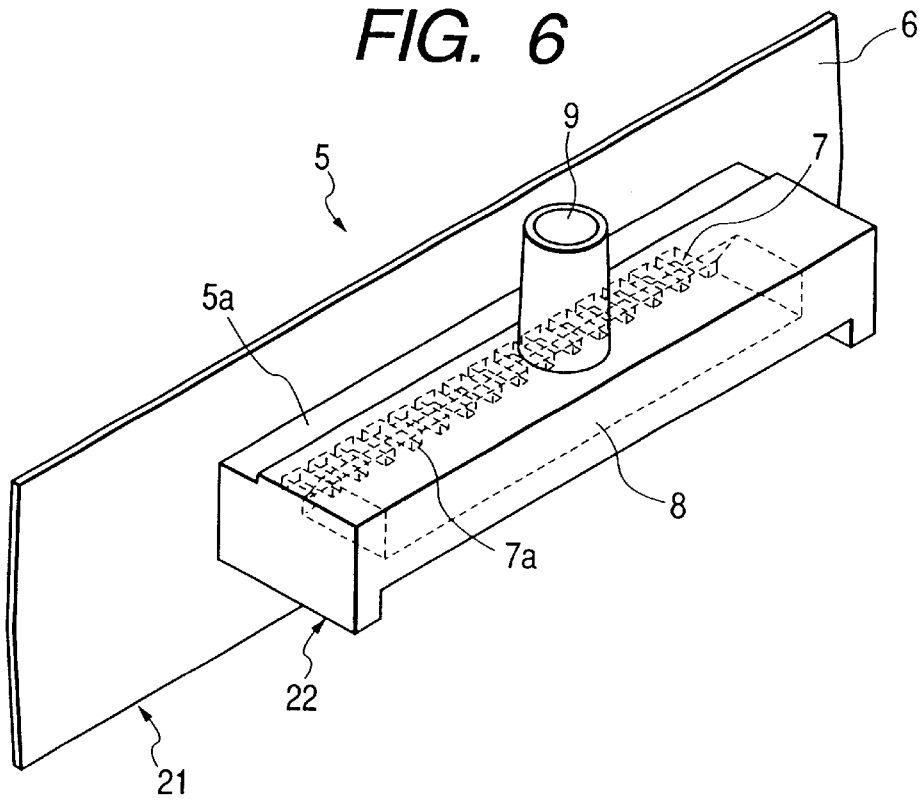
FIG. 6 is a perspective view which shows the ceiling plate represented in FIG. 3, observed from the back face side.
Figure 7:
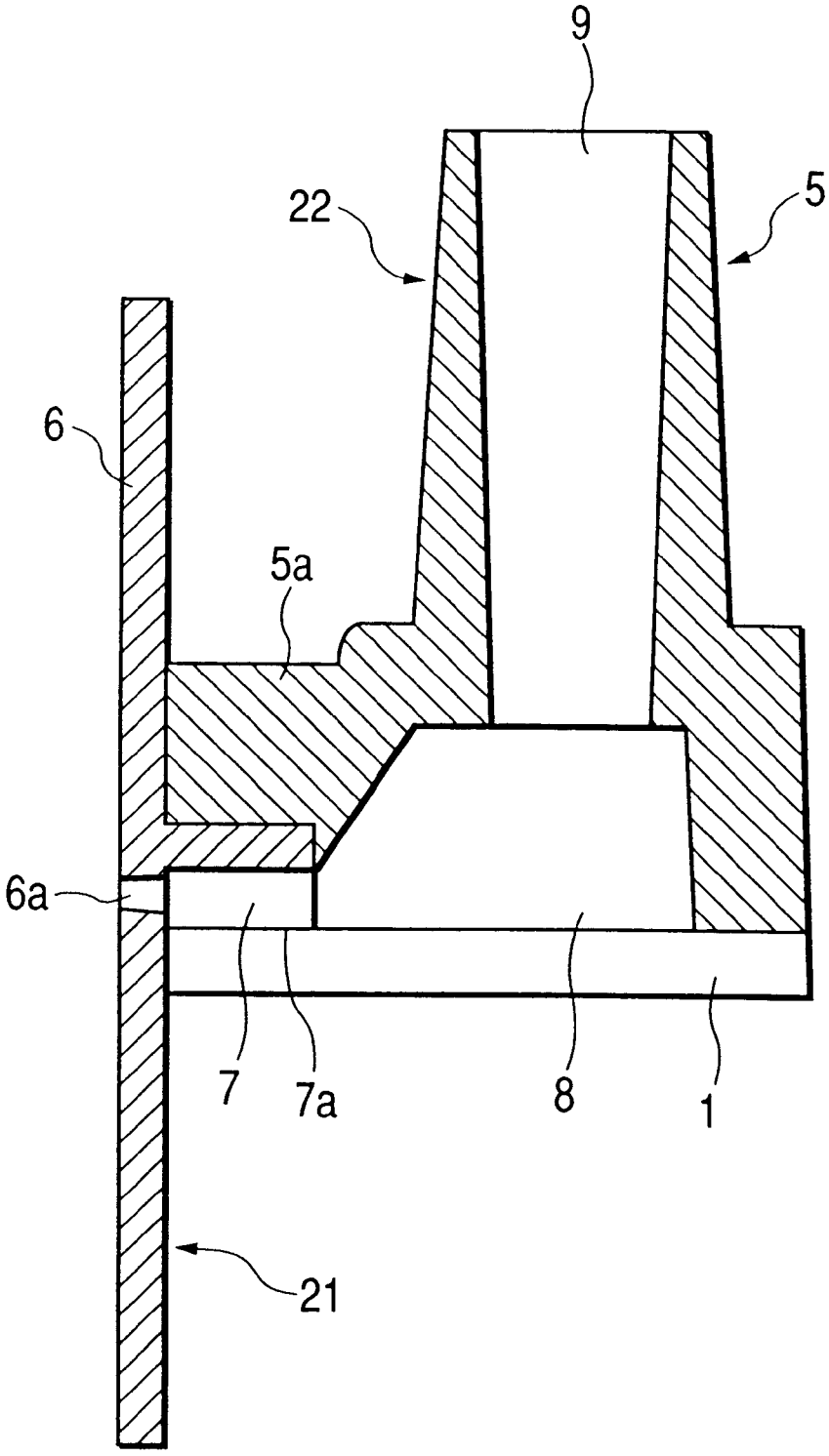
FIG. 7 is a cross-sectional view which shows the ceiling plate represented in FIG. 3.

FIG. 3 is a perspective view which shows the outer appearance of one example of the chip structure of a liquid jet recording head in accordance with a first embodiment of the present invention. FIG. 4 is an exploded perspective view which shows the liquid jet recording head represented in FIG. 3. FIG. 5 is a perspective view which shows the ceiling plate represented in FIG. 3, observed from the front face side. FIG. 6 is a perspective view which shows the ceiling plate represented in FIG. 3, observed from the back face side. FIG. 7 is a cross-sectional view which shows the ceiling plate represented in FIG. 3.

At first, the structure of the liquid jet recording head will be described.

As shown in FIG. 3 and FIG. 4, the heater board 1 is formed by the silicon substrate by the application of the silicon film molding process together with the electrothermal transducing devices (discharge heaters) 1*a* serving as the energy generating elements to discharge ink, and the wiring that supplies electric power to the discharge heaters 1*a*. The wiring arranged on the heater board 1 is electrically connected with the wiring substrate 2 by use of wire bonding, for example. Then, with the wiring substrate 2, the heater board 1 and the main body of the ink jet recording apparatus are electrically connected. As the wiring substrate 2, there is adopted a PWB substrate produced by forming the wiring pattern with copper or nickel on the glass epoxy substrate or the TAB film or the like formed by a flexible film or the like with the wiring pattern on it.

The heater board 1 and the wiring substrate 2 are installed a supporting substrate (hereinafter referred to as the base plate) 3 which is formed of aluminum or the like. The heater board 1 is mold bonded on the base plate 3. Then, the wiring substrate 2 is adhesively bonded on the base plate 3 by the application of adhesives or the like. The base plate 3 also functions as the heat sink to cool and radiate the heat of the heater board 1 generated along with the driving of the discharge heaters 1*a*.

On the area of the base plate 3, which includes the heater board 1, the ceiling plate 5 is bonded to form the ink flow paths. The ceiling plate 5 comprises the orifice plate 6 having a desired number of ink discharge ports 6a arranged on it to discharge ink onto' a recording medium; the nozzles 7 serving as the ink flow paths communicated with the ink discharge ports 6*a,* which are formed by the recessed grooves on the lower face of the ceiling plate 5 corresponding to each of the ink discharge ports 6*a;* the ink chamber 8 serving as the sub-tank to supply ink to the nozzles 7, which is recessed on the lower face of the ceiling plate 5; and the ink supply port 9 to supply ink from the ink storage tank (not shown) to the ink liquid chamber 8. In this respect, the ceiling plate 5 is molded integrally by means of the bicolor molding which will be described later.

The thickness of the orifice plate 6 is several tens of dam to several hundreds of $\mu$m. However, the greater the thickness, the longer the process time becomes and the lower the processing accuracy when the ink discharge ports 6*a* are formed by laser processing. In general, therefore, the orifice plate is formed in an extremely thin thickness of 30 $\mu$m to 80 $\mu$m.

Also, the nozzles 7 are formed in extremely minute dimensions: its thickness is several $\mu$m to several tens of $\mu$m at its leading end of the grooved walls, which serves as the close contact surface with the heater board 1, and the depth of the grooves is several tens of $\mu$m to several hundreds of $\mu$m each. For example, if the nozzle line should be formed for the 600 dpi resolution, the nozzle line is arranged at pitches of approximately 42.3 $\mu$m.

Since the orifice plate 6 and nozzles 7 are extremely thin and minutely configured, the ceiling plate is molded by use of a high-speed injection molding machine with a forming material having an excellent flowability by removing the air and the gas in the metallic mold assuredly.

Here, for the structure of the ceiling plate 5, there is the one where the orifice plate 6, the nozzles 7, the ink chamber 8 and the ink supply port 9 and all others are molded together as one body or the one where only the orifice plate 6 is molded separately, among some others.

The ceiling plate 5 is in close contact with the heater board 1 by means of the pressure spring 10. The pressure spring 10 is aligned so as to enable the relative positions of the discharge heaters 1*a* and nozzles 7 to be in agreement completely, and then, to press the ceiling plate 5 from the receptacle 5*a* arranged above the nozzles 7. In other words, the nails 10*a* provided for the lower part of each end of the pressure spring 10 are inserted into each of the holes 3*a* formed on the base plate 3 to be hooked on the lower face of the base plate 3. In this manner, the pressure spring 10 compresses the receptacle 5*a* of the ceiling plate 5 to exert the mechanical pressure on the contact portions on the lower face 7*a* of the nozzles. With the compression of this pressure spring 10, the walls of the nozzles 7 are in close contact with the heater board 1, hence completely separating nozzles 7 from each other.

Figure 1:
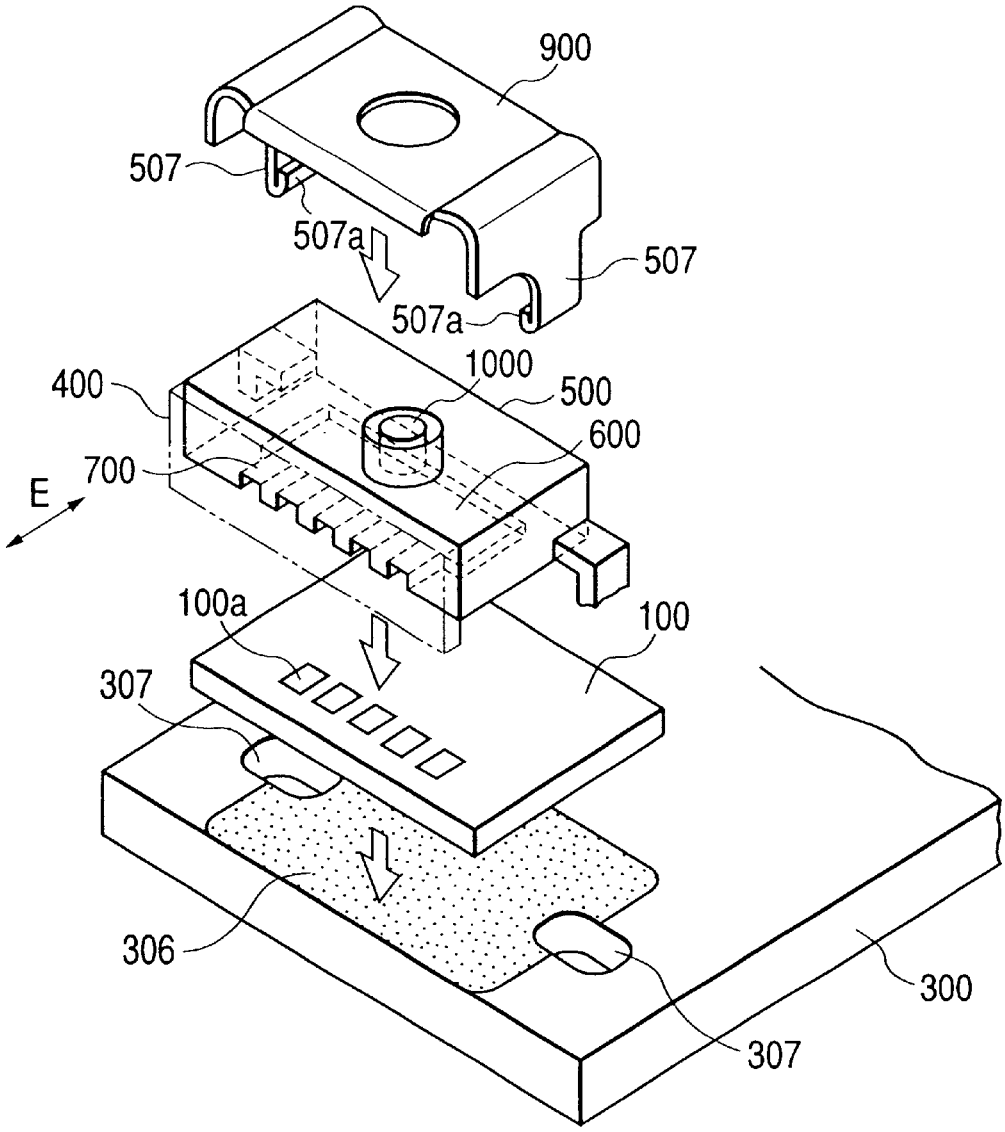
FIG. 1 is a view which schematically shows the conventional liquid jet recording head.
Figure 2:
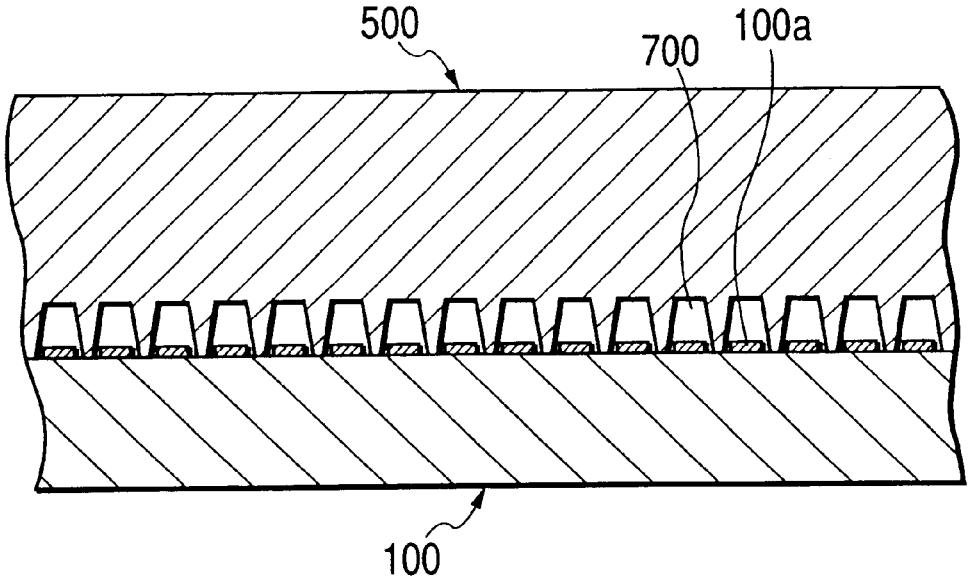
FIG. 2 is an enlarged cross-sectional view which shows the state of the ceiling plate and the heater board being bonded together for the conventional liquid jet recording head represented in FIG. 1.

Also, since the orifice plate 6 is arranged for the front end face 1*b* of the heater board 1 like an apron, the heater board 1 and the ceiling plate 5 are positioned in the direction (indicated by an arrow in FIG. 2) parallel to the ink discharge direction by allowing the front end face 1*b* of the heater board 1 to abut upon the back face 6*b* of the orifice plate 6.

In this manner, each of the nozzles 7 is separated from each other completely by compressing the heater board 1 and the ceiling plate 5 by means of the pressure spring 10. However, since the compression of the pressure spring 10 does not act sufficiently upon the boundary faces of the orifice plate 6 and the front end face 1*b* of the heater board 1, the close contactness becomes insufficient there.

Then, if any location is present where the contact is not close enough, ink leakage may take place in it to make it impossible for the liquid jet recording head to execute its function.

Therefore, in order to prevent the ink leakage from the location where the contact is not good enough, silicone or some other sealant is injected over the entire bonded interface between the heater board 1 and the ceiling plate 5 to fill it in the gaps. More specifically, these are the gap between the back face 6*b* of the orifice plate 6 and the front end face 1*b* of the heater board 1; the gap between the back face 6*b* of the orifice plate 6 and the front end face 3*b* of the base plate 3; and the bonded portions between the ceiling plate 5, the heater board 1, and base plate 3. The sealing of each of these gaps and bonded portions is made by the sealant which is allowed to flow within each specific region by means of the capillary force generated between the sealant and each of the gaps between the respective members, while the configuration of each member is devised or the viscosity of the sealant is controlled so as not to allow the sealant to flow out from such specific region, respectively.

However, the gap between the back face 6*b* of the orifice plate 6 and the front end face 1*b* of the heater board 1 is extremely minute, which is the most difficult portion for the sealant to be injected. It is, therefore, necessary to visually confirm whether or not the sealant is filled in the desired range in this particular portion. If the orifice plate 6 is transparent, the filling condition of the sealant can be ascertained from the front end of the orifice plate 6. For that matter, it is preferable to make the orifice plate 6 transparent.

Now, in conjunction with FIG. 5 to FIG. 7, the structure of the ceiling plate 5 will be described.

In FIG. 5 to FIG. 7, the ceiling plate 5 comprises a first substrate 21 formed with the orifice plate 6 and the nozzles 7, and a second substrate 22 formed with the ink chamber 8, the ink supply port 9, the receptacle 5*a,* and the outer circumference of the ceiling plate 5. The first substrate 21 and the second substrate 22 are conjugately molded by the bicolor molding.

The first substrate 21 comprises the thinner thickness portion of the orifice plate 6 and the fine portions of the nozzles 7, which is the portions of the ceiling plate 5 that require the highest precision of the molding, and which is formed by polysulfone, polyether sulfone, or some other material suitable for precise molding with excellent flowability. Also, the material should present the conditions needed for the molding of the orifice plate 6, such as transparency and superior laser processabilty, among some others.

The first substrate 21 is molded in a thinly elongated configuration having a uniform thickness, hence making it possible to contemplate the enhancement of the molding precision, because the inner stress is smaller at the time of molding shrinkage, and the residual stress is smaller at the time of being removed from the mold.

Moreover, since the first substrate 21 is molded separately from the ink liquid chamber 8 and the ink supply port 9, no welds are created on the nozzle forming portion. As a result, it becomes possible to avoid the defective transfer of the weld portions, which has presented the problem encountered in forming such a highly densified ceiling plate having the nozzles arrangement of 1,200 dpi. Also, as shown in FIG. 6, the flatness of the lower face 7*a* of the nozzles is more enhanced than the ceiling plate 5 which is molded by means of the monochromatic molding. As a result, the inner distortion becomes smaller when the lower face 7*a* of the nozzles is in contact with the heater board 1 under pressure, thus improving the ink discharge performance of the ceiling plate 5.

In this way, the ceiling plate 5 is divided into the first substrate 21 and the second substrate 22. Then, the structure is arranged so that these substrates are bonded by means of the bicolor molding. This becomes a very effective means for enhancing the forming precision of the ceiling plate 5. Then, even when these substrates are molded by exactly the same material, each of them is molded in high precision if divisionally molded by the application of the polychromic molding method. The molding precision of the ceiling plate 5 is then enhanced significantly. Further, since both of them are bonded at the time of molding, there is no need for assembling, welding, or any other bonding steps. Thus, the productivity also becomes excellent.

Also, the second substrate 22 is provided with the ink liquid chamber 8 and the ink supply port 9 which may cause the molding welds, but unlike the first substrate 21, the transferability precision is not required for the molding of this substrate. Also, the outer circumference of the second substrate 22 carries the housing function for the ceiling plate 5. Then, the mechanical properties of this portion exert a greater influence on the performance of the ceiling plate as a whole. For these two reasons, therefore, it should be good enough if only more attention is given to the physical properties of the second substrate 22 in selecting the molding material for it.

Now, if the second substrate 22 is molded by the resin which is filled with fillers, the elastic modulus of the second substrate 22 and the circumference of the nozzles 7 becomes greater, along which the robustness of the ceiling plate 5 is enhanced as a whole. Also, on the other hand, the flatness of the lower face 7*a* of the nozzles of the first substrate 21 is improved. As a result, by the combination of the enhanced molding precision of the first substrate 21 and the improved robustness of the second substrate 22, it becomes possible to make the inner distortion smaller in the ceiling plate 5 when the ceiling plate 5 and the heater board 1 are closely in contact.

Also, if the metallic mold is produced for the second substrate 22, it is unnecessary to prepare the expensive mold dowels, and then, the filler which should be filled in the material of the second substrate 22 can be selected from among many filler materials. Then, it becomes possible to control the elastic modulus by the selection of the material for the second substrate 22 so that the optimum robustness of the ceiling plate may be obtainable. Further, if the second substrate 22 is molded by means of the metal injection using magnesium alloy or alloy material, it is made possible to obtain the robustness of the ceiling plate 5 more than usually obtainable by means of the resin molding.

Also, as described earlier, there is naturally a limit of the material adoptable for use of the nozzles 7 for reasons related to molding, sealing, laser processing, and the like. Consequently, there is a limit in lowering the linear expansion coefficient of the first substrate 21. Now, therefore, if the second substrate 22 is molded with the material that may withstand the linear expansion well, it becomes possible to complement the weakness of the first substrate 21 against the thermal expansion structurally by the provision of the second substrate 22 as in the case of the enhanced robustness as described earlier.

In order to reduce the linear expansion coefficient of polymeric material, it is most effective to adopt a method so that such material may be filled with fillers. As described in the preceding paragraph, however, if the bonding strength becomes greater between the first substrate 21 and the second substrate 22, the effect of the second substrate 22 is made smaller in complementing the thermal expansion of the first substrate 21.

Also, when the fillers are filled in the molding resin used for the second substrate 22 to make the linear expansion coefficient of the second substrate 22 smaller, the bond performance becomes important between the base resin of the second substrate 22 and the resin used for the first substrate 21. Here, it is preferable to select the material having good compatibility between the base resin of the second substrate 22 and the first substrate 21 in bonding them. For example, if the first substrate 21 is formed by polysulfone, the base resin of the second substrate 22 is also formed by polysulfone, while the polysulfone being filled with the carbon filler, the glass filler, or the like. In this way, the base resin used for both of them is the same, and the boundary surface bonding is performed in a better condition when the bicolor molding is executed. As a result, it becomes possible to improve the thermal expansion aspect of the second substrate 22 and the first substrate 21 significantly.

In addition, if the second substrate 22 is molded with the resin which is filled with fillers, there is an effect to enhance the molding precision of the second substrate 22 itself. In other words, when the fillers are filled, the mold shrinkage of the resin per se is relaxed by the presence of fillers. Naturally, therefore, the molding precision of the second substrate 22 is improved, and then, with the improved molding precision of the first substrate 21 and the second substrate 22, the molding precision of the ceiling plate 5 is automatically improved, because it is formed by bonding these two substrates.

Also, it is preferable to mold the first substrate 21 by the injection from the secondary side when the bicolor molding is performed. As described earlier, for the molding of the first substrate 21, there is a need for the provision of the expensive mold dowels for the nozzle transfer. Then, when the mold dowels for the nozzle transfer should be set at the core portion, it is necessary to arrange them in two locations. On the cavity side, however, it should be good enough to arrange the dowel only at one location. Therefore, if the mold is structured so that the nozzles 7 of the first substrate 21 can be formed by transfer on the cavity side, the structure of the metal mold should become simpler, leading to the lower manufacturing costs of the metallic mold.

Further, if the first substrate 21 is injected on the primary side, it is affected by the following continuous injection to damage the minute portions of the nozzles in some cases. Therefore, it is preferable to mold the first substrate 21 by the injection on the secondary side to form the minute portions exactly so as to avoid any possibility that the secondary damage takes place at the time of following continuous injection.

So far, the description has been made of one example of the ceiling plate 5 applicable to the structure of the first embodiment in accordance with the present invention. For the structure described above, the ink liquid chamber and ink supply port are formed in only one location, and the kind of ink that the ceiling plate 5 thus structured can use is only one. For the ceiling plate which is arranged to deal with plural kinds of ink with one ceiling plate, the same type of molding is possible. The present invention is applicable to the molding of all types of the ceiling plate irrespective of the mode and configuration thereof, and it is possible to anticipate the same effect as described above.

However, for the ceiling plate 5 that can supply plural kinds of ink, the partition walls (the so-called color separation walls) are arranged to partition each of the ink chambers. The color separation walls may be molded integrally either with the first substrate 21 or with the second substrate 22.

Also, the ceiling plate 5 of the present embodiment is structured so that the orifice plate 6 may be formed integrally with the ceiling plate 5 after its molding. Naturally, however, it is possible to execute the bicolor molding and obtain the same effect even if the orifice plate 6 is completely separated from the ceiling plate 5, and the structure of the liquid jet recording head is arranged so that after the molding of the ceiling plate, the orifice plate 6 is bonded to the ceiling plate 5 by means of bonding, connecting means, or the like.

Furthermore, the surface layer of the orifice plate 6 is separated from the main body of the orifice plate. Then, the surface layer of the orifice plate is formed by use of the material having good water repellency, and at the same time, the structure is arranged so that the ceiling plate is completed by bonding the first substrate, the second substrate, and the surface layer of the orifice plate by three color molding. In this way, it becomes possible to simplify the manufacturing steps of the ceiling plate, because the water repellency treatment given to the surface of the orifice plate, which has conventionally been made in the secondary process, is now made executable at the time of molding.

Also, the present invention is not necessarily limited to the ceiling structure where nozzles 7 are produced by molding. The invention is applicable to the ceiling plate structure where the nozzles 7 are formed by the laser processing or the like.

Also, as means for enhancing the robustness of the ceiling plate 5, the method is not necessarily limited to the use of the material having larger elastic modulus. There is a method for enhancing the robustness thereof structurally by devising the ceiling plate configuration. Then, it may be possible to enhance the robustness of the ceiling plate 5 by developing both the materials and structures.

Also, since the first substrate 21 is configured so as not to allow the molding weld to be formed, it becomes possible to mold this substrate with the LCP resin or the like which is a pure resin without any fillers filled in it, having lower thermal expansion property with a good molding flowability.

(Second Embodiment)

Figure 8:
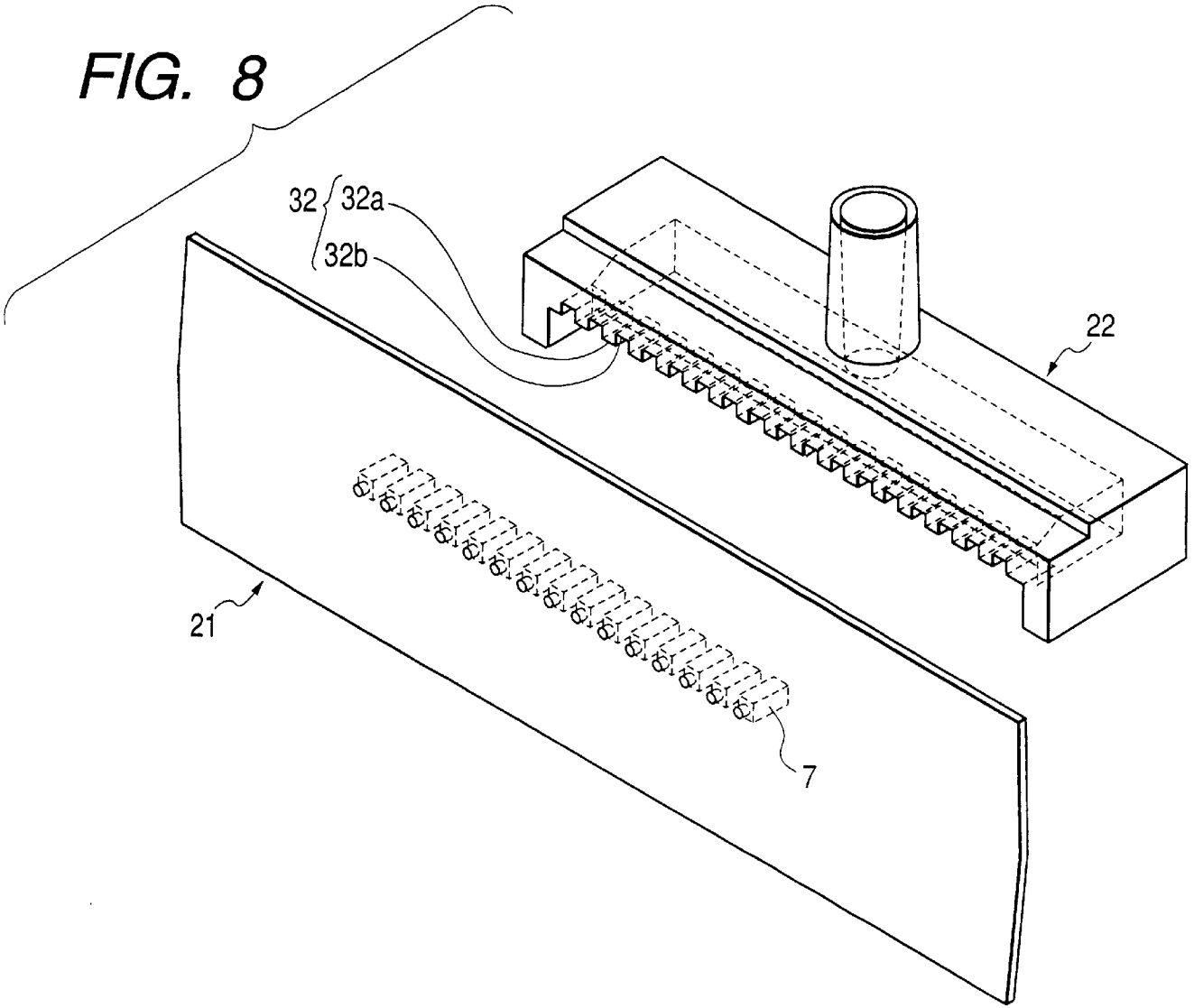
FIG. 8 is a perspective view which shows the orifice plate, observed from the front face side, after having disassembled the ceiling plate of the liquid jet recording head into a first substrate and a second substrate in accordance with a second embodiment of the present invention.
Figure 9:
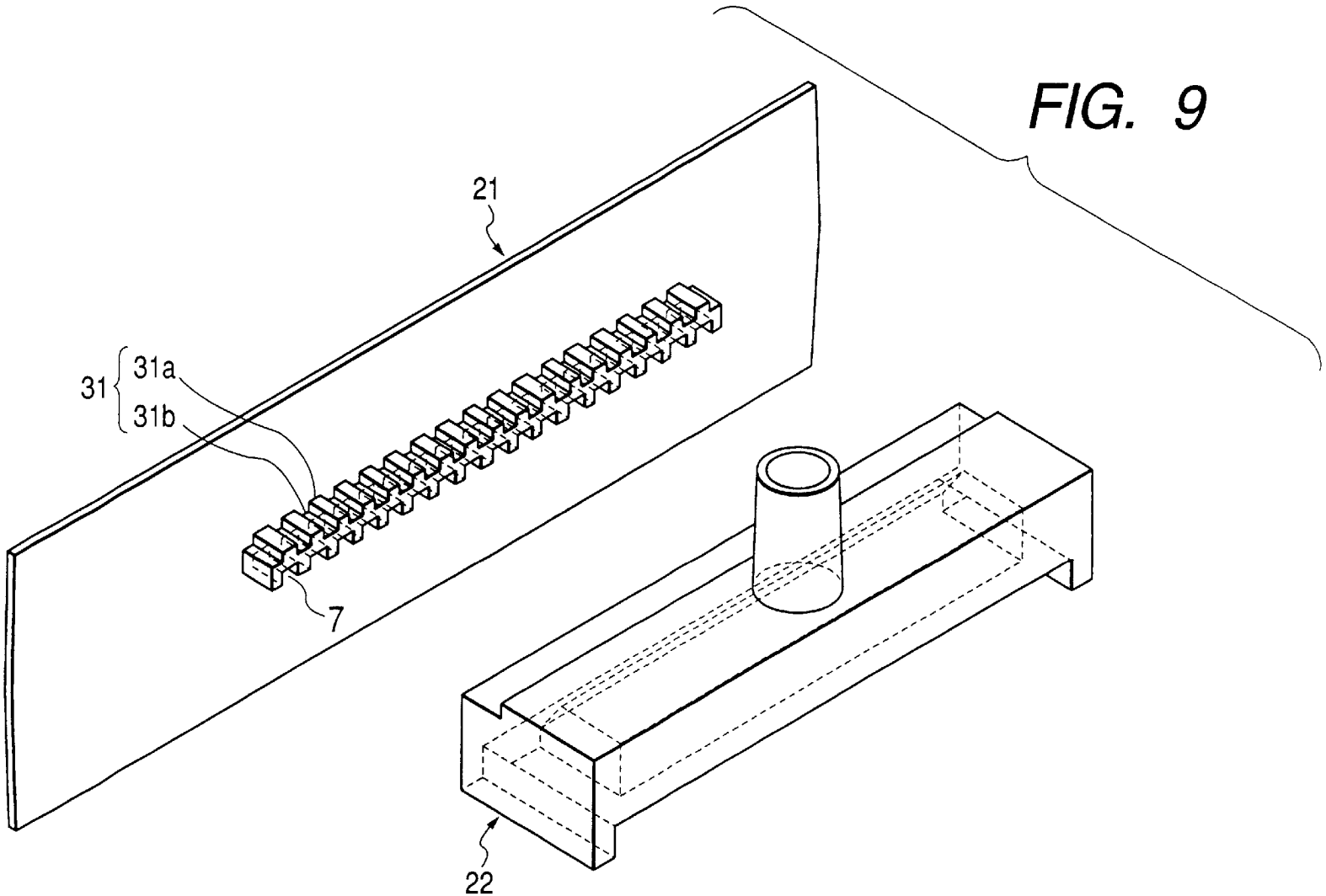
FIG. 9 is a perspective view which shows the ceiling plate represented in FIG. 8, observed from the back face side of the orifice plate.

FIG. 8 is a perspective view which shows the orifice plate, observed from the front face side, after having disassembled the ceiling plate of the liquid jet recording head into a first substrate and a second substrate in accordance with a second embodiment of the present invention. FIG. 9 is a perspective view which shows the ceiling plate represented in FIG. 8, observed from the back face side of the orifice plate.

In accordance with the first embodiment, the structure is arranged so that the second substrate 22 is molded by the material having the smaller linear expansion coefficient to compensate for the thermal expansion weakness of the nozzles 7 in the arrangement direction thereof. With this structure, however, the constraint force of the second substrate 22 becomes smaller when the nozzles 7 are caused to be expanded or contracted in the arrangement direction thereof if the bonding force is smaller between the first substrate 21 and the second substrate 22. In accordance with the present embodiment, therefore, it is devised to overcome the weakness of the nozzles 7 even in the case where the molding resin of the first substrate 21 and that of the second substrate 22 are not easily fused together in the performance of the bicolor molding.

Now, hereunder, with reference to FIG. 8 and FIG. 9, the description will be made of the second embodiment in accordance with the present invention. Here, the same parts as those of the above embodiment are referenced by the same reference marks, and the description thereof will be omitted.

In FIG. 8 and FIG. 9, an irregular line 31 is arranged for the first substrate 21 in the form of ribs, and the irregular line 32 also in the form of ribs is arranged for the second substrate 22 corresponding to the irregular line 31 arranged for the first substrate 21. These irregular lines 31 and 32 are arranged in the same direction as the arrangement direction of the nozzles 7. The extrusions 31*a* on the first substrate 21 advance into the recesses 32*b* on the second substrate 22. The irregular lines 31 and 32 are arranged to face each other alternately so that the extrusions 31*a* on the first substrate 21 advance into the recesses 32*b* on the substrate 22, and the extrusions 32*a* on the second substrate 22 advance into the recesses 31*b* on the first substrate 21. In this way, these lines are bonded by means of the bicolor bonding.

In this manner, the extrusions 31*a* and 32*a* on both lines advance into the facing recesses 31*b* and 32*b* alternately to make the bonding area of the interface area between them becomes greater to increase the constraint force to be exerted on the expansion and contraction of the nozzles 7 in the arrangement direction thereof, provided that the thermal expansion property of the second substrate 22 is favorable.

Further, it may be possible to arrange the irregular lines 31 and 32 either at equal intervals or at irregular intervals. However, if the lines are arranged at the equal intervals, the molding resin is stabilized and allowed to flow regularly to be filled with a good efficiency, hence producing an effect to suppress the warping of the molded product, which contributes to enhancing the molding precision.

In accordance with the present embodiment, the irregular lines 31 and 32 are arranged in the form of ribs as constraint means for nozzles 7 on the boundary between the first substrate 21 and the second substrate 22. However, the constraint means for nozzles 7 is not necessarily limited to the arrangement of the irregular lines 31 and 32 in the form of ribs. The same effect may be demonstrated by the irregular lines in the form of bellows, bosses, seats, rectangles, or the like.

Also, the bonding force between the substrates may be enhanced still more if the irregular lines are formed so that both of them are undercut in the releasing direction.

Also, the irregular lines 31 and 32 are not necessarily limited to the arrangement direction of the nozzles 7. It may be possible to arrange them in the ink discharge direction.

Also, nozzle constraint means is not necessarily limited to the irregular lines 31 and 32. It may be possible to arrange the structure so that the second substrate 22 holds side faces of both ends of the nozzles 7. Also, if the arrangement of the irregular lines 31 and 32 and the holding of side faces of both ends are adopted in combination, it becomes possible to anticipate more effect in a better condition.

Here, in accordance with the present embodiment, the description has been referred to the weakness that may be brought about by the thermal expansion of the nozzles 7. The structure formed in accordance with the second embodiment also presents itself as an effective method to enable the second substrate 22 to enhance the robustness of the ceiling plate as a whole.

(Third Embodiment)

Figure 10:
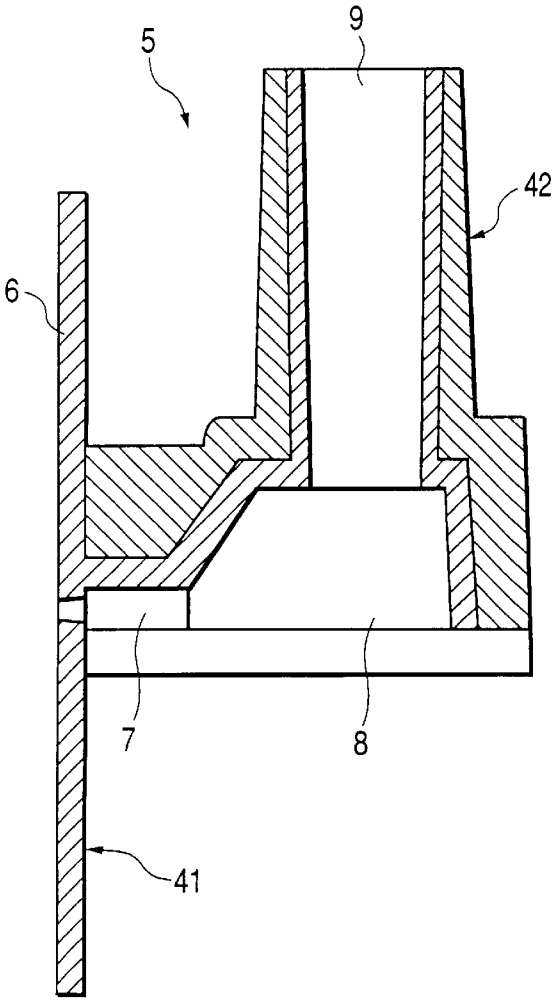
FIG. 10 is a schematically cross-sectional view which shows the ceiling plate of the liquid jet recording head in accordance with a third embodiment of the present invention.

FIG. 10 is a schematically cross-sectional view which shows the ceiling plate of the liquid jet recording head in accordance with a third embodiment of the present invention.

In accordance with the embodiment described above, the bonding material of the second substrate should present its excellent property of ink resistance. As a result, it is impossible to select the material having fillers filled in the inexpensive base resin which has the versatility although inferior in the ink resistive performance. The volume of the second substrate is larger than that of the first substrate, and requires more material accordingly. Therefore, if the base resin used for the molding material of the second substrate is inexpensive, the ceiling plate can be finished as a molded product at lower costs.

Now, in accordance with the present embodiment, it is arranged so that the ceiling plate is divided into the ink-contacted substrate which should be in contact with ink, and the non-ink contact substrate which is not in contact with ink, and that these substrates are bonded by means of the bicolor molding.

With reference to FIG. 10, the third embodiment will be described in accordance with the present invention. Here, the same reference marks are applied to the same parts as those appearing in the embodiment described above.

In FIG. 10, the ceiling plate 5 comprises an orifice plate 6, nozzles 7, an ink chamber 8, and an ink supply port 9, which is formed by the ink-contact unit substrate 41 to be in contact with ink at all times; the outer circumference of the ceiling plate 5; and the non-ink contact unit substrate 42. The ink-contact unit substrate 41 and the non-ink contact unit substrate 42 are bonded together by means of the bicolor molding.

In accordance with the present embodiment, the non-ink contact unit 42, that is, the outer circumference of the ceiling plate 5, is not needed to present the ink resistive characteristics. Therefore, for this portion, an inexpensive material can be adopted as its base resin to make it possible to manufacture the bicolor molded ceiling plate at lower costs.

Further, with the fillers filled in the material of the non-ink contact unit 42, the bond shrinkage per se of such material is relaxed by the presence of the fillers as described in the first embodiment. As a result, the bonding precision of the non-ink contact unit 42 is enhanced. Also, with the fillers thus filled, the linear expansion coefficient of the non-ink contact unit 42 becomes smaller so as to block the deformation of the ink flow paths that may be brought about by the environmental changes. At the same time, its elastic modulus is made higher to enhance the robustness of the ceiling plate 5 as a whole. In order to enhance the robustness further still, it may be possible to mold the non-ink contact unit 42 by means of the metal injection molding with magnesium alloy or some other alloy material.

Also, since the thickness of the inner wall of the ink liquid chamber 8 and the thickness of the inner wall of the ink supply port 9 can be set arbitrarily, the thickness of the ink-contact unit substrate 41 becomes uniform as a whole if the arrangement is made so that the thickness of these walls are in agreement with those of the orifice plate 6 and nozzles 7. Then, the molding material can flow efficiently to make it possible to finish the ceiling plate in higher molding precision.

(Fourth Embodiment)

Figure 11:
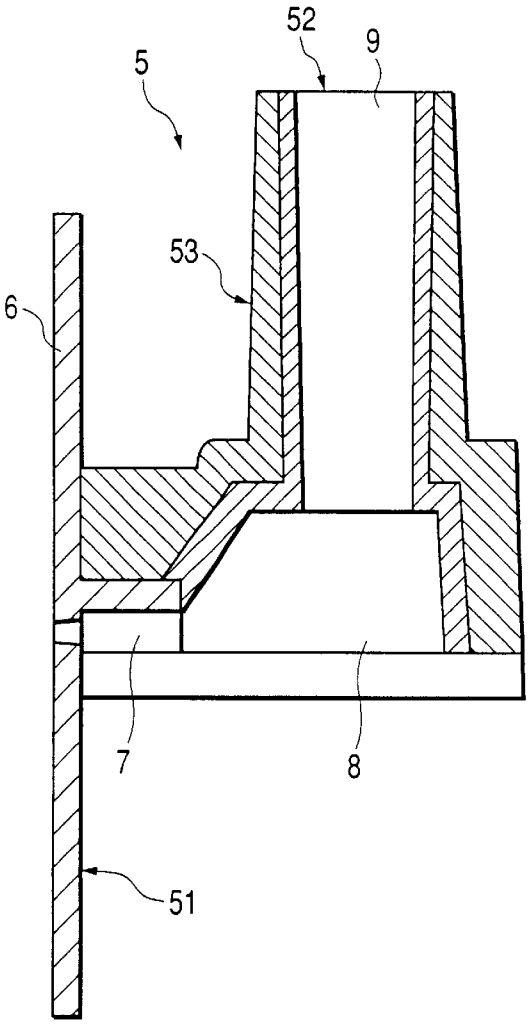
FIG. 11 is a schematically cross-sectional view which shows the ceiling plate of the liquid jet recording head in accordance with a fourth embodiment of the present invention.

FIG. 11 is a schematically cross-sectional view which shows the ceiling plate of the liquid jet recording head in accordance with a fourth embodiment of the present invention.

In accordance with the third embodiment, the ink contact unit substrate is provided with the ink liquid chamber 8 and the ink supply port 9. As a result, when this portion is molded, welds are formed on the finished product. For that matter, there is a fear that the welds affect the filling performance of the thinner thickness portion and minute portion of the ink-contact unit substrate when molding the ceiling plate 5 having nozzles in higher density.

Therefore, in accordance with the present embodiment, the structure is arranged to configure the thinner thickness portion of the orifice plate 6 and the minute portions of the nozzles 7 so that no welds are formed, thus attempting to mold an inexpensive ceiling plate, while making it possible to improve the molding precision.

Now, hereunder, with reference to FIG. 11, the fourth embodiment will be described in accordance with the present invention. In this respect, the same reference marks are applied to the same parts appearing in the embodiment described above.

In FIG. 11, the ceiling plate 5 comprises the ink discharge unit substrate 51 formed with an orifice plate 6 and nozzles 7; the ink supply unit substrate 52 formed with an ink chamber 8, and an ink supply port 9;and the outer circumference unit substrate 53 that forms the outer circumference of the ceiling plate 5. In other words, the ink-contact unit substrate 41 shown in FIG. 8 is further divided into the ink discharge unit substrate 51 and the ink supply unit substrate 52. Then, the ink discharge unit substrate 51, the ink supply unit substrate 52, and the outer circumference unit substrate 53 are bonded by means of the three color bonding.

With the ceiling plate 5 thus divided into three substrates, it becomes possible to configure the ink discharge unit substrate 51 in a simply uniform thickness. Also, it shows the configuration that blocks the creation of welds. As a result, molding is possible in high precision. On the other hand, since the outer circumference unit substrate 53 does not need any ink resistive characteristics, an inexpensive versatile material can be adopted for this substrate. For the outer circumference unit substrate 53, it is of course possible to use the same material as the one used for the non-ink contact unit substrate described in the third embodiment.

As described above, with the ink discharge unit substrate 51, the ink supply unit substrate 52, and the outer circumference unit substrate 53 integrally bonded and molded by means of the three color molding, it becomes possible to mold the ceiling plate 5 having nozzles in high density in high precision at lower costs.

Here, as in the first embodiment, it is preferable for the ink discharge unit substrate 51 to bond the nozzles 7 on the cavity side in order to make the manufacturing costs of the metallic mold lower. Also, in order to prevent the nozzles 7 from being influenced by the following continuous injection, the ink discharge unit substrate 51 should preferably be bonded by the third side injection which is the last injection step.

As described above, in accordance with the present invention, the ceiling plate member formed integrally with the orifice plate and others having grooves that correspond to the ink flow paths, and discharge ports together is integrally molded by means of the polychromic molding. Thus, it becomes possible to mold the ceiling plate member in combination of various resins, fillers, alloys, and the like to implement the molding of the multiply functional high-performance ceiling plate.

Particularly, the ceiling plate member is structured by the first substrate formed with the grooves and the orifice plate, and the second substrate formed with the ink liquid chamber and the ink supply port, which are bonded by means of the bicolor molding to mold them integrally. In this way, the thinner thickness portion of the orifice plate and nozzle portion that require the highest molding precision are separated from the other portions to be in a simple configuration. Thus, it is made possible to mold them in high precision. Further, since the ink liquid chamber and the ink supply port which cause the creation of welds are molded separately from the first substrate, the transferability of the minute parts is enhanced to make it easier to mold the ceiling plate member provided with nozzles in high density.

On the other hand, with the ceiling plate structured with the ink-contact unit substrate formed by the parts that contact ink, and the non-ink contact unit substrate formed by the parts that do no contact ink, it becomes possible to select various materials for use of the non-ink contact unit substrate without any particular consideration given to resistance to ink.

Further, by means of the bicolor molding or the polychromic molding, the material can be injected for molding the substrate portion where the grooves are arranged. In this way, the minute portion of the ink flow paths can be transferred assuredly without receiving any influence from the following continuous injection.

(Fifth Embodiment)

Figure 12:
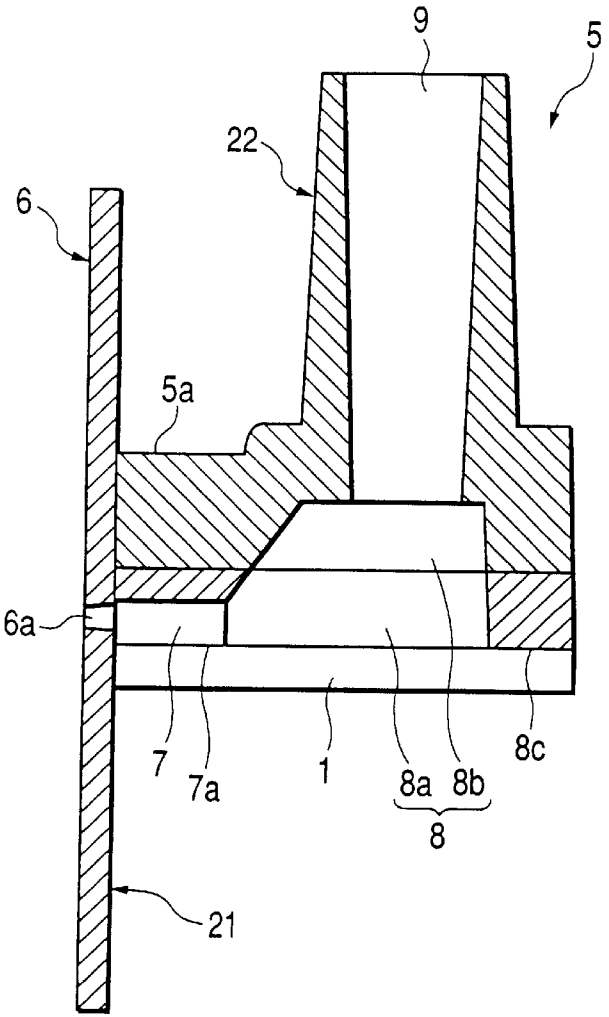
FIG. 12 is a schematically cross-sectional view which shows the ceiling plate of the liquid jet recording head in accordance with a fifth embodiment of the present invention.

With reference to FIG. 12, the description will be made of the structure of the ceiling plate 5 molded by means of another bicolor molding.

As shown in FIG. 12, the ceiling plate 5 comprises the first substrate 21 formed by the orifice plate 6, nozzles 7, and the lower part 8*a* of the ink liquid chamber 8, and the second substrate 22 formed with the upper part 8*b* of the ink liquid chamber 8, the ink supply port 9, the receptacle 5*a,* and the outer circumference of the ceiling plate 5. The first substrate 21 and the second substrate 22 are bonded by means of the bicolor bonding. In other words, the separately molded lower part 8*a* and upper part 8*b* of the ink liquid chamber 8 are molded together by means of the bicolor molding as the ceiling plate 5. This aspect is different from the first embodiment.

The first substrate 21 comprises the thinner thickness portion of the orifice plate 6 and the fine portions of the nozzles 7, which is the portions of the ceiling plate 5 that require the highest precision of the molding, and which is formed by polysulfone, polyether sulfone, or some other material suitable for precise molding with excellent flowability. Also, the material should present the conditions needed for the molding of the orifice plate 6, such as transparency and superior laser processabilty, among some others. Further, this material is the pure material that does not contain any fillers. Therefore, unlike the one that contains fillers, the worn out degree of the metallic mold is made smaller so as not to lower the durability of the expensive nozzle transfer mold dowels.

Also, in accordance with the present embodiment, the nozzles 7 and the lower part 8*a* of the ink liquid chamber 8 are molded on the same substrate. As a result, the mold dowel for molding the nozzles 7 and the mold dowel for molding the lower part 8*a* of the ink liquid chamber 8 are arranged inside the same cavity, hence making it possible to secure high precision for the step between the lower face 7*a* of the nozzles and the lower face 8*c* of the ink liquid chamber outer walls, and to seal the outer circumference of the ink liquid chamber 8 reliably.

Also, since the first substrate 21 is molded with pure and transparent material (polysulfone, polyether sulfone, or the like), it becomes easier to observe sealing condition in each of the sealed portions in the sealing step which follows the step where the ceiling plate 5 and the heater board 1 are closely in contact.

Particularly, the observation of the sealing condition between the lower face 8*c* of the ink liquid chamber and the heater board 1 should be made from the outer circumference of the ceiling plate 5. Therefore, unless the portion on the lower face 8*c* of the ink liquid chamber outer walls is transparent, it is difficult to visually observe the sealing condition between them. In accordance with the present embodiment, the lower face portion of the ink liquid chamber is molded with the transparent material, it is easier to observe the sealing condition of the lower face 8*c* of the ink liquid chamber walls.

In this manner, the first substrate 21 comprises the orifice plate 6, the nozzles 7, and the lower part 8*a* of the ink liquid chamber 8, and its configuration is simple, thus making it possible to implement the enhancement of the molding precision.

Also, the surface precision of the lower face 7*a* of the nozzles is made higher than that of the ceiling plate 5 which is molded by means of the monochromatic molding. The inner distortion becomes smaller when the nozzle lower face 7*a* is pressed to the heater board 1 to contact them, hence enhancing the ink discharge performance of the ceiling plate 5.

Therefore, it is an extremely effective means for enhancing the molding precision for the ceiling plate 5 to arrange the structure to divide the ceiling plate 5 into the first substrate 21 and the second substrate 22, and then, to bond them together by means of the bicolor molding. Thus, even if the same material is used for both of them, each substrate is molded in high precision separately by means of the polychromatic molding to make it possible to enhance the molding precision of the completed ceiling plate 5 significantly. Further, both of them are bonded at the time of being molded, and there is no need for the connecting process, such as assembling, adhesive bonding, which leads to the excellent productivity.

On the other hand, it is not required for the second substrate 22 to acquire such transfer precision and dimensional precision as needed for the first substrate 21. Also, since the outer circumferential portion of the second substrate 22 carries the housing function, the mechanical property of this portion exerts a great influence on the performance of the ceiling plate 5 as a whole. With these aspects in view, it should be good enough if only the molding material is selected for the second substrate giving more attention to its physical properties. The second substrate 22 is the same as described in conjunction with the first embodiment. However, if the second substrate 22 is molded by means of the metal injection using magnesium alloy, SUS, iron, steel, or some other, the ceramics injection using ceramics, or the like, it becomes possible to obtain even the robustness which is not obtainable usually for the ceiling plate 5 by means of the resin molding.

Figure 13:
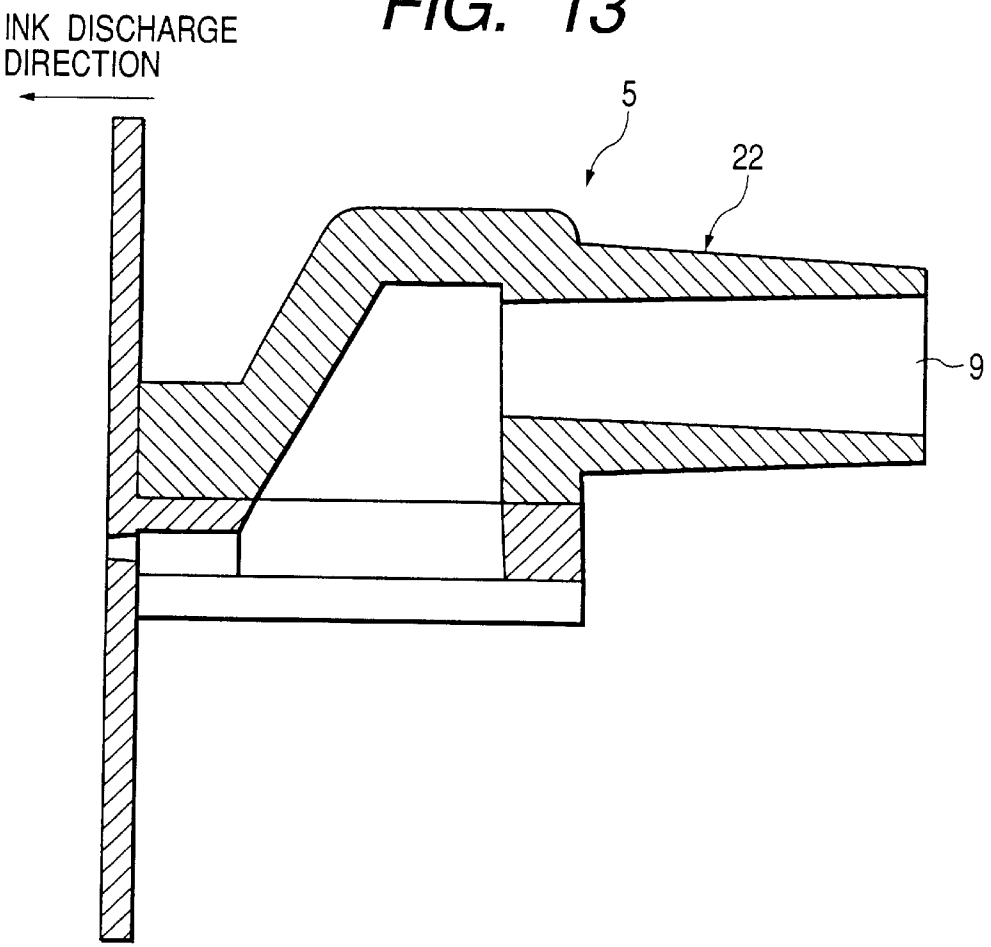
FIG. 13 is a cross-sectional view which shows one variational example of the ceiling plate of the liquid jet recording head in accordance with the fifth embodiment of the present invention.

Here, in accordance with the present embodiment, the ink supply port 9 is arranged in the direction orthogonal to the ink discharge direction. However, as shown in FIG. 13, the same effect is obtainable as described above for the ceiling plate 5 having the second substrate 22 provided with the ink supply port 9 arranged in the same direction as the ink discharge direction.

(Sixth Embodiment)

Figure 14:
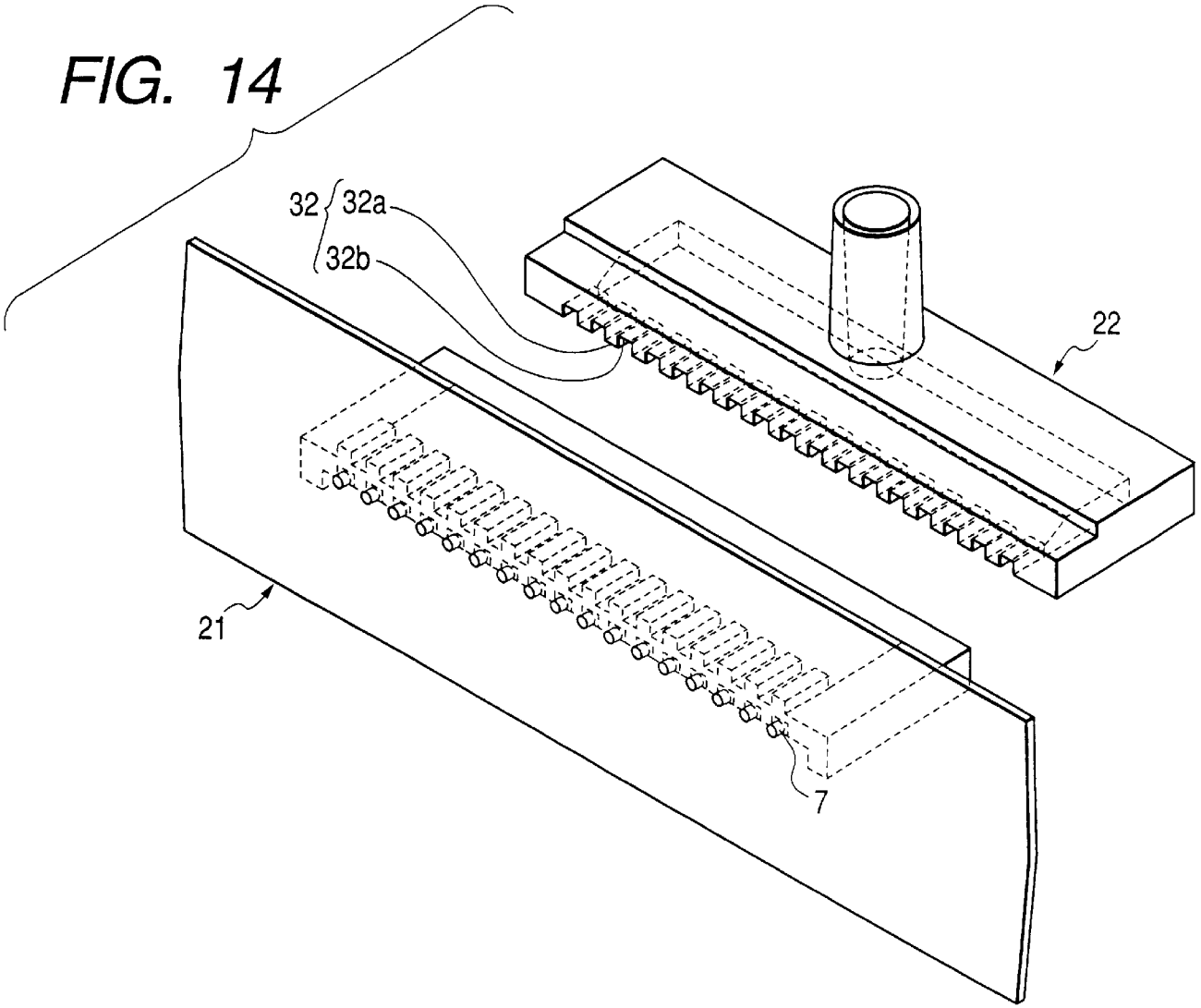
FIG. 14 is a perspective view which shows the orifice plate, observed from the front face side, after having disassembled the ceiling plate of the liquid jet recording head into a first substrate and a second substrate in accordance with a sixth embodiment of the present invention.
Figure 15:
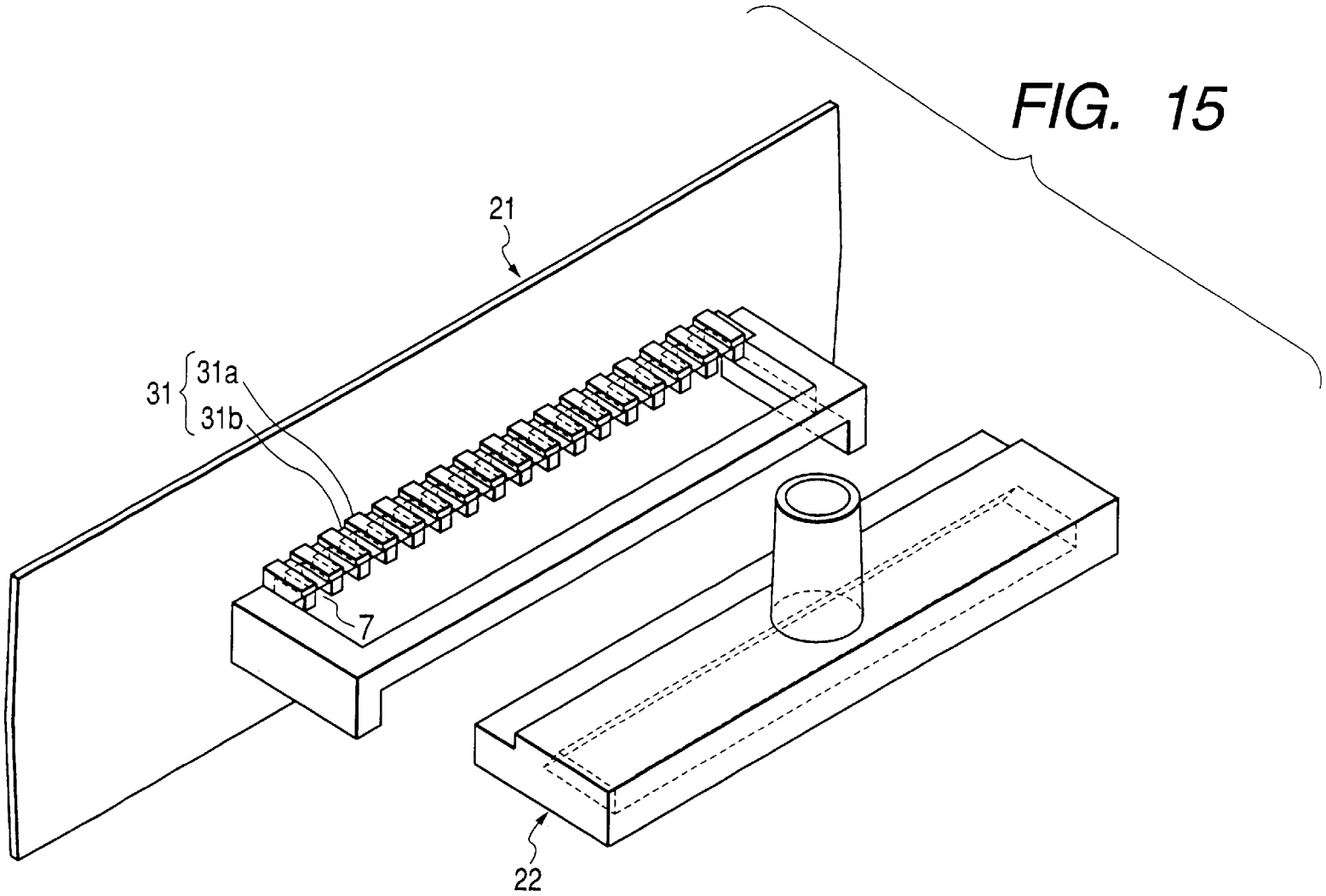
FIG. 15 is a perspective view which shows the ceiling plate represented in FIG. 14, observed from the back face side of the orifice plate.

FIG. 14 is a perspective view which shows the orifice plate, observed from the front face side, after having disassembled the ceiling plate of the liquid jet recording head into a first substrate and a second substrate in accordance with a sixth embodiment of the present invention. FIG. 15 is a perspective view which shows the ceiling plate represented in FIG. 14, observed from the back face side of the orifice plate.

In accordance with the fifth embodiment, the second substrate 22 is molded with the material having a smaller linear expansion coefficient, and the structure is arranged to compensate for the thermal expansion weakness of the nozzles 7 in the arrangement direction. However, with the structure thus arranged, if the bonding force between the first substrate 21 and the second substrate 22 is smaller, the restraint force of the second substrate 22 becomes weaker, which should be exerted when the nozzles 7 are expanded or contracted in the arrangement direction thereof. Hence, it becomes difficult for the second substrate 22 to compensate for the thermal expansion weakness of the nozzles 7. In accordance with the present embodiment, therefore, it is devised so as to overcome such weakness of the nozzles 7 even when the molding resin used for the first substrate 21 and the second substrate 22 are not easily fused together in the execution of the bicolor molding.

Now, hereunder, with reference to FIG. 14 and FIG. 15, the sixth embodiment will be described in accordance with the present invention. Here, the description will be made by applying the same reference marks to the same parts as those appearing in the embodiment described above.

As shown in FIG. 14 and FIG. 15, the first substrate 21 is provided with the irregular line 31 in the form of ribs, and the second substrate 22 is provided with the irregular line 32 in the form of ribs that correspond to the irregular line 31 provided for the first substrate 21. The irregular lines 31 and 32 are arranged in the same direction as the arrangement direction of the nozzles 7 of the first substrate 21. The irregular lines 31 and 32 are arranged alternately so that the extrusions 31*a* of the first substrate 21 advance into the recesses 32*b* of the second substrate 22, and the extrusions 32*a* of the second substrate 22 advance into the recesses 31*b* of the first substrate 21, thus bonding them by means of the bicolor molding.

For the present embodiment, the same effect as the second embodiment can be anticipated. Also, it may be possible to carry out the same modifications as those of the second embodiment.

(Seventh Embodiment)

Figure 16:
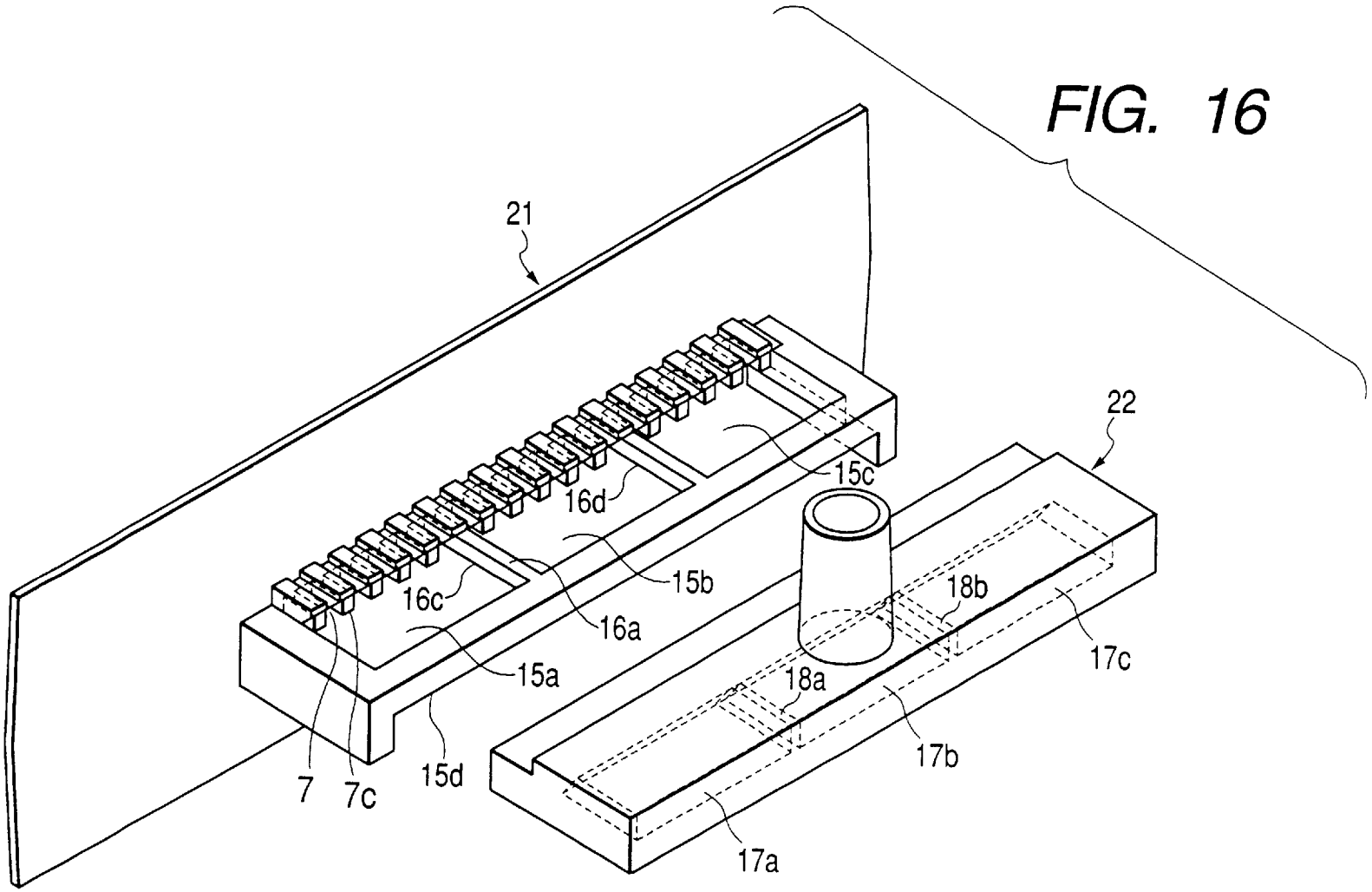
FIG. 16 is a perspective view which shows the orifice plate, observed from the front face side, after having disassembled the ceiling plate of the liquid jet recording head into a first substrate and a second substrate in accordance with a seventh embodiment of the present invention.

FIG. 16 is a perspective view which shows the orifice plate, observed from the front face side, after having disassembled the ceiling plate of the liquid jet recording head into a first substrate and a second substrate in accordance with a seventh embodiment of the present invention.

For the present embodiment, one example is shown for the embodiments of the liquid jet recording head which is provided with a plurality of ink liquid chambers to supply plural kinds of ink.

Now, hereunder, with reference to FIG. 16, the description will be made of a seventh embodiment of the present invention. The same parts as those of the embodiment described above are referenced by the same reference marks for description.

In FIG. 16, the first substrate 21 is provided with three lower part 15*a,* 15*b,* and 15*c* of the ink liquid chambers, which are separated by two lower parts 16*a* and 16*b* of the separation walls. Then, the second substrate 22 is provided with three upper parts 17*a,* 17*b,* and 17*c* of the ink liquid chambers, which are separated by two upper parts 18*a* and 18*b* of the separation walls correspondingly.

Since the first substrate 21 and the second substrate 22 are bonded by means of the bicolor molding, each of the ink liquid chamber lower parts 15*a,* 15*b,* and 15*c,* and each of the ink liquid chamber upper parts 17*a,* 17*b,* and 17*c* are integrated to form the three ink liquid chambers. In other words, the separation wall.,lower part 16*a* and the separation wall upper part 18*a;* the separation wall lower part 16*b* and the separation wall upper part 18*b;* and the ink liquid chamber lower part 15*a* and the ink liquid chamber upper part 17*a;* the ink liquid chamber lower part 15*b* and the ink liquid chamber upper part 17*b;* and the ink liquid chamber lower part 15*c* and the ink liquid chamber upper part 17*c* are integrally molded together, respectively.

In this manner, the nozzles 7, the ink liquid chamber lower parts 15*a,* 15*b,* and 15*c,* and the separation wall lower part 16*a* and 16*b* are molded together as the first substrate 21. Therefore, the steps between the nozzle lower face 7*a,* the outer wall lower face 15*d* of the ink liquid chamber lower parts 15*a,* 15*b,* and 15*c,* and the lower faces 16*c* and 16*d* of the separation wall lower parts 16*a* and 16*b* are molded in high precision.

Therefore, the steps between the outer wall lower face 15*d* of the ink liquid chamber lower parts 15*a,* 15*b,* and 15*c,* the lower faces 16*c* and 16*d* of the separation wall lower parts 16*a* and 16*b,* and the heater board (not shown) are secured within a desired dimension (several μm to several tens of μm) to make it possible to seal the outer circumference of the ink liquid chambers reliably.

For the present embodiment, the ceiling plate is structured with three ink liquid chambers, but the numbers of the ink liquid chambers and the kinds of ink that can be handled are not necessarily limited. There is no problem even if the structure is arranged so that the ink liquid chambers are divided into any numbers, and that the kinds of ink that should be handled are many.

As described above, in accordance with the present invention, the ceiling member is structured by the first substrate comprising the grooves corresponding to the ink flow paths; the orifice plate; and a part of the outer walls of ink liquid chambers which are close in contact with the substrate member, and by the second substrate which is formed with all the other portions. Then, both substrates are bonded to be integrally molded by means of the bicolor molding. Therefore, the ceiling plate member can be molded by the combination of various resins, metals, ceramics, fillers, and the like. As a result, it becomes possible to mold the multiply functional ceiling plate member in high precision that cannot be implemented by means of the monochromatic molding.

Also, for the ceiling plate, the grooves and the orifice plate for which the highest molding precision is required are separated from the other portions to mold the first substrate in a simple configuration, hence making it possible to perform molding in high precision. Further, the portions of the ceiling plate, which are in close contact with the substrate members, become one and the same substrate, and then, the dowels of the metallic mold are arranged in one and the same metallic mold in order to transfer the lower face of the ink liquid chambers and the lower face of the ink flow paths. Therefore, although the ceiling plate member is molded by means of the bicolor molding, the step between the ink liquid chamber lower face and the ink flow path lower face can be molded in high precision.

The above mentioned effects are equally anticipated even if the ink liquid chamber is separated into plural ones by use of the separation walls, and then, a part of each separation wall, which is in close contact with the substrate member, is included in the first substrate.

Furthermore, as described in conjunction with the first to fourth embodiments, the freedom of the divisional structure of the ceiling plate can be enhanced by integrally molding the ceiling member by means of the polychromic molding. With the polychromic molding, the molding material of the substrate member having grooves thereon is injected in the last to make it possible to transfer the minute portions of the ink flow paths exactly without being influenced by the following continuous injection.

(Eighth Embodiment)

Figure 17:
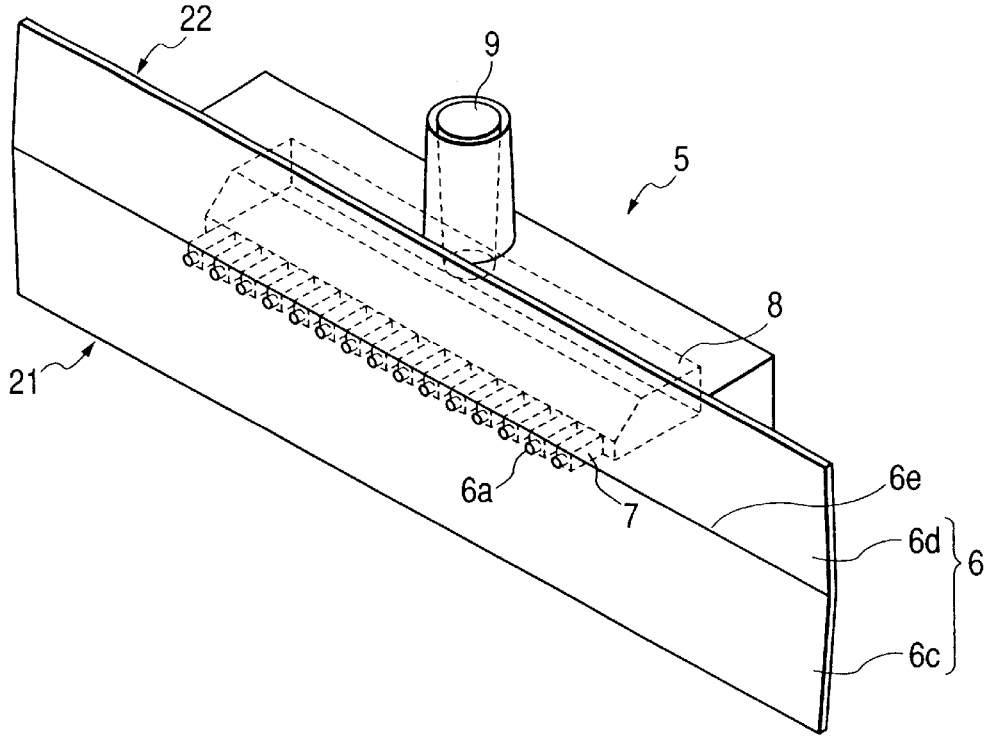
FIG. 17 is a perspective view which shows the ceiling plate of the liquid jet recording head in accordance with an eighth embodiment of the present invention, observed from the front face side of the ceiling plate.
Figure 18:
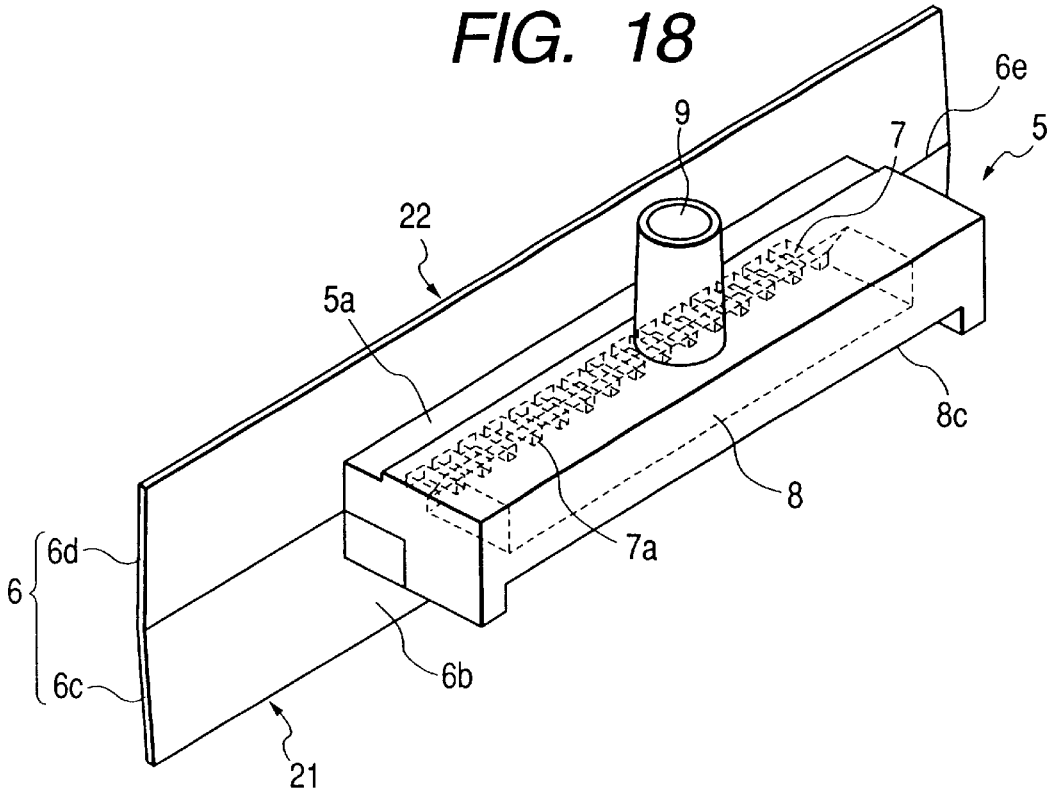
FIG. 18 is a perspective view which shows the ceiling plate represented in FIG. 17, observed from the back face side thereof.
Figure 19:
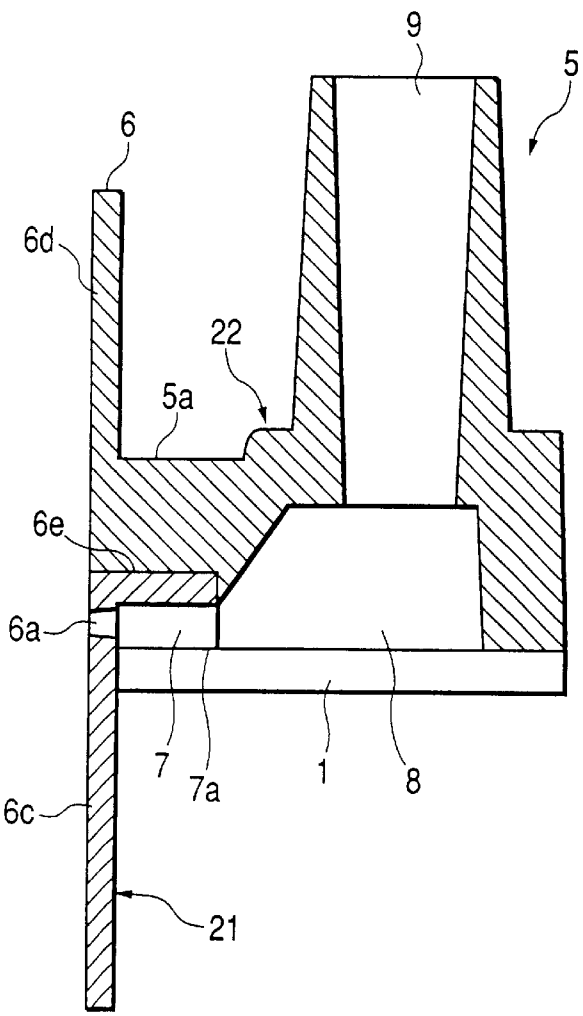
FIG. 19 is a cross-sectional view which shows the ceiling plate represented in FIG. 17.

In conjunction with FIG. 17 to FIG. 19, the description will be made of the structure of the ceiling plate 5 to be molded by means of the bicolor molding in accordance with an eighth embodiment of the present invention. In FIG. 17 to FIG. 19, the orifice plate 6 is divided into the orifice plate lower part 6*c* and the orifice plate upper part 6*d* and molded with the boundary surface 6*e* as boundary position in the vicinity above the nozzles 7.

Then, the ceiling plate 5 is structured by the first substrate 21 provided with the orifice plate lower part 6*c* and the nozzles 7, and the second substrate 22 provided with the orifice plate upper part 6*d,* the ink liquid chamber 8, the ink supply port 9, the receptacle 5*a,* and the outer circumference of the ceiling plate 5. The first substrate 21 and the second substrate 22 are bonded by means of the bicolor bonding. In other words, the upper and lower parts of the divisionally molded orifice plate 6 are molded integrally by means of the bicolor molding as the ceiling plate 5.

The first substrate 21 is structured with the thinner thickness portion of the orifice plate lower part 6*c* and the minute portions of the nozzles 7, which are the portions that required the highest molding precision in the ceiling plate 5, and also, which are the portions where the molding difficulties become extremely high. These portions are molded by use of the high-speed injection molding machine using the material having a good flowability to be suitable for the precise molding, such as polysulfone, polyether sulfone. The material should be transparent, and also, it shows the excellent result in the laser processing, and satisfies the conditions required for the molding of the orifice plate 6, and the machining process of ink discharge ports 6*a*. Further, the material is pure which does not contain any fillers. Therefore, unlike the material which is filled with fillers, it becomes possible to keep the wearing of the metallic mold smaller so as not to affect the durability of the expensive nozzle transfer mold dowels.

Also, since the first substrate 21 is molded with pure and transparent material (polysulfone, polyether sulfone, or the like), it becomes easier to observe the sealing condition in each of the sealed portions in the sealing step which is performed after the step where the ceiling plate 5 and the heater board 1 are in close, contact.

As described above, the first substrate 21 is structured with the orifice plate lower part 6*c* and the nozzles 7, and its configuration is simple. Therefore, it is made possible to implement the enhancement of the molding precision.

In other words, the surface precision of the nozzle lower face 7*a* becomes better than the ceiling plate 5 which is molded by means of the monochromatic molding. Therefore, the inner distortion becomes smaller when the nozzle lower face 7*a* is pressed to be in contact with the heater board 1.

Also, the orifice plate 6 which is the thinner thickness portion that makes the resin filling most difficult is divided into two, and molded in the first substrate 21 and second substrate 22 steps. Therefore, as compared with the conventional case where the orifice plate is molded at a time, the area of the thinner thickness portion is made smaller per molding step to facilitate the resin molding. Thus, the productivity is enhanced significantly, and at the same time, the molding precision is improved further still.

In this way, the ceiling plate 5 is divided into the first substrate 21 and the second substrate 22. Then, the structure is arranged so that the substrates are bonded together by means of the bicolor molding. This becomes a very effective means for enhancing the forming precision of the ceiling plate 5. Then, even when these substrates are molded by exactly the same material, each of them is molded in high precision if divisionally molded by the application of the polychromic molding method. The molding precision of the ceiling plate 5 is then enhanced significantly. Further, since both of them are bonded at the time of molding, there is no need for assembling, welding, or any other bonding steps. Thus, the productivity also becomes excellent.

On the other hand, it is not required for the second substrate 22 to acquire such transfer precision and dimensional precision as needed for the first substrate 21. Also, since the outer circumferential portion of the second substrate 22 carries the housing function, the mechanical property of this portion exerts a great influence on the performance of the ceiling plate 5 as a whole. With these aspects in view, it should be good enough if only the molding material is selected for the second substrate 22 giving more attention to its physical properties.

As shown in FIG. 19, the boundary surface 6*e* of the orifice plate 6 is arranged in the vicinity above the ink flow paths communicated from the nozzles 7 to the ink discharge ports 6*a*. Then, if the second substrate 22 is molded with the lower thermal expansion material, the second substrate 22 acts upon the ink, flow paths to block the thermal expansion that may take place in the ink flow paths in the direction of its arrangement when the environment changes. With the arrangement of the second substrate 22 molded with the lower thermal expansion material in the vicinity above the entire area of the ink flow paths formed continuously from the nozzles 7 to the ink discharge ports 6*a,* it is made possible to prevent each of the nozzles 7 and the ink discharge ports 6*a* from being deformed individually or to prevent the nozzles 7 and the ink discharge ports 6*a* from being displaced from the relatively facing positions. In order to reduce the linear expansion coefficient of polymeric material, it is most effective to adopt a method so that such material may be filled with fillers. As described in the preceding paragraph, however, if the bonding strength becomes greater between the first substrate 21 and the second substrate 22, the effect of the second substrate 22 is made smaller in complementing the thermal expansion of the first substrate 21.

In other words, the filler orientation becomes different between the resin flow direction and the direction at right angles to it. As a result, the linear expansion coefficient becomes smaller in the resin flow direction. However, there is a tendency that the linear expansion coefficient becomes greater in the direction at right angles to the resin flow direction. Therefore, the gate 32 for molding the second substrate 22 is arranged on the side to the nozzles 7 as shown in FIG. 4 so as to allow resin to flow in the arrangement direction of the nozzles 7. Then, the directional control of resin is made efficiently to suppress the thermal expansion of the nozzles 7 effectively in its arrangement direction. Also, the elastic modulus, the molding shrinkage, and other mechanical strength of the second substrate 22 can be demonstrated to the maximum in the arrangement direction of the nozzles 7. Particularly, the arrangement of the gate 32 should preferably made in the vicinity of the nozzle 7. Thus, it becomes easier to make the directional control of resin, and execute the directional control of resin stably. This is equally applicable to the base resin whose anisotropy is greater.

Also, when the fillers are filled in the molding resin used for the second substrate 22 to make the linear expansion coefficient of the second substrate 22 smaller, the bond performance becomes important between the base resin of the second substrate 22 and the resin used for the first substrate 21. Here, it is preferable to select the material having good compatible between the base resin of the second substrate 22 and the first substrate 21 in bonding them. For example, if the first substrate 21 is formed by polysulfone, the base resin of the second substrate, 22 is also formed by polysulfone, while polysulfone being filled with the carbon filler, the glass filler, or the like. In this way, the base resin used for both of them is the same, and the boundary surface bonding is performed in a better condition when the bicolor molding is executed. As a result, it becomes possible to improve the thermal expansion aspect of the second substrate 22 and the first substrate 21 significantly.

In addition, if the second substrate 22 is molded with the resin which is filled with fillers, there is an effect to enhance the molding precision of the second substrate 22 itself. In other words, when the fillers are filled, the mold shrinkage of the resin per se is relaxed by the presence of fillers. Naturally, therefore, the molding precision of the second substrate 22 is improved, and then, with the improved molding precision of the first substrate 21 and the second substrate 22, the molding precision of the ceiling plate 5 is automatically improved, because it is formed by bonding these two substrates.

Also, the ribs, bellows, bosses, seats, rectangles, or some other irregular lines are provided for the bonding interface between the first substrate 21 and the second substrate 22, and at the same time, the extrusions on the first substrate 21 are allowed to advance into the recesses of the second substrate 22 in order to insert the extrusions on the second substrate 22 into the recesses on the first substrate 21 to bond the first substrate 21 and the second substrate 22 together, hence making the bonding area of the first substrate 21 and the second substrate 22 greater to enable them to be bonded firmer. Also, if these irregular lines are provided, it becomes possible to suppress the voluminal changes of the first substrate 21 even when the first substrate 21 may present the voluminal changes by the ceiling plate 5 which is placed under the environment that causes great temperature changes, because the second substrate 22 is able to block such occurrence structurally in cooperation with the irregular lines thus provided therefor if the second substrate 22 is molded with resin having the smaller linear expansion coefficient.

Furthermore, if the irregular lines described above should be formed to be undercut in the releasing direction of the first substrate 21 and the second substrate 22, both of them are molded integrally even when the first substrate 21 and the second substrate 22 are molded with different materials or the bonding strength between them smaller, hence enabling the second substrate 22 to compensate for the weakness (robustness, thermal expansion, and the like) of the ceiling plate. Also, if the arrangement of the irregular lines are made in the same direction as the arrangement direction of the nozzles 7, it becomes possible to suppress the deviation of the relative positions of the discharge heaters 1*a* and the ink flow paths up to the ink discharge ports 6*a*.

So far, the description has been made of one example of the ceiling plate 5 applicable to the structure of the eighth embodiment in accordance with the present invention. However, the present invention is not necessarily limited to the mode of such ceiling plate or the configuration thereof. It is executable for any type of the ceiling plates, and the same effects can be anticipated.

For example, in accordance with the present embodiment, the ink supply port 9 is arranged in the direction orthogonal to the ink discharge direction, but the same effects are equally obtainable for the ceiling structure where ink supply port 9 is arranged in the same direction in which ink is discharged.

Also, the ceiling plate 5 of the present embodiment is structured so that the orifice plate 6 may be formed integrally with the ceiling plate 5 after its molding. Naturally, however, it is possible to execute the bicolor molding and obtain the same effect even if the orifice plate 6 is completely separated from the ceiling plate 5, and the structure of the liquid jet recording head is arranged so that after the molding of the ceiling plate 5, the orifice plate 6 is bonded to the ceiling plate 5 by means of bonding, connecting means, or the like.

Furthermore, the surface layer of the orifice plate 6 is separated from the main body of the orifice plate. Then, the surface layer of the orifice plate is formed by use of the material having good water repellency, and at the same time, the structure is arranged so that the ceiling plate 5 is completed by bonding the first substrate 21, the second substrate 22, and the surface layer of the orifice plate by three color molding. In this way, it becomes possible to simplify the manufacturing steps of the ceiling plate 5, because the water repellency treatment given to the surface of the orifice plate, which has conventionally been made in the secondary process, is now made executable at the time of molding.

Also, the present invention is not necessarily limited to the ceiling structure where nozzles 7 are produced by molding. The invention is applicable to the ceiling plate structure where the nozzles 7 are formed by the laser processing or the~like.

Also, as means for enhancing the robustness of the ceiling plate 5, the method is not necessarily limited to the use of the material having larger elastic modulus. There is a method for enhancing the robustness thereof structurally by devising the ceiling plate configuration. Then, it may be possible to enhance the robustness of the ceiling plate 5 by developing both the materials and structures.

Also, in accordance with the present embodiment, the orifice plate 6 is divided into two for forming its structure, but it is of course possible to divide the orifice plate 6 into three or more for the formation of its structure.

Also, the primary molding may be performed either for the first substrate 21 or for the second substrate 22 without any problem.

(Eighth Embodiment)

Figure 32A:
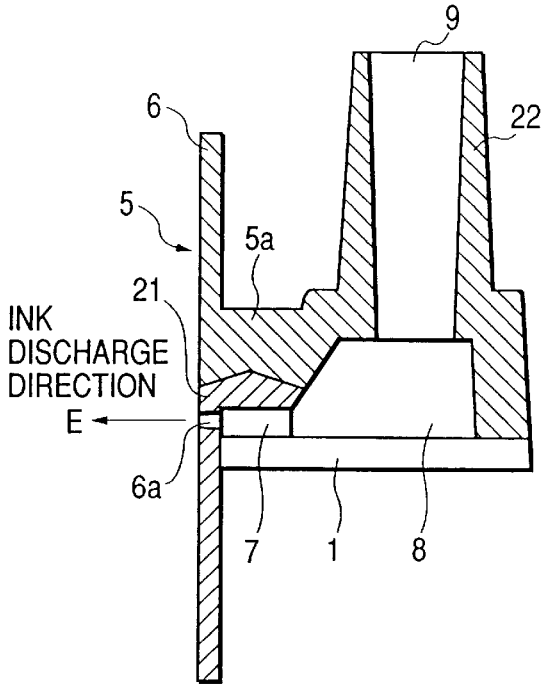
FIGS. 32A, 32B and 32C are side sectional views which illustrate the variational example of the liquid jet recording head in accordance with the eighth, embodiment of the present invention.
Figure 32B:
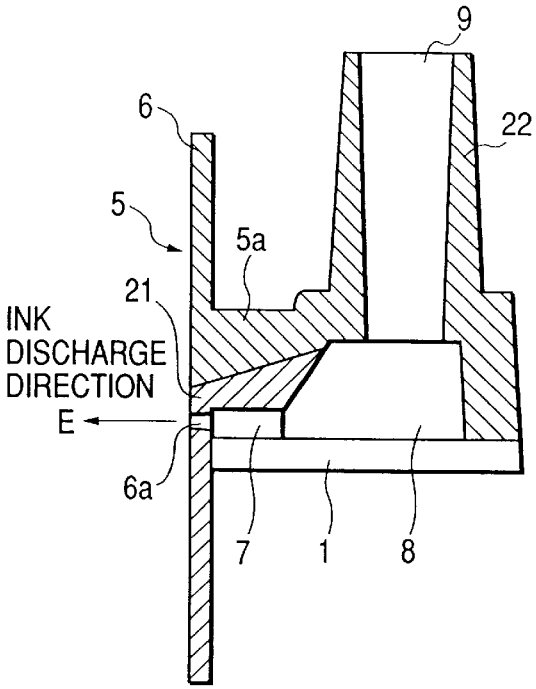
Figure 32C:
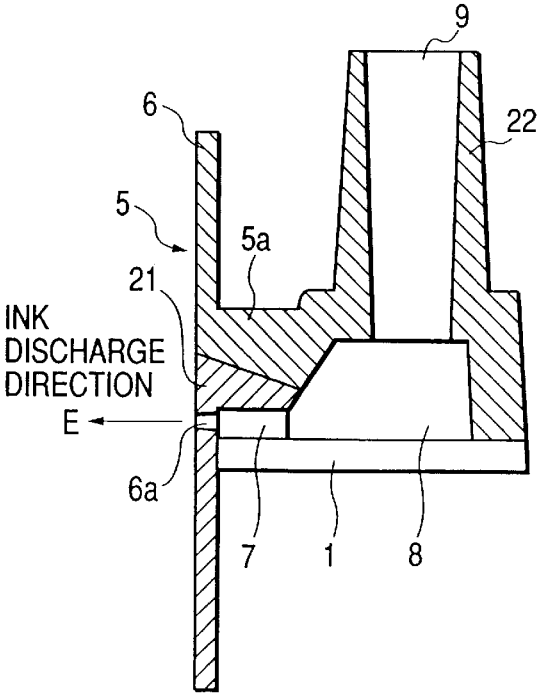

FIGS. 32A to 32C are side sectional views which illustrate the variational example of the eighth embodiment.

As shown in FIGS. 32A to 32C, it is possible to improve the transferability by controlling the resin flow when the grooved portion is molded by means of the injection molding with the change of the sectional configuration of the first substrate 21 in the longitudinal direction of the grooves. Further, the robustness of the ceiling plate member is changed in the longitudinal direction of the grooves to improve the close contactness between the nozzle 7 portion of the heater board 1 and the ceiling plate 5.

For example, as shown in FIG. 32A, the thickness of the central part of the first substrate 21 is made greater in the longitudinal direction of the nozzles 7. Then, when resin is filled in the first substrate 21, the gas and the air thus generated are led to the expanded central part by being pushed to flow by the resin which is filled in. Therefore, the gas bent is arranged on this portion to efficiently exhaust the gas externally. Also, since the material, which is harder to be deformed than the one used for the first substrate 21, is adopted for use of the second substrate 22. Consequently, in terms of the ceiling plate 5 as a whole, the central portion is more subjected to deformation, but the circumferential portions are not easily deformed. Therefore, if the convex warping takes place on the lower face of the first substrate 21 in the longitudinal direction of the nozzles 7, the extruded central portion, which is configured as shown in FIG. 32A, is deformed to be retracted to improve the close contactness of the circumferential portion when being compressed by use of the pressure spring 10.

Likewise, as shown in FIG. 32B, the upper wall of the nozzles 7 is made thinner on the ink discharge ports 6*a* side, while that on the ink liquid chamber 8 side is made thicker or as shown in FIG. 32C, the wall is made thicker on the ink discharge ports 6*a* side, while it is made thinner on the ink liquid chamber 8 side. Then, the gas vents are arranged on each of the thicker portions of the first substrate 21 to improve the gas exhaust condition at the time of molding. Also, by making the thicker portion of the first substrate 21 easily deformable, while making the thinner portion hardly deformable, respectively, it is possible to improve the close contactness between the heater board 1 and the ceiling plate 5.

(Ninth Embodiment)

Figure 20:
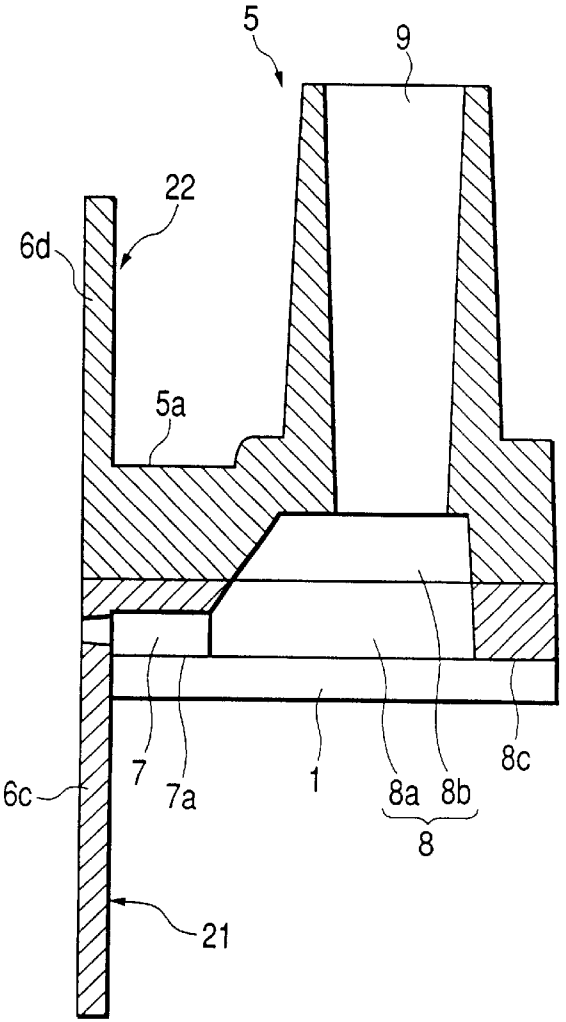
FIG. 20 is a cross-sectional view which shows the structure of the ceiling plate of the liquid jet recording head in accordance with a ninth embodiment of the present invention.

FIG. 20 is a cross-sectional view which shows the structure of the ceiling plate of the liquid jet recording head in accordance with a ninth embodiment of the present invention. Hereunder, the description will be made of the ninth embodiment by applying the same reference marks to the same parts as those appearing in the first embodiment.

For the present embodiment, the ink liquid chamber 8 is divided into the lower part 8*a* and the upper part 8*b* for molding. Then, the first substrate 21 is provided with the ink liquid chamber lower part 8*a,* the nozzles 7 and the orifice plate lower part 6*c.* These portions are molded in one and the same process so as to mold the step between the ink liquid chamber outer wall lower face 8*c* and the nozzle lower face 7*a* in high precision.

In FIG. 20, the first substrate 21 comprises the orifice plate lower part 6*c,* the nozzles 7, and the lower part 8*a* of the ink liquid chamber 8. The second substrate 22 comprises the upper part 8*b* of the ink liquid chamber 8, the ink supply port 9, the orifice plate upper part 6*d,* the receptacle 5*a,* and the outer circumference of the ceiling plate 5. The first substrate 21 and the second substrate 22 are bonded by means of the bicolor molding. In other words, the lower part 8*a* and the upper part 8*b* of the ink liquid chamber 8, the orifice plate lower part 6*c* and the orifice plate upper part 6*d* are integrally molded.

Since the nozzles 7 and the lower part 8*a* of the ink chamber 8 are molded with one and the same substrate, the mold dowel to mold the nozzles 7 and the mold dowel to mold the lower part 8*a* of the ink liquid chamber 8 are arranged in the same cavity. Therefore, as compared with the case where both of them are molded at each individual process, the step precision between the lower face 7*a* of the nozzles 7 and the outer wall lower face 8*c* of the ink liquid chamber is easily secured, hence making it easy and reliable to seal the outer circumference of the ink liquid chamber 8.

Also, since the first substrate 21 is molded with pure and transparent material (polysulfone, polyether sulfone, or the like), it becomes easier to observe sealing condition in each of the sealed portions in the sealing step which follows the step where the ceiling plate 5 and the heater board 1 are closely in contact as described in conjunction with the first embodiment.

Particularly, the observation of the sealing condition between the lower face 8*c* of the ink liquid chamber and the heater board 1 should be made from the outer circumference of the ceiling plate 5. Therefore, unless the portion on the lower face 8*c* of the ink liquid chamber outer walls is transparent, it is difficult to visually observe the sealing condition between them. In accordance with the present embodiment, the lower face portion of the ink liquid chamber is molded with the transparent material, it is easier to observe the sealing condition of the lower face 8*c* of the ink liquid chamber walls.

For the present embodiment, the ceiling plate is structured to handle one kind of ink. However, the ceiling plate to which the present embodiment is applicable is not necessarily limited to the structure described here. The present embodiment is equally executable for the liquid jet recording head having a plurality of ink liquid chambers to discharge many kinds of ink, and the same effects are obtainable.

In other words, separation walls are divisionally molded to provide a plurality of ink liquid chambers, and then, the first substrate is provided with the orifice plate lower part, the nozzle lower face, the ink liquid outer wall lower face, and the separation wall lower face to mold them within one and same cavity.

(Tenth Embodiment)

Figure 21:
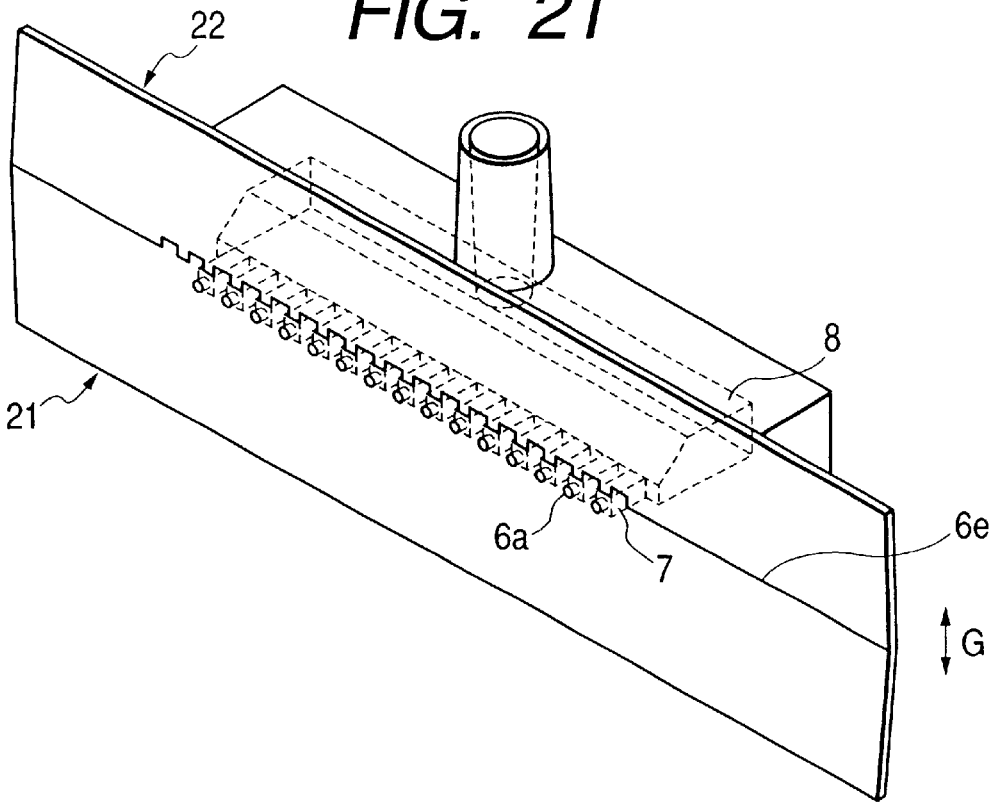
FIG. 21 is a perspective view which shows the ceiling plate of the liquid jet recording head in accordance with a tenth embodiment of the present invention.
Figure 22:
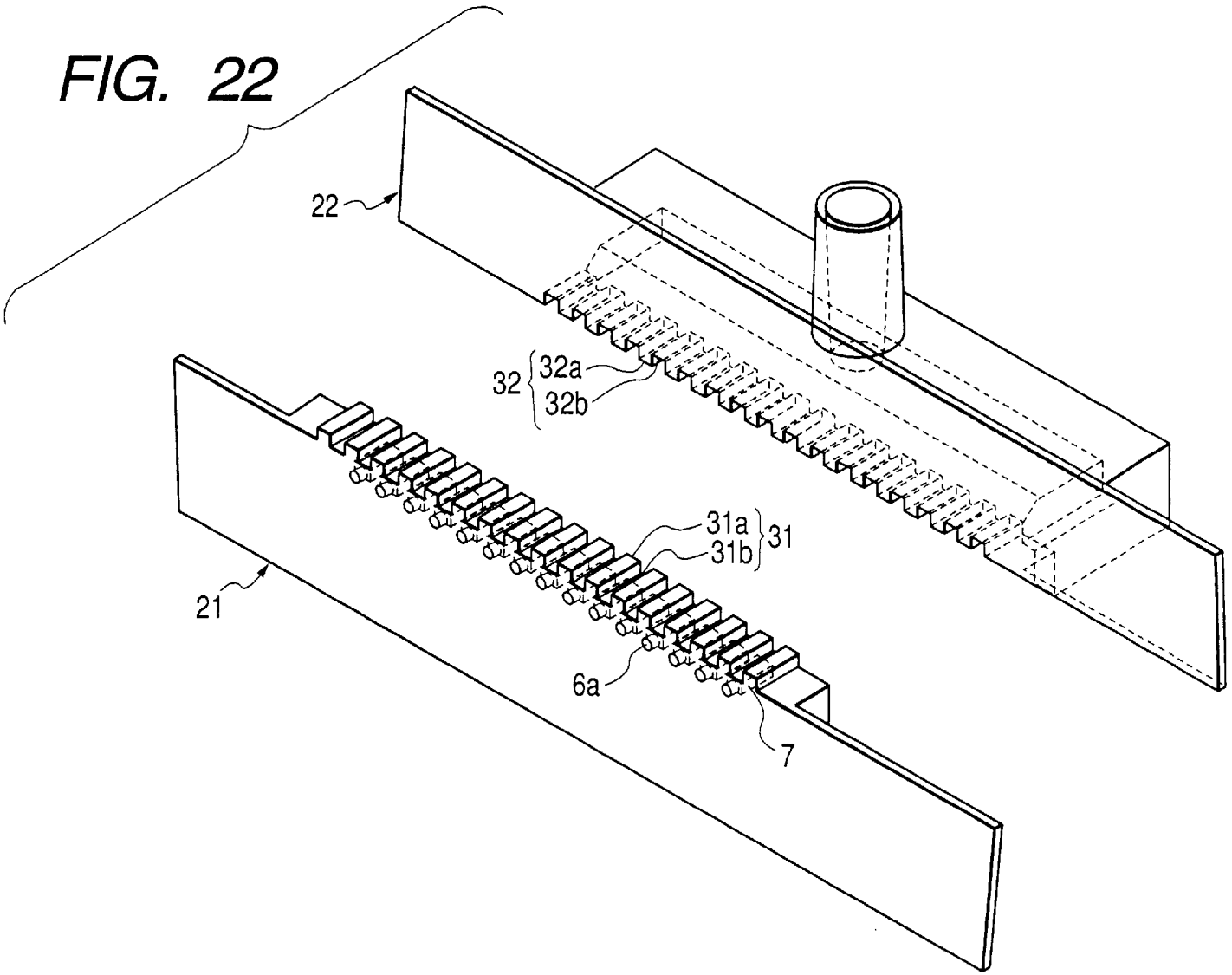
FIG. 22 is an exploded perspective view which shows the ceiling plate represented in FIG. 21, observed from the front face side of the orifice plate.
Figure 23:
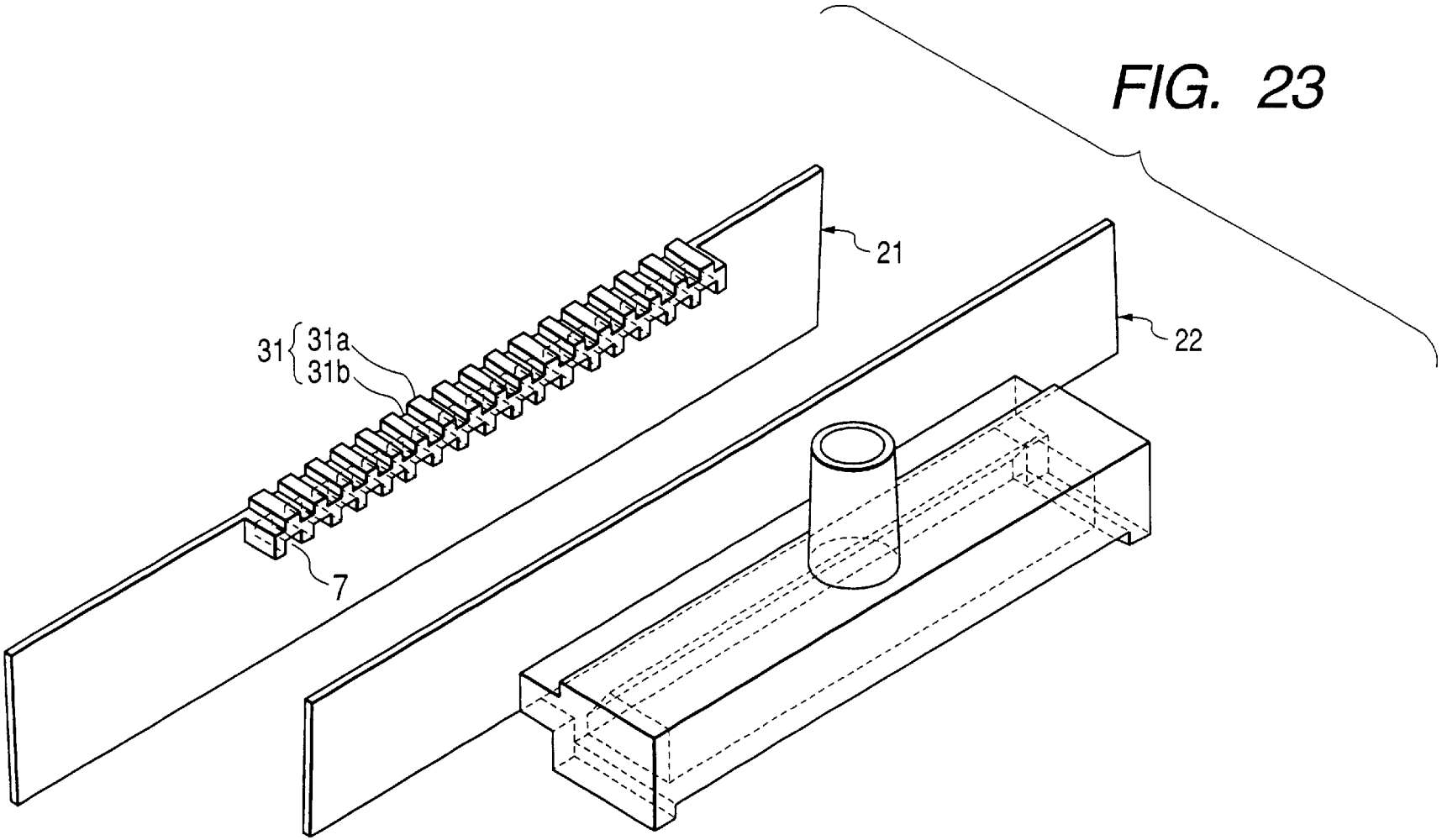
FIG. 23 is an exploded perspective view which shows the ceiling plate represented in FIG. 21, observed from the back face side of the orifice plate.

FIG. 21 is a perspective view which shows the ceiling plate of the liquid jet recording head in accordance with a tenth embodiment of the present invention. FIG. 22 is an exploded perspective view which shows the ceiling plate represented in FIG. 21, observed from the front face side of the orifice plate. FIG. 23 is an exploded perspective view which shows the ceiling plate represented in FIG. 21, observed from the back face side of the orifice plate.

In accordance with the embodiment described above, the structure is arranged so that the second substrate 22 is molded by the material having the smaller linear expansion coefficient to reduce the thermal expansion in the ink flow paths from the nozzles 7 to the ink discharge ports 6*a*. With this structure, however, the constraint force of the second substrate 22 becomes smaller when the ink flow paths are caused to be expanded or contracted in the arrangement direction thereof if the bonding force is smaller between the first substrate 21 and the second substrate 22. Then, it becomes difficult for the second substrate 22 to compensate for the weakness of the thermal expansion in the ink flow paths. Therefore, in accordance with the present embodiment, it is devised to overcome the weakness of the thermal expansion in the ink flow paths even in the case where the molding resin of the first substrate 21 and that of the second substrate 22 are not easily fused together.

Now, hereunder, with reference to FIG. 21 to FIG. 23, the description will be made of the tenth embodiment in accordance with the present invention by applying the same reference marks to the same parts as those appearing in the embodiment described above.

In FIG. 21 to FIG. 23, an irregular line 31 is arranged for the first substrate 21 in the form of ribs, and the irregular line 32 in the form of ribs is arranged for the second substrate 22 corresponding to the irregular line 31 arranged for the first substrate 21. These irregular lines 31 and 32 are arranged on the boundary surface 6*e* between the first substrate 21 and the second substrate 22 in the vicinity above the ink flow paths continuously present from the nozzles 7 to the discharge ports 6*a* in the same direction as the arrangement direction of the nozzles 7 and the ink discharge port 6*a* (ink flow paths). The extrusions 31*a* on the first substrate 21 advance into the recesses 32*b* on the second substrate 22. Then, the irregular lines 31 and 32 are arranged to face each other alternately so that the extrusions 32*a* on the second substrate 22 advance into the recesses 31*b* on the first substrate 21. In this way, these lines are bonded by means, of the bicolor bonding.

Consequently, if the second substrate 22 is molded with the material having the smaller linear expansion coefficient, the expansion and contraction of the nozzles 7 and the ink discharge ports 6*a* are blocked by the presence of the irregular lines 31 and 32 arranged for the substrates even when the nozzles 7 and the ink discharge ports 6*a* are caused to be expanded or contracted in its arrangement direction by the changes of the environmental temperature. Therefore, as compared with the mode that has not irregular lines 31 and 32, the constraint force of the second substrate 22 becomes greater significantly.

In other words, even if the first substrate 21 and the second substrate 22 cannot be easily fused together to make the resultant bonding force smaller, it is possible to suppress the thermal expansion in the arrangement direction of the nozzles 7 and the ink discharge ports 6*a,* because the irregular lines 31 and 32 are present on the boundary 6*e* between them. As a result, the combination of the molding materials of the first substrate 21 and the second substrate 22 can be selectively made from among a wide range thereof.

On the other hand, if the materials are selected so as to enable the first substrate 21 and the second substrate 22 to be fused together easily, the bonding area between them becomes greater to increase the constraint force which acts to block the expansion and contraction of the nozzles 7 and the ink discharge ports 6*a* in the arrangement direction thereof, provided that the thermal expansion property of the second substrate 22 is favorable.

Further, it may be possible to arrange the irregular lines 31 and 32 either at equal intervals or at irregular intervals. However, if the lines are arranged at the equal intervals, the molding resin is stabilized and allowed to flow regularly to be filled with a good efficiency, hence producing an effect to suppress the warping of the molded product, which contributes to enhancing the molding precision.

In accordance with the present embodiment, the irregular lines 31 and 32 are arranged in the form of ribs as constraint means for nozzles 7 and the ink discharge ports 6 on the boundary 6*e* between the first substrate 21 and the second substrate 22. However, the constraint means is not necessarily limited to the arrangement of the irregular lines in the form of ribs.

The same effect may be demonstrated by the irregular lines in the form of bellows, bosses, seats, rectangles, or the like.

Figure 24:
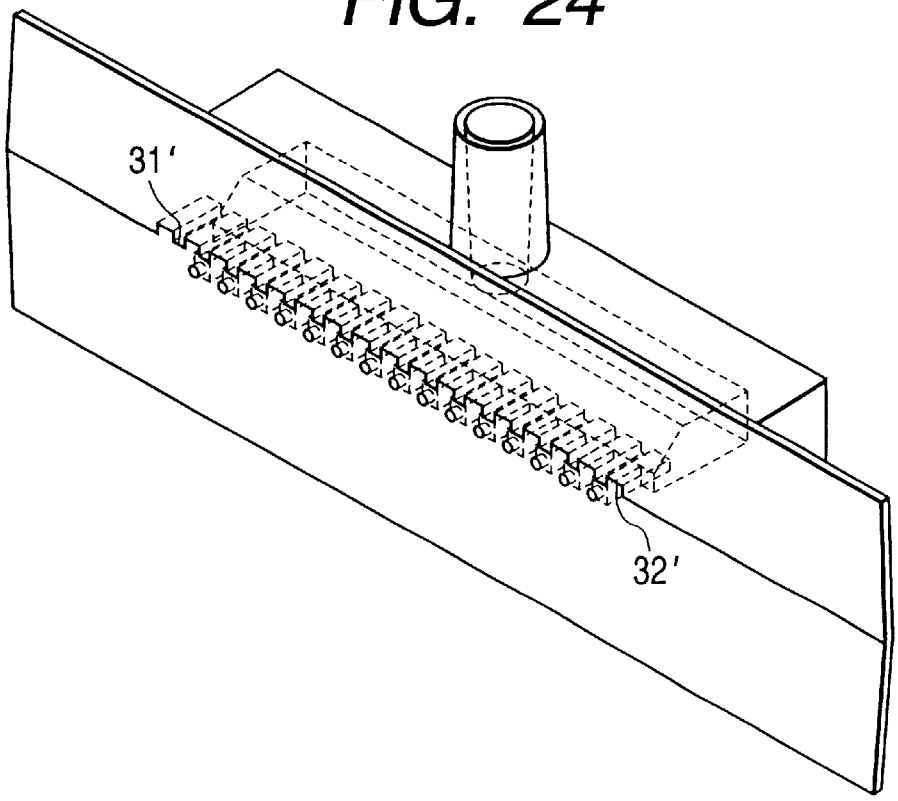
FIG. 24 is a perspective view which shows one variational example of the ceiling plate of the liquid jet recording head in accordance with the tenth embodiment of the present invention.

Also, the bonding force between the substrates may be enhanced still more if the irregular lines 31' and 32' are formed so that both of them are undercut in the reversely tapered irregular line configuration as shown in FIG. 24 in the releasing direction of the substrate 21 and the second substrate 22 (in the direction indicated by an arrow G in FIG. 21), for example.

Also, the irregular lines are not necessarily limited to in the arrangement direction of the ink flow paths. It may be possible to arrange them in the ink discharge direction.

Also, nozzle constraint means is not necessarily limited to the irregular lines. It may be possible to arrange the structure so that the second substrate 22 holds side faces of both ends of the ink flow paths. Also, if the arrangement of the irregular lines and the holding of side faces of both ends are adopted in combination, it becomes possible to anticipate more effect in a better condition.

Here, in accordance with the present embodiment, the description has been made of the thermal expansion weakness of the ink flow paths. However, the adoption of the structure of the tenth embodiment may also be an effective method in which the second substrate 22 enhances the robustness of the ceiling plate as a whole.

Also, the boundary surface 6*e* between the orifice plate upper part and the orifice plate lower part is not necessarily a straight line. It may be possible to mold this boundary surface in the irregular form, the undulated form, or the like.

(Eleventh Embodiment)

Figure 25:
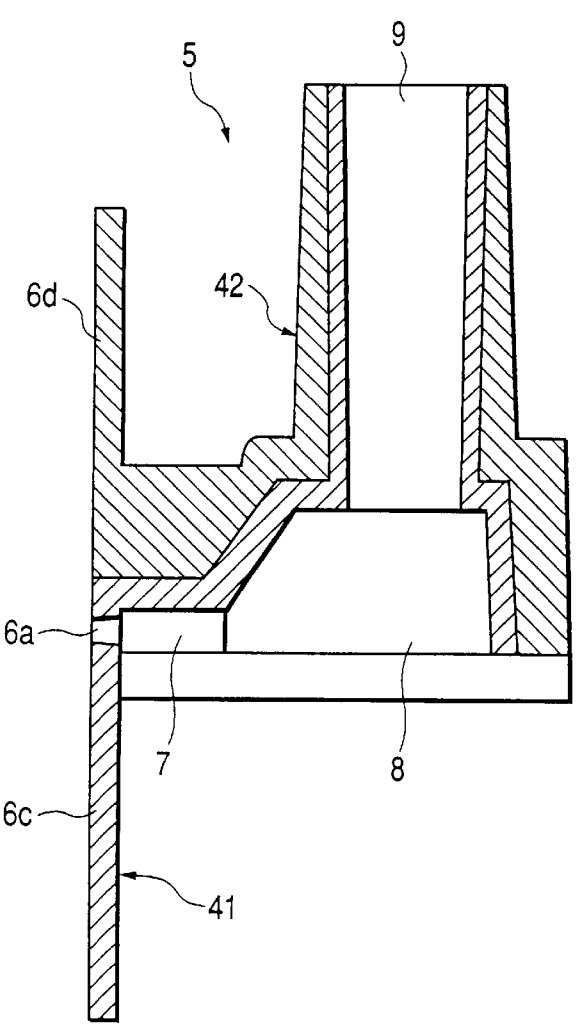
FIG. 25 is a schematically cross-sectional view which shows the ceiling plate of the liquid jet recording head in accordance with an eleventh embodiment of the present invention.

FIG. 25 is a schematically cross-sectional view which shows the ceiling plate of the liquid jet recording head in accordance with an eleventh embodiment of the present invention.

For the embodiment described above, the molding material of the second substrate should be excellent in ink resistive properties. Generally, ink has a high alkaline component, and also, ink is produced by mixing various chemicals. To this end, It is practiced to select the material having an excellent resistance to chemicals as the molding material of the ceiling plate. It is not feasible to select the inexpensive versatile base resin unless fillers are mixed with the versatile base resin, because the inexpensive base resin is generally inferior in the ink resistive performance.

The volume of the second substrate is larger than that of the first embodiment and required more amount of material. Therefore, if the base resin of the molding material used for the second substrate is inexpensive, it becomes possible to manufacture the finished ceiling plate at lower costs.

Now, in accordance with the present embodiment, the ceiling plate is divided into the ink-contact unit substrate that is in contact with ink, and the non-ink contact unit substrate that is not in contact with ink. Then, both of them are bonded by means of the bicolor molding.

Hereunder, with reference to FIG. 25, the eleventh embodiment will be described in accordance with the present invention by applying the same reference marks' to the same parts as those appearing in the embodiment described above.

In FIG. 25, the ceiling plate 5 comprises the ink contact unit substrate 41 which is always in contact with ink, having the orifice plate lower part 6*c* that includes the ink discharge ports 6*a,* nozzles 7, an ink liquid chamber 8, and ink supply port 9; and the nonink contact unit substrate 42 which is not in contact with ink, having the orifice plate upper part 6*d,* and the outer circumference portion of the ceiling plate 5.

The ink contact unit substrate 41 and the non-ink contact unit substrate 42 are bonded together by means of the bicolor molding.

In accordance with the present embodiment, there is no need for the non-ink contact unit portion 42 to be provided with the ink resistance characteristics.

For that matter, the material, which is prepared by the inexpensive base resin having fillers filled in it, can be used for this portion, making it possible to manufacture the bicolor molded ceiling plate at lower costs.

As described in conjunction with the first embodiment, the fillers filled in the material that forms the non-ink contact portion 42 the molding shrinkage per se of such material can be relaxed by the fillers filled in it. As a result, the molding precision of the non-ink contact portion 42 is enhanced. Also, with the fillers thus filled, the linear expansion coefficient becomes smaller for the non-ink contact portion 42 to block the deformation of the ink flow paths that may be caused by the environmental changes. At the same time, the elastic modulus is made higher to enhance the robustness of the ceiling plate 5 as a whole accordingly. In order to enhance the robustness still more, it may be possible to mold the non-ink contact portion 42 by means of the metal injection, the ceramics injection, or the like.

Also, since the thickness of the inner wall of the ink liquid chamber 8, and the thickness of the inner wall of the ink supply port 9 can be set arbitrarily, the ink contact unit substrate 41 is made in the uniform thickness as a whole if the structure is arranged so that the thickness of the orifice plate lower part 6*c* and that of the upper part of the nozzles 7 are almost in agreement with each other. Then, the molding material is allowed to flow efficiently, hence making it possible to finish the ceiling plate in high molding precision.

(Twelfth Embodiment)

Figure 26:
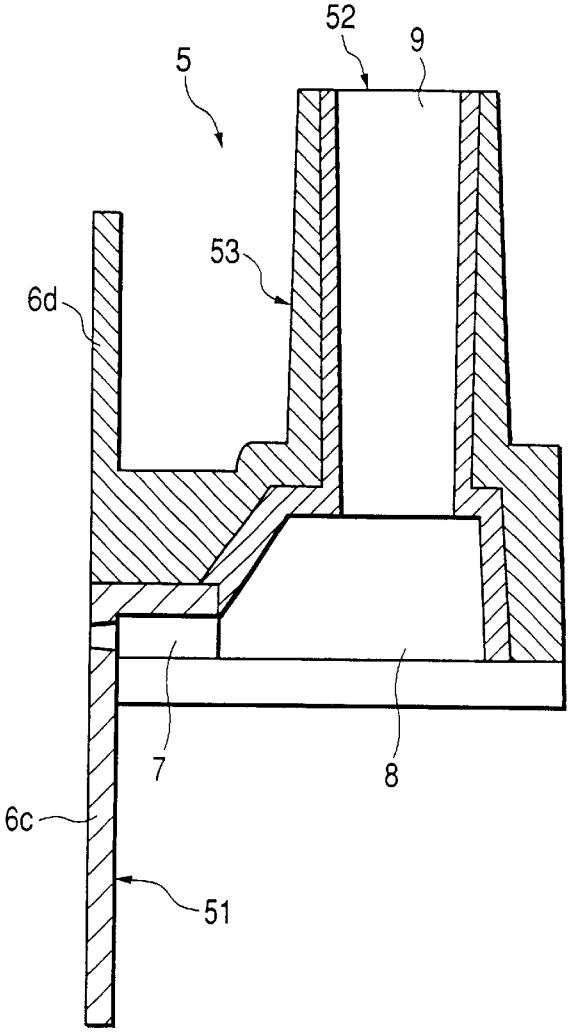
FIG. 26 is a schematically cross-sectional view which shows the ceiling plate of the liquid jet recording head in accordance with a twelfth embodiment of the present invention.

FIG. 26 is a schematically cross-sectional view which shows the ceiling plate of the liquid jet recording head in accordance with a twelfth embodiment of the present invention.

In accordance with the eleventh embodiment, since the ink contact unit substrate is provided with the ink liquid chamber 8 and the ink supply port 9, welds are formed on the finished product when this portion is molded. Therefore, when the ceiling plate 5 having nozzles in high density is molded, there is a fear that the welds thus formed affect the filling performance on the thinner thickness portion and the minute portion of the ink contact unit substrate.

Now, therefore, in accordance with the present embodiment, the structure is arranged to configure the thinner thickness portion of the orifice plate lower part 6*c,* and the minute portions of the nozzles 7 so as to form welds on them, hence making it possible to mold the ceiling plate 5 at lower costs, while enhancing the molding precision.

Hereunder, with reference to FIG. 26, the twelfth embodiment will be described in accordance with the present invention by applying the same reference marks to the same parts as those appearing in the embodiment described above.

As shown in FIG. 26, the ceiling plate 5 comprises the ink discharge unit substrate 51 formed by the orifice plate lower part 6*c,* and the nozzles 7; the ink supply unit substrate 52 formed by the ink liquid chamber 8 and ink supply port 9; and the outer circumference unit substrate 53 that forms the orifice plate upper part 6*d* and the outer circumference portion of the ceiling plate 5. In other words, the ink contact unit substrate 41 shown in FIG. 25 is further divided into the ink discharge unit substrate 51 and the ink supply unit substrate 52. Then, these ink discharge unit substrate 51, the ink supply unit substrate 52, and the outer circumference unit substrate 53 are bonded by means of the three bonding.

With the ceiling plate 5 thus divided into three substrates, the ink discharge unit substrate 51 is configured simply in a uniform thickness. Also, with this configuration, it is possible to block the creation of welds, and mold this substrate in high precision. On the other hand, since the outer circumference substrate 53 does not require any ink resistive characteristics, it becomes possible to adopt the inexpensive versatile material for this substrate.

It is of course possible to adopt for the outer circumference unit substrate 51 the same material as the one used for the non-ink contact unit substrate described in conjunction with the fourth embodiment.

As described above, with the ink discharge unit substrate 51, the ink supply unit substrate 52, and the outer circumference unit substrate 53 which are integrally molded by means of the three color molding, it becomes possible to mold the ceiling plate 5 having the highly densified nozzles in high precision at lower costs.

In accordance with the present invention described above, the orifice plate integrally molded with the ceiling plate member is divided into the orifice plate lower part that includes the discharge ports, and the orifice plate upper part where not discharge ports are included. At the same time, the ceiling plate member is structured at least by the two substrates: the substrate that includes the orifice plate lower part and the substrate that includes the orifice plate upper part depending on the required dimensional precision, mechanical strength, and ink resistive performance. Each of the substrates is bonded by means of the polychromic bonding to mold it integrally, hence molding the ceiling plate member by the combination of various resins, metals, ceramics, fillers, and the like. In this manner, the multiply functional ceiling plate member is obtained in high precision, which has never been implemented by means of the monochromatic molding. Also, since the thinner thickness orifice plate is divisionally molded by the two steps of the primary molding and the secondary molding, the area of the thinner thickness portion becomes smaller per molding step and the difficulty of resin filling is made smaller to enhance the productivity significantly. Further, the molding precision is improved still more.

Particularly when the ceiling plate member is structured with the grooves corresponding to the ink flow paths, the first substrate formed by the orifice plate lower part, and the second substrate formed by the orifice plate upper part, the ink liquid chamber, and the ink supply port, the first substrate is simply configured to make it easier to structure it with the uniform thickness. In this way, the flow of resin is stabilized to make the precise molding possible. On the other hand, if the portion of the aforesaid ink liquid chamber, which is in close contact with the substrate member, is structured as the first substrate, the portion of the ceiling plate member, which is in close contact with the substrate member, becomes the same substrate, the metallic mold dowels used for transferring the ink liquid chamber lower face and the ink flow path lower face can be arranged in the same metallic mold. Therefore, it becomes easier to provide the step precision between them when the metallic mold is produced. Consequently, even for the ceiling plate member which is molded by means of the bicolor molding, the step difference between the ink liquid chamber lower face and the ink flow path lower face is molded in high precision.

(Thirteenth Embodiment)

Figure 27:
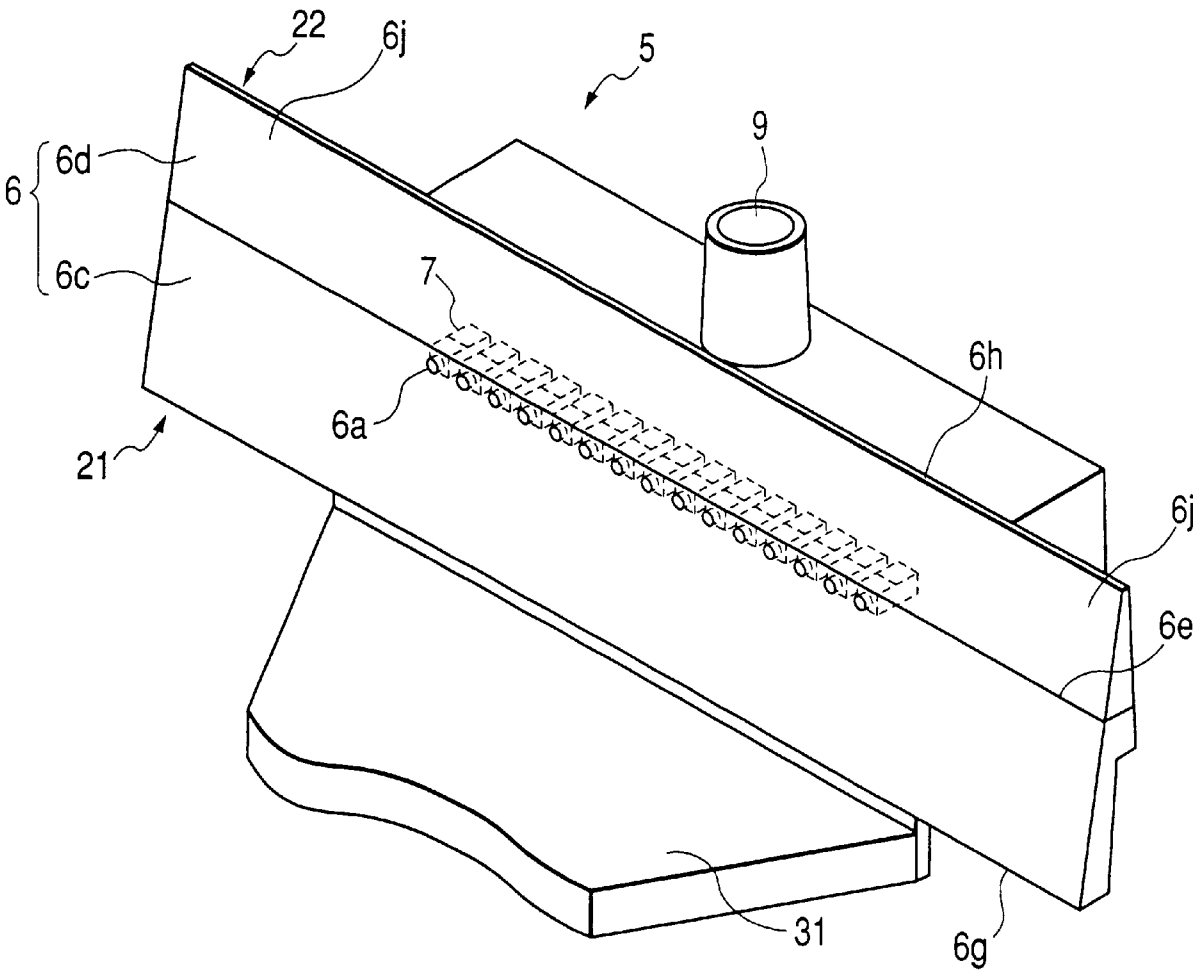
FIG. 27 is a perspective view which shows the ceiling plate of the liquid jet recording head in accordance with a thirteenth embodiment of the present invention, observed from the front face side of the ceiling plate.
Figure 28:
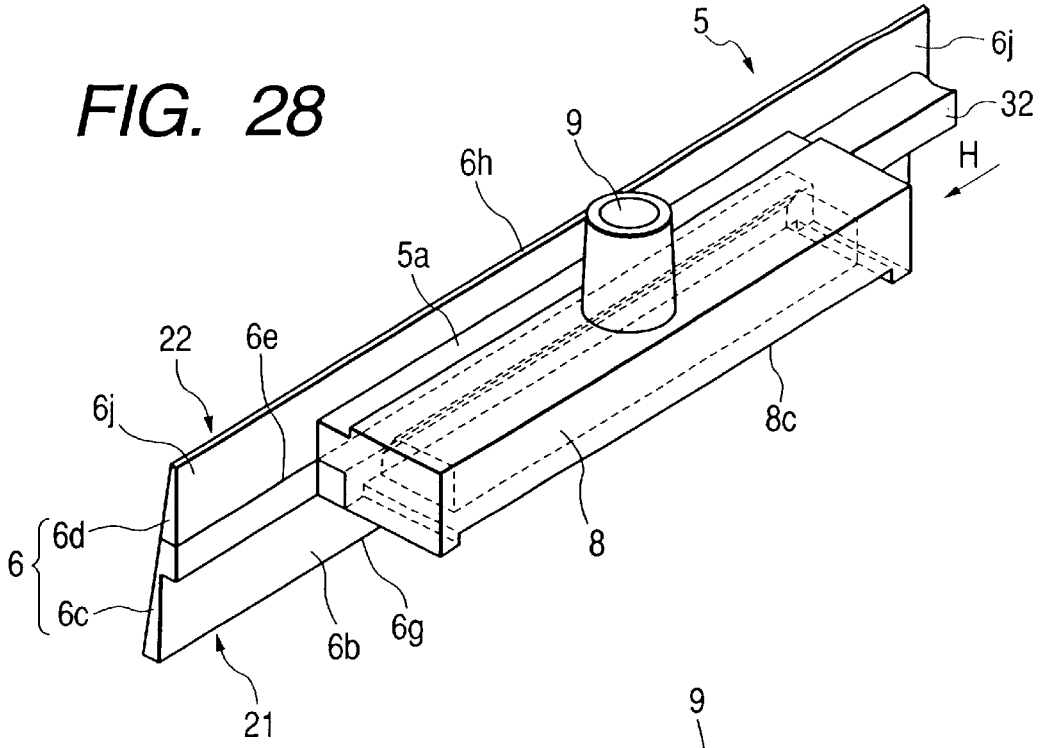
FIG. 28 is a perspective view which shows the ceiling plate represented in FIG. 27, observed from the back face side thereof.
Figure 29:
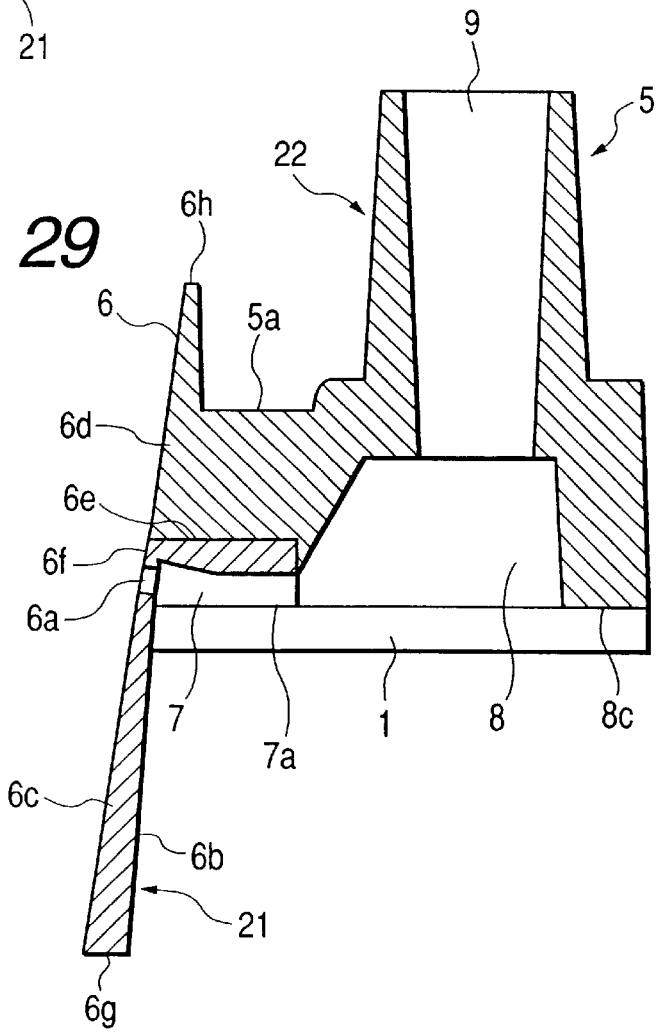
FIG. 29 is a cross-sectional view which shows the ceiling plate represented in FIG. 27.

In conjunction with FIG. 27 to FIG. 29, the description will be made of the structure of the ceiling plate 5 molded by means of the bicolor molding , in accordance with a thirteenth embodiment of the present invention. As shown in FIG. 27 to FIG. 29, the orifice plate 6 is divisionally molded as the orifice plate lower part 6*c* and the orifice plate upper part 6*d* with the boundary surface 6*e* positioned above in the vicinity of the nozzles 7 as the boundary between them.

Then, the ceiling plate 5 is structured with the fist substrate 21 formed by the orifice plate lower part 6*c* and nozzles 7, and the second substrate 22 formed with the orifice plate upper part 6*d,* the ink liquid chamber 8, the ink supply port 9, the receptacle 5*a,* and the outer circumference portion of the ceiling plate 5. The first substrate 21 and the second substrate 22 are bonded by means of the bicolor molding. In other words, the upper and lower parts of the orifice plate 6 which are divisionally molded are integrated by means of the bicolor molding as the ceiling 5.

In this respect, FIG. 27 and FIG. 28 illustrate the gate 31 which becomes the injection path for molding the first substrate 21, and the gate 32 which becomes the injection path for molding the second substrate 22, respectively. The gate 31 to mold the first substrate 21 is arranged on the orifice plate lower side face 6*g* which is lower face of the orifice plate lower part 6*c*.

The first substrate 21 is formed with the orifice plate lower part 6*c* and the minute portions of the nozzles 7. Thus, in the ceiling plate 5, the highest precision is required for this portion, and the molding difficulty becomes extremely high. This portion is molded with the material, such as polysulfone, polyether sulfone, which is suitable for the precise molding, having a good flowability. The material is transparent, and also, it shows the excellent result in the laser processing, and satisfies the conditions required for the molding of the orifice plate 6, and the machining process of ink discharge ports 6*a*. Further, if the material is pure which does not contain any fillers, it becomes possible to keep the wearing of the metallic mold smaller so as not to affect the durability of the expensive nozzle transfer mold dowels unlike the material which is filled with fillers.

As shown in FIG. 29, the circumferential portion 6f of the discharge port on the orifice plate lower part 6*c* has the thinnest thickness of several tens of $\mu$m for the first substrate 21, and if this area is wider, it affects the filling of resin. Therefore, the thickness of the orifice plate lower part 6*c* is inclined smoothly so that it becomes gradually thicker downwardly from the circumferential portion 6*f* of the discharge ports. This arrangement is made in order to avoid the irregular changes in the thickness, while implementing the enhancement of the molding precision, and also, to reduce the pressure loss of the flowing resin for the implementation of the filling enhancement. At the same time, it is aimed at making the strength higher for the orifice plate 6. Further, if the structure is arranged so that resin is injected from the orifice plate lower part 6*c* side, it becomes possible to maintain the higher flowability, because with the configuration thus formed, resin is allowed to generate shearing heat actively.

Also, the gate 31 is the fan gate which is elongated in the nozzle arrangement direction, and resin is allowed to flow sprightly to the nozzles 7 without detouring. Then, in the arrangement direction of nozzles 7, the uniform flow of resin is maintained stably without any unevenness. Here, the gate 31 is represented as the fan gate. However, the present invention is not necessarily limited to the use of the fan gate. The film gate is also applicable.

The width of the leading end of each nozzle 7 is several $\mu$m to several tens of $\mu$m. In recent years, along with the higher density arrangement, the width is approximately several $\mu$m. Also, the depth of each groove (the height of each nozzle 7) is approximately 20 $\mu$m to 70 $\mu$m. The arrangement pitch of the nozzles 7 is 42.3 $\mu$m in a case of 600 dpi, for example. Therefore, the nozzles are in an extremely fine configuration, and naturally, it is most difficult to transfer the nozzles 7 exactly in molding the ceiling plate. The resin, which is injected from the gate 31 arranged on the lower side face 6*g* of the orifice plate, is straightly raised from the orifice plate lower side face 6*g* through the orifice plate lower part 6*c,* and bent at the discharge circumferential portion 6*f,* and then, flows toward the back face in the longitudinal direction of the nozzles 7. Such flow of resin as this is orthogonal to the flow direction of resin to the leading portion of each groove. Therefore, in the stage of the injection process, it is difficult to allow resin to flow up to the leading end of each groove of the nozzles 7. In this respect, if the gate is arranged directly above the nozzles 7, it becomes possible to fill resin in the nozzle 7 portions in the stage of the injection process. However, since the injection pressure is added to the mold dowels for use of the groove transfer, there is a fear that the mold dowels are damaged. This is not considered advisable.

As described earlier, if the filling is not sufficient at the time of injection process, the dwelling pressure in the dwell process is biased to the portion where filling is yet to be made when it is exerted, and the dwelling pressure is not allowed to act upon the entire interior of the metallic mold. As a result, it becomes extremely difficult to transfer resin to the leading end of each minute portion.

In other words, in order to allow resin to be filled exactly up to the leading end of each nozzle 7 in the dwell process, the viscosity of resin is made smaller in the stage of the injection process by the application of the shearing heat or by the temperature control to enable resin to flow as fast as possible. It is then important to quickly complete the resin filling that may be executable at this state.

Therefore, with the structure arranged in accordance with the present embodiment, the distance between the gate 31 to the nozzles 7 is shortened to enable resin to flow quickly and stably to the circumference of nozzles 7. Consequently, the dwelling pressure acts efficiently upon the circumferential portions of the nozzles 7 at the time of the dwell process. Then, the resultant transfer of resin to the leading end of each nozzle 7 is made exactly, and it becomes possible to handle the nozzles 7 sufficiently, which should be molded in still higher density from now on.

As described above, in accordance with the present embodiment, the flow of resin is stabilized to make it easier to transfer the minute portions by the effect of the simplified configuration of the first substrate 21 and the gate 31 which is arranged on the orifice plate lower side face 6*c*. Then, there is no need for the formation of the step on the surface of the orifice plate. As shown in FIG. 28, however, it is necessary to increase the thickness of the back face of the both side portions 6*j* (the portion where not ink liquid chamber 8 is present on the back face thereof) of the orifice plate 6 in the arrangement direction of the nozzles 7 so as to enhance the strength of that portion.

Further, the surface of the orifice plate 6 is uniformly flat or curved from the lower end to the upper end to present a smooth surface. Therefore, the blade can slidably rub the surface of the orifice plate 6 without any resistance to make it possible to clean the surface of the orifice plate 6. As a result, the cleaning can be operated efficiently, and the durability of the blade is also improved.

Also, there is no step on the surface of the orifice plate 6, the distance between a recording sheet and the ink discharge ports 6*a* can be made smaller to improve the ink impact precision.

Here, the description has been made of one example of the ceiling plate 5 applicable to the structure in accordance with the thirteenth embodiment of the present invention. However, the present invention may be executable with respect to any ceiling plate irrespective of the mode and configuration of the ceiling plate, and the same effect can be anticipated.

For example, in accordance with the present embodiment, the ink supply port 9 is arranged in the direction orthogonal to the ink discharge direction. However, the same effect is obtainable even if the ceiling plate is structured so that the ink supply port 9 is arranged in the same direction in which ink is discharged.

Also, the surface layer of the orifice plate 6 is separated from the orifice plate main body. Then, the surface layer of the orifice plate is molded with the material having a good water repellency, and at the same time, the structure is arranged so that the ceiling plate 5 is completed by bonding the first substrate 21, the second substrate 22, and the orifice plate surface layer by means of the three color molding. In this way, it becomes possible to simplify the manufacturing process of the ceiling plate 5, because the water repellency treatment, which has been given to the orifice plate surface in the secondary process conventionally, can be given at the time of molding the ceiling plate.

Also, as means for enhancing the robustness of the ceiling plate 5, the method is not necessarily limited to the selection of the material having a greater elastic modulus. However, there is a method for enhancing the robustness of the ceiling plate by devising its configuration. Therefore, it may be possible to increase the robustness of the ceiling plate 5 by developing both the material and the structure.

Figure 30:
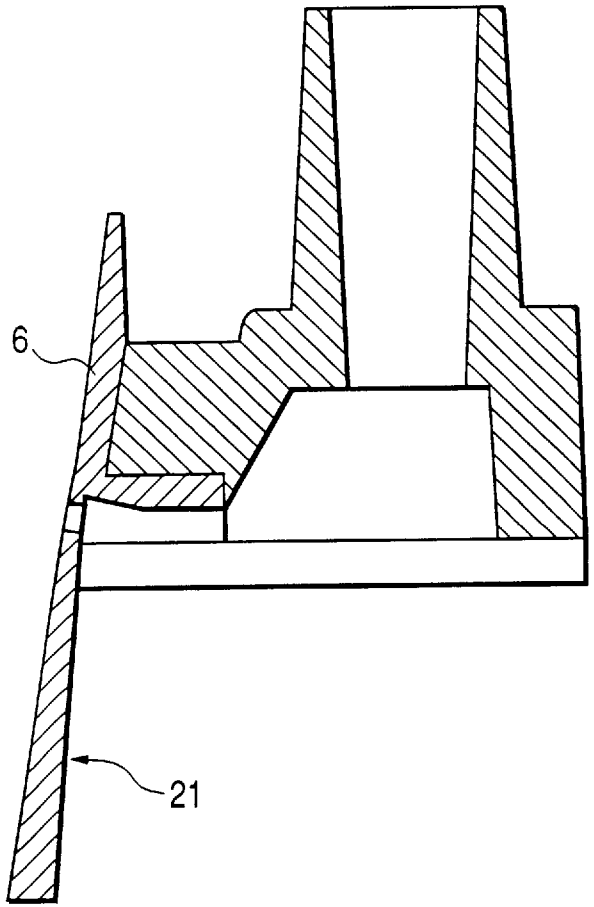
FIG. 30 is a cross-sectional view which shows the variational example of the liquid jet recording head in accordance with the thirteenth embodiment of the present invention.

Also, in accordance with the present embodiment, the orifice plate 6 is divided into two structures. Naturally, however, as shown cross-sectionally in FIG. 30, it may be possible to arrange the structure so that the entire area of the orifice plate 6 is included in the first substrate 21 or to arrange the structure so that the orifice plate 6 is molded in three or more divisions. If the entire area of the orifice plate 6 is structured as the first substrate 21, the surface of the orifice plate 6 is formed to be extremely smooth unlike the ease where the orifice plate 6 is molded divisionally.

The components that structure the first substrate 21 are not necessarily limited to the orifice plate 6 and the nozzles 7, but the ink liquid chamber 8 may be divided into two, and then, to include the lower part in the first substrate or the structure may be arranged so as to include all the portions that are in contact with ink in the first substrate.

Further, the orifice plate 6 and the nozzles 7 are separated, and then, the structure may be arranged so that these portions are molded by means of the polychromic molding.

Also, the position of the gate 31 for use of molding the first substrate 21 is not necessarily limited to the lower side face 6*g* of the orifice plate, but it may be possible to arrange this gate on one end face or on both end faces of the orifice plate 6 in the arrangement direction of the nozzles 7. If the gate is arranged on the end face of the orifice plate, resin is injected straightly without being bent in the side direction of the nozzles. As a result, the pressure loss is made smaller to make it possible to allow resin to flow toward the circumferential portion 6*f* of the discharge ports. Moreover, the gate width can be made smaller to cut the gate easily for the enhancement of the productivity. If the structure is arranged so that the entire area of the orifice plate is included in the first substrate 21, it may be possible to arrange the gate on the upper side face 6*h* of the orifice plate.

Figure 31:
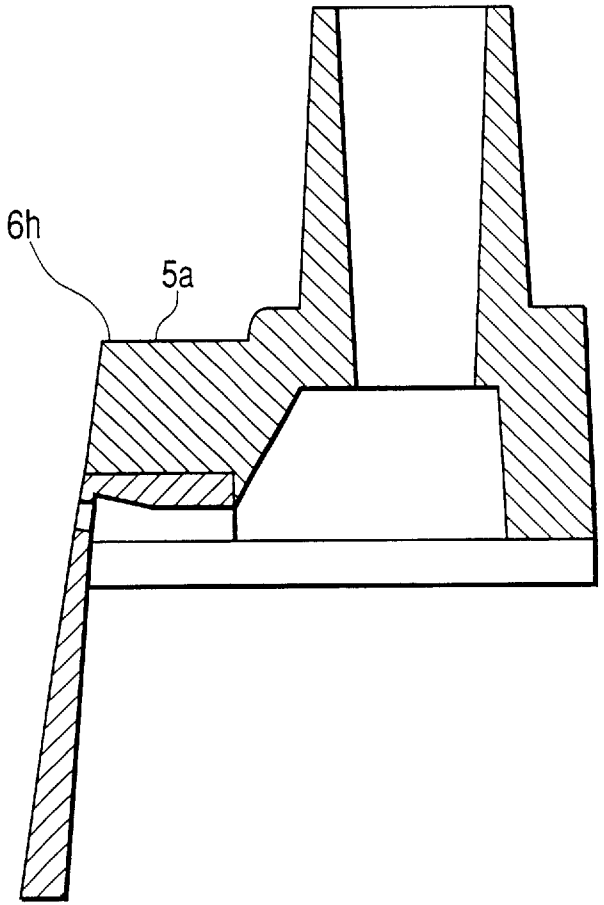
FIG. 31 is a cross-sectional view which shows another variational example of the liquid jet recording head in accordance with the thirteenth embodiment of the present invention.

Furthermore, in accordance with the example described above, the upper side face 6*h* of the orifice plate is positioned above the receptacle 5*a* of the ceiling plate 5. As shown in FIG. 31, however, it may be possible to form the upper side face 6*h* of the orifice plate and the receptacle 5*a* on one and the same surface or to form the upper side face 6*h* of the orifice plate in the position lower than the receptacle 5*a*. In this way, it becomes possible to set the acting point of the pressure unit lOb of the pressure spring 10 on the position nearer to the surface of the orifice plate 6. As a result, the pressure can be exerted on the region on the nozzles 7, which is nearer to the ink discharge ports 6*a*, and then, the close contactness in the vicinity of the ink discharge ports 6*a* is reliably increased to implement the close contact more stably.

In this respect, the primary molding may be performed either for the first substrate 21 or the second substrate 22 in the execution of the bicolor molding.

As described above, in accordance with the present invention, the surface of the orifice plate is formed by the uniform plane or by the curved plane. Then, the ceiling plate member is divided into the first substrate that includes the circumferential portion of the discharge ports and the grooves of the orifice plate, and the second substrate formed by all the other portions. Thus, the structure is arranged to integrate them by means of the bicolor molding in order to configure the first substrate simply. As a result, it becomes possible to enhance the transferability at the time of molding, the molding precision, the surface precision of the bonded face with the substrate member, and others. Then, the flow of material and directivity thereof are stabilized when injected into the metallic mold for molding the first substrate without any unwanted loss of the pressure in the flow of material. Therefore, the transferability of the ink flow paths which requires the high molding precision, and the molding precision are enhanced significantly. Also, it becomes possible to obtain the multiply functional ceiling plate in high precision, which has never been implemented by means of the monochromatic molding, by combining various resins, ceramics, metals, filler, and the like for the polychromic molding.

Furthermore, since the surface of the orifice plate is formed by the uniformly flat plane or curved plane, the surface wiping of the orifice plate can be performed effectively, and at the same time, the distance to a recording medium is made smaller to enhance the impact precision of ink to be discarded from it.

What is claimed is:

1. A liquid jet recording head comprising:

a substrate member provided with discharge energy generating elements for generating ink discharge energy corresponding to a plurality of ink flow paths;

a plurality of grooves corresponding to said plurality of ink flow paths;

an orifice plate provided with ink discharge ports for discharging ink, each of said ports communicating with one end of one of said grooves;

an ink liquid chamber that communicates with each of said grooves at the other end thereof for supplying ink to each of said grooves;

an ink supply port for supplying ink to said ink liquid chamber, and a ceiling plate member integrally formed with said grooves, said orifice plate, said ink liquid chamber, and said ink supply port to which said substrate member is joined under pressure to form a plurality of ink discharge paths, wherein said ceiling plate member is structured with a first substrate comprising said grooves and said orifice plate, and a second substrate comprising a cover portion covering said grooves, said ink liquid chamber and said ink supply port, and said first substrate and said second substrate are joined by means of bicolor molding to be integrally molded, and said ceiling plate member is joined to said substrate member by pressing the cover portion of said second substrate with a pressing member.

2. A liquid jet recording head according to claim 1, wherein said first substrate is molded with transparent material.

3. A liquid jet recording head according to claim 1, wherein said first substrate is molded with polysulfone.

4. A liquid jet recording head according to claim 1, wherein said first substrate is molded with pure material containing no fillers.

5. A liquid jet recording head according to claim 1, wherein said second substrate is molded with composite material filled with fillers.

6. A liquid jet recording head according to claim 1, wherein the base resin of the material constituting said second substrate is the same base resin of the material constituting said first substrate.

7. A liquid jet recording head according to claim 1, wherein said second substrate is molded by means of metal injection.

8. A liquid jet recording head according to claim 1, wherein said first substrate is configured so as not to create welds upon molding.

9. A liquid jet recording head according to claim 1, wherein said second substrate is molded with material having a smaller linear expansion coefficient than that of the material constituting said first substrate.

10. A liquid jet recording head according to claim 1, wherein said second substrate has a smaller mold shrinkage than that of the material constituting said first substrate.

11. A liquid jet recording head according to claim 1, wherein said second substrate has a larger elastic modulus than that of the material constituting said first substrate.

12. A liquid jet recording head according to claim 1, wherein said first substrate and said second substrate are molded with the same material.

13. A liquid jet recording head according to claim 1, wherein on a part of the bonded interface between said first substrate and said second substrate, irregular lines are formed with a plurality of extrusions and a plurality of recesses, and the extrusions on said first substrate advance into the recesses on said second substrate, and the extrusion on said second substrate advance into the recesses on said first substrate.

14. A liquid jet recording head according to claim 13, wherein the recessed portions and the extruded portions of said irregular lines are arranged alternately and at equal intervals.

15. A liquid jet recording head according to claim 13, wherein said irregular lines are arranged in the same direction as the arrangement direction of said grooves provided for said ceiling plate.

16. A liquid jet recording head according to claim 1, wherein the material for molding the substrate portion having said grooves is injected lastly in said bicolor molding or polychromatic molding.

17. A liquid jet recording head according to claim 1, wherein said first substrate has a portion changing the thickness thereof in the longitudinal direction of said flow paths.

18. A liquid jet recording head comprising:

a substrate member provided with discharge energy generating elements for generating ink discharge energy corresponding to a plurality of ink flow paths;

a plurality of grooves corresponding to said plurality of ink flow paths;

an orifice plate provided with ink discharge ports for discharging ink, each of said ports communicating with one end of one of said grooves;

an ink liquid chamber that communicates with each of said grooves at the other end thereof for supplying ink to each of said grooves;

an ink supply port for supplying ink to said ink liquid chamber, and a ceiling plate member integrally formed with said grooves, said orifice plate, said ink liquid chamber, and said ink supply port to which said substrate member is joined under pressure to form a plurality of ink discharge paths, wherein said ceiling plate member is structured with an ink contact unit substrate provided with portions to be in contact with ink, and a non-ink contact unit substrate provided with portions not to be in contact with ink, and said ink contact unit substrate and said non-ink contact unit substrate are joined by means of polychromatic molding to be integrally molded.

19. A liquid jet recording head according to claim 18, wherein said ink contact unit substrate comprises said grooves, said orifice plate, the inner walls of said ink liquid chamber, and the inner wall of said ink supply port, and said non-ink contact unit substrate comprises the outer circumferential portions of said ceiling plate.

20. A liquid jet recording head according to claim 18, wherein said ink contact unit substrate is divided into two substrates for molding: an ink discharge unit substrate comprising said grooves and said orifice plate, and an ink supply unit substrate comprising the inner wall of said ink liquid chamber and the inner wall of said ink supply port.

21. A liquid jet recording head according to claim 18, wherein said ink contact unit substrate is molded with transparent material.

22. A liquid jet recording head according to claim 18, wherein said ink contact unit substrate is molded with polysulfone.

23. A liquid jet recording head according to claim 18, wherein said ink contact unit substrate is molded with pure material containing no fillers.

24. A liquid jet recording head according to claim 18, wherein said non-ink contact unit substrate is molded with composite material filled with fillers.

25. A liquid jet recording head according to claim 18, wherein the base resin of the material constituting said non-ink contact unit substrate is the same base resin of the material constituting said ink contact unit substrate.

26. A liquid jet recording head according to claim 18, wherein the material constituting said non-ink contact unit substrate is metallic alloy molding material.

27. A liquid jet recording head according to claim 18, wherein the material constituting said non-ink contact unit substrate has a smaller linear expansion coefficient than that of the material constituting said ink contact unit substrate.

28. A liquid jet recording head according to claim 18, wherein the material constituting said non-ink contact unit substrate has a smaller mold shrinkage than that of the material constituting said ink contact unit substrate.

29. A liquid jet recording head according to claim 18, wherein the material constituting said non-ink contact unit substrate has a larger elastic modulus shrinkage than that of the material constituting said ink contact unit substrate.

30. A liquid jet recording head comprising:

a substrate member provided with discharge energy generating elements for generating ink discharge energy corresponding to a plurality of ink flow paths;

a plurality of grooves corresponding to said plurality of ink flow paths;

an orifice plate provided with ink discharge ports for discharging ink, each of said ports communicating with one end of one of said grooves;

an ink liquid chamber that communicates with each of said grooves at the other end thereof for supplying ink to each of said grooves;

an ink supply port for supplying ink to said ink liquid chamber, and a ceiling plate member integrally formed with said grooves, said orifice plate, said ink liquid chamber, and said ink supply port to which said substrate member is joined under pressure to form a plurality of ink discharge paths, wherein said ceiling plate member comprises a first substrate provided with said grooves, said orifice plate, and a part of the outer wall of said ink liquid chamber to be in close contact with said substrate member, and a second substrate that includes a cover portion covering said grooves, and is provided with the portion of said ink liquid chamber with the exception of said first substrate, and said ink supply port, and said first substrate and said second substrate are joined by means of bicolor molding to be integrally molded, and said ceiling plate member is joined to said substrate member by pressing the cover portion of said second substrate with a pressing member.

31. A liquid jet recording head according to claim 30, wherein said first substrate is molded with transparent material.

32. A liquid jet recording head according to claim 30, wherein said first substrate is molded with polysulfone.

33. A liquid jet recording head according to claim 30, wherein said first substrate is molded with pure material containing no fillers.

34. A liquid jet recording head according to claim 30, wherein said second substrate is molded with composite material filled with fillers.

35. A liquid jet recording head according to claim 30, wherein the base resin of the material constituting said second substrate is the same base resin of the material constituting said first substrate.

36. A liquid jet recording head according to claim 30, wherein said second substrate is molded by means of metal injection.

37. A liquid jet recording head according to claim 30, wherein said second substrate is molded with material having a smaller linear expansion coefficient than that of the material constituting said first substrate.

38. A liquid jet recording head according to claim 30, wherein said second substrate has a smaller mold shrinkage than that of the material constituting said first substrate.

39. A liquid jet recording head according to claim 30, wherein said second substrate has a larger elastic modulus than that of the material constituting said first substrate.

40. A liquid jet recording head according to claim 30, wherein said first substrate and said second substrate are molded with the same material.

41. A liquid jet recording head according to claim 30, wherein on a part of the bonded interface between said first substrate and said second substrate, irregular lines are formed with a plurality of extrusions and a plurality of recesses, and the extrusions on said first substrate advance into the recesses on said second substrate, and the extrusion on said second substrate advance into the recesses on said first substrate.

42. A liquid jet recording head according to claim 41, wherein the recessed portions and the extruded portions of said irregular lines are arranged alternately and at equal intervals.

43. A liquid jet recording head according to claim 41, wherein said irregular lines are arranged in the same direction as the arrangement direction of said grooves provided for said ceiling plate.

44. A liquid jet recording head according to claim 30, wherein said ceiling plate member is integrally molded by means of polychromic molding.

45. A liquid jet recording head according to claim 44, wherein the material constituting the substrate portion having said grooves is injected lastly in polychromic molding.

46. A liquid jet recording head comprising:

a substrate member provided with discharge energy generating elements for generating ink discharge energy corresponding to a plurality of ink flow paths;

a plurality of grooves corresponding to said plurality of ink flow paths;

an orifice plate provided with ink discharge ports for discharging ink, each of said ports communicating with one end of one of said grooves;

an ink liquid chamber that communicates with each of said grooves at the other end thereof for supplying ink to each of said grooves;

an ink supply port for supplying ink to said ink liquid chamber, and a ceiling plate member integrally formed with said grooves, said orifice plate, said ink liquid chamber, and said ink supply port to which said substrate member is joined under pressure to form a plurality of ink discharge paths, wherein said ink liquid chamber is separated into plural divisions by separation walls integratedly formed with said ceiling plate member, and said ceiling plate member comprises a first substrate provided with said grooves, said orifice plate, a part of the outer wall of said ink liquid chamber to be in close contact with said substrate member, and a part of said separation walls to be in close contact with said substrate member, and a second substrate that includes a cover portion covering said grooves, and is provided with the portion of said ink liquid chamber with the exception of said first substrate, said separation walls with the exception of said first substrate, and said ink supply port, and said first substrate and said second substrate are joined by means of bicolor molding to be integrally molded, and said ceiling plate member is joined to said substrate member by pressing the cover portion of said second substrate with a pressing member.

47. A liquid jet recording head according to claim 46, wherein said first substrate is molded with polysulfone.

48. A liquid jet recording head according to claim 46, wherein said first substrate is molded with pure material containing no fillers.

49. A liquid jet recording head according to claim 46, wherein said second substrate is molded with composite material filled with fillers.

50. A liquid jet recording head according to claim 46, wherein the base resin of the material constituting said second substrate is the same base resin of the material constituting said first substrate.

51. A liquid jet recording head according to claim 46, wherein said second substrate is molded by means of metal injection.

52. A liquid jet recording head according to claim 46, wherein said first substrate is configured so as not to create welds upon molding.

53. A liquid jet recording head according to claim 46, wherein said second substrate is molded with material having a smaller linear expansion coefficient than that of the material constituting said first substrate.

54. A liquid jet recording head according to claim 46, wherein said second substrate has a smaller mold shrinkage than that of the material constituting said first substrate.

55. A liquid jet recording head according to claim 46, wherein said second substrate has a larger elastic modulus than that of the material constituting said first substrate.

56. A liquid jet recording head according to claim 46, wherein said first substrate and said second substrate are molded with the same material.

57. A liquid jet recording head according to claim 46, wherein on a part of the interface between said first substrate and said second substrate, irregular lines are formed with a plurality of extrusions and a plurality of recesses, and the extrusions on said first substrate advance into the recesses on said second substrate, and the extrusions on said second substrate advance into the recesses on said first substrate.

58. A liquid jet recording head according to claim 57, wherein the recessed portions and the extruded portions of said irregular lines are arranged alternately and at equal intervals.

59. A liquid jet recording head according to claim 57, wherein said irregular lines are arranged in the same direction as the arrangement direction of said grooves provided for said ceiling plate.

60. A liquid jet recording head according to claim 46, wherein said ceiling plate member is integrated molded by means of polychromic molding.

61. A liquid jet recording head according to claim 60, wherein the material constituting the substrate portion having said grooves is injected lastly in polychromic molding.

62. A liquid jet recording head according to claim 61, wherein said first substrate is molded with transparent material.

63. A liquid jet recording head according to claim 61, wherein said first substrate is molded with polysulfone.

64. A liquid jet recording head according to claim 61, wherein said first substrate is molded with pure material containing no fillers.

65. A liquid jet recording head according to claim 61, wherein said second substrate is molded with composite material filled with fillers.

66. A liquid jet recording head according to claim 61, wherein the base resin of the material constituting said second substrate is the same base resin of the material constituting said first substrate.

67. A liquid jet recording head according to claim 61, wherein said second substrate is molded by mean of metal injection.

68. A liquid jet recording head according to claim 61, wherein said second substrate is molded with material having a smaller linear expansion coefficient than that of the material constituting said first substrate.

69. A liquid jet recording head according to claim 61, wherein said second substrate has a smaller mold shrinkage than that of the material constituting said first substrate.

70. A liquid jet recording head according to claim 61, wherein said second substrate has a larger elastic modulus than that of the material constituting said first substrate.

71. A liquid jet recording head according to claim 61, wherein on a part of the boundary surface between said first substrate and said second substrate, irregular lines are formed with a plurality of extrusions and a plurality of recesses, and the extrusions on said first substrate advance into the recesses on said second substrate, and the extrusion on said second substrate advance into the recesses on said first substrate.

72. A liquid jet recording head according to claim 71, wherein the recessed portions and the extruded portions of said irregular lines are arranged alternately and at equal intervals.

73. A liquid jet recording head according to claim 71, wherein said irregular lines are arranged in the same direction as the arrangement direction of said grooves provided for said ceiling plate.

74. A liquid jet recording head comprising:

a substrate member provided with discharge energy generating elements for generating ink discharge energy corresponding to a plurality of ink flow paths;

a plurality of grooves corresponding to said plurality of ink flow paths;

an orifice plate provided with ink discharge ports for discharging ink, each of said ports communicating with one end of one of said grooves;

an ink liquid chamber that communicates with each of said grooves at the other end thereof for supplying ink, to each of said grooves;

an ink supply port for supplying ink to said ink liquid chamber, and a ceiling plate member integrally formed with said grooves, said orifice plate, said ink liquid chamber, and said ink supply port to which said substrate member is joined under pressure to form a plurality of ink discharge paths, wherein said orifice plate is divided into an orifice plate lower part having said discharge ports, and an orifice plate upper part excluding said discharge ports with above said discharge ports as the boundary, and said ceiling plate member comprises a first substrate provided with said grooves and said orifice plate lower part, and a second substrate that includes a cover portion covering said grooves, and is provided with said orifice plate upper part, said ink liquid chamber, and said ink supply port, and said first substrate and said second substrate are joined by means of bicolor molding to be integrally molded, and said ceiling plate member is joined to said substrate member by pressing the cover portion of said second substrate with a pressing member.

75. A liquid jet recording head according to claim 74, wherein said first substrate is molded with transparent material.

76. A liquid jet recording head according to claim 74, wherein said first substrate is molded with polysulfone.

77. A liquid jet recording head according to claim 74, wherein said first substrate is molded with pure material containing no fillers.

78. A liquid jet recording head according to claim 74, wherein said second substrate is molded with composite material filled with fillers.

79. A liquid jet recording head according to claim 74, wherein the base resin of the material constituting said second substrate is the same base resin of the material constituting said first substrate.

80. A liquid jet recording head according to claim 74, wherein said second substrate is molded by means of metal injection.

81. A liquid jet recording head according to claim 74, wherein said second substrate is molded with material having a smaller linear expansion coefficient than that of the material constituting said first substrate.

82. A liquid jet recording head according to claim 74, wherein said second substrate has a smaller mold shrinkage than that of the material constituting said first substrate.

83. A liquid jet recording head according to claim 74, wherein said second substrate has a larger elastic modulus than that of the material constituting said first substrate.

84. A liquid jet recording head according to claim 74, wherein on a part of the boundary surface between said first substrate and said second substrate, irregular lines are formed with a plurality of extrusions and a plurality of recesses, and the extrusions on said first substrate advance into the recesses on said second substrate, and the extrusion on said second substrate advance into the recesses on said first substrate.

85. A liquid jet recording head according to claim 84, wherein the recessed portions and the extruded portions of said irregular lines are arranged alternately and at equal intervals.

86. A liquid jet recording head according to claim 84, wherein said irregular lines are arranged in the same direction as the arrangement direction of said grooves provided for said ceiling plate.

87. A liquid jet recording head comprising:

a substrate member provided with discharge energy generating elements for generating ink discharge energy corresponding to a plurality of ink flow paths;

a plurality of grooves corresponding to said plurality of ink flow paths;

an orifice plate provided with ink discharge ports for discharging ink, each of said ports communicating with one end of one of said grooves;

an ink liquid chamber that communicates with each of said grooves at the other end thereof for supplying ink to each of said grooves;

an ink supply port for supplying ink to said ink liquid chamber, and a ceiling plate member integrally formed with said grooves, said orifice plate, said ink liquid chamber, and said ink supply port to which said substrate member is joined under pressue to form a plurality of ink discharge paths, wherein said orifice plate is divided into an orifice plate lower part having said discharge ports, and an orifice plate upper part excluding said discharge ports with above said discharge ports as the boundary, and said ceiling plate member comprises a first substrate provided with said grooves and said orifice plate lower part, and a part of the portion of the outer wall of said ink liquid chamber to be in close contact with said substrate member, and a second substrate that includes a cover portion covering said grooves, and is provided with said orifice plate upper part, said ink liquid chamber with the exception of said first substrate, and said ink supply port, and said first substrate and said second substrate are joined means of bicolor molding to be integrally molded, and said ceiling plate member is joined to said substrate member by pressing the cover portion of said second substrate with a pressing member.

88. A liquid jet recording head according to claim 87, wherein said first substrate is molded with transparent material.

89. A liquid jet recording head according to claim 87, wherein said first substrate is molded with polysulfone.

90. A liquid jet recording head according to claim 87, wherein said first substrate is molded with pure material containing no fillers.

91. A liquid jet recording head according to claim 87, wherein said second substrate is molded with composite material filled with fillers.

92. A liquid jet recording head according to claim 87, wherein the base resin of the material constituting said second substrate is the same base resin of the material constituting said first substrate.

93. A liquid jet recording head according to claim 87, wherein said second substrate is molded by means of metal injection.

94. A liquid jet recording head according to claim 87, wherein said second substrate is molded with material having a smaller linear expansion coefficient than that of the material constituting said first substrate.

95. A liquid jet recording head according to claim 87, wherein said second substrate has a smaller mold shrinkage than that of the material constituting said first substrate.

96. A liquid jet recording head according to claim 87, wherein said second substrate has a larger elastic modulus than that of the material constituting said first substrate.

97. A liquid jet recording head according to claim 87, wherein on a part of the boundary surface between said first substrate and said second substrate, irregular lines are formed with a plurality of extrusions and a plurality of recesses, and the extrusions on said first substrate advance into the recesses on said second substrate, and the extrusion on said second substrate advance into the recesses on said first substrate.

98. A liquid jet recording head according to claim 97, wherein the recessed portions and the extruded portions of said irregular lines are arranged alternately and at equal intervals.

99. A liquid jet recording head according to claim 97, wherein said irregular lines are arranged in the same direction as the arrangement direction of said grooves provided for said ceiling plate.

100. A liquid jet recording head comprising:

a substrate member provided with discharge energy generating elements for generating ink discharge energy corresponding to a plurality of ink flow paths;

a plurality of grooves corresponding to said plurality of ink flow paths;

an orifice plate provided with ink discharge ports for discharging ink, each of said ports communicating with one end of one of said grooves;

an ink liquid chamber that communicates with each of said grooves at the other end thereof for supplying ink to each of said grooves;

an ink supply port for supplying ink to said ink liquid chamber, and a ceiling plate member integrally formed with said grooves, said orifice plate, said ink liquid chamber, and said ink supply port to which said substrate member is joined under pressure to form a plurality of ink discharge paths, wherein said orifice plate is divided into an orifice plate lower part having said discharge ports, and an orifice plate upper part excluding said discharge ports with above said discharge ports as the boundary, and said ceiling plate member comprises an ink contact unit substrate provided with portions to be in contact with ink, and a non-ink contact unit substrate provided with portions not to be in contact with ink, and said ink contact unit substrate and said non-ink contact unit substrate are joined by means of polychromic molding to be integrally molded.

101. A liquid jet recording head according to claim 100, wherein said ink contact unit substrate is structured with said grooves, said orifice plate lower part, the inner wall of said ink liquid chamber, and the inner wall of said ink supply port, and said non-ink contact unit substrate is structured said orifice plate upper part and the outer circumferential portion of said ceiling plate member.

102. A liquid jet recording head according to claim 100, wherein said ink contact unit substrate is divided into two substrates to be molded: an ink discharge unit substrate comprising said grooves and said orifice plate lower part, and an ink supply unit substrate comprising the inner wall of said ink liquid chamber and the inner wall of said ink supply port.

103. A liquid jet recording head according to claim 100, wherein said ink contact unit substrate is molded with transparent material.

104. A liquid jet recording head according to claim 100, wherein said ink contact unit substrate is molded with polysulfone.

105. A liquid jet recording head according to claim 100, wherein said ink contact unit substrate is molded with pure material containing no fillers.

106. A liquid jet recording head according to claim 100, wherein said non-ink contact unit substrate is molded with composite material filled with fillers.

107. A liquid jet recording head according to claim 100, wherein the base resin of the material constituting said non-ink contact unit substrate is the same base resin of the material constituting said ink-contact unit substrate.

108. A liquid jet recording head according to claim 100, wherein said non-ink contact unit substrate is molded by means of metal injection.

109. A liquid jet recording head according to claim 100, wherein the material constituting said non-ink contact unit substrate has a smaller linear expansion coefficient than that of the material constituting said ink contact unit substrate.

110. A liquid jet recording head according to claim 100, wherein said non-ink contact unit substrate has a smaller mold shrinkage than that of the material constituting said ink contact unit substrate.

111. A liquid jet recording head according to claim 100, wherein the material constituting said non-ink contact unit substrate has a larger elastic modulus than that of the material constituting said ink contact unit substrate.

112. A liquid jet recording head comprising:

a substrate member provided with discharge energy generating elements for generating ink discharge energy corresponding to a plurality of ink flow paths;

a plurality of grooves corresponding to said plurality of ink flow paths;

an orifice plate provided with ink discharge ports for discharging ink, each of said ports communicating with one end of one of said grooves;

an ink liquid chamber that communicates with each of said grooves at the other end thereof for supplying ink to each of said grooves;

an ink supply port for supplying ink to said ink liquid chamber, and a ceiling plate member integrally formed with said grooves, said orifice plate, said ink liquid chamber, and said ink supply port to which said substrate member is joined under pressure to form a plurality of ink discharge paths, wherein the surface of said orifice plate is formed in the uniform plane or the uniform curve, and said ceiling plate is structured with a first substrate comprising said orifice plate including at least a circumferential portion of said discharge ports, and said grooves, and a second substrate comprising a cover portion covering said grooves and the portions with the exception of the portions becoming said first substrate, and said first substrate and said second substrate are joined by means of bicolor molding to be integrally molded, and said ceiling plate member is joined to said substrate member by pressing the cover portion of said second substrate with a pressing member.

113. A liquid jet recording head according to claim 112, wherein the surface of said orifice plate is inclined to said substrate member.

114. A liquid jet recording head according to claim 112, wherein the gate for molding said first substrate is positioned on the lower side face of said orifice plate.

115. A liquid jet recording head according to claim 114, wherein said gate is a fan gate or a film gate.

116. A liquid jet recording head according to claim 112, wherein the surface and back face of said orifice plate are formed in parallel on the circumferential portion of said discharge ports, and the thickness of said orifice plate is formed to be gradually thicker downward from the circumferential portion of said discharge port.

117. A liquid jet recording head according to claim 112, the gate for molding said first substrate is positioned at the end face of said orifice plate facing the arrangement direction of said discharge ports.

118. A liquid jet recording head according to claim 112, wherein said second substrate is molded with composite material filled with fillers.

119. A liquid jet recording head according to claim 112, said second substrate has a smaller linear expansion coefficient than said first substrate.

120. A liquid jet recording head according to claim 112, said second substrate has a greater elastic modulus than said first substrate.

121. A liquid jet recording head according to claim 112, wherein the position of gate for molding said second substrate is arranged to allow the molding material to flow in the arrangement direction of said grooves at the time of molding said second substrate.

122. A liquid jet recording head according to claim 112, wherein the position of the gate for molding said second substrate is arranged to be in the vicinity of the line end portion of said grooves.

123. A liquid jet recording head according to claim 112, wherein the base resin of the material constituting said second substrate is the same base resin of the material constituting said first substrate.

124. A liquid jet recording head according to claim 112, wherein on a part of the boundary surface between said first substrate and said second substrate, irregular lines are formed, and the extrusions on said first substrate advance into the recesses on said second substrate, and the extrusion on said second substrate advance into the recesses on said first substrate.

125. A liquid jet recording head comprising:

a substrate member provided with discharge energy generating elements for generating ink discharge energy corresponding to a plurality of ink flow paths;

a plurality of grooves corresponding to said plurality of ink flow paths;

an orifice plate provided with ink discharge ports for discharging ink, each of said ports communicating with one end of one of said grooves;

an ink liquid chamber that communicates with each of said grooves at the other end thereof for supplying ink to each of said grooves;

an ink supply port for supplying ink to said ink liquid chamber, and a ceiling plate member integrally formed with said grooves, said orifice plate, said ink liquid chamber, and said ink supply port to which said substrate member is joined under pressure to form a plurality of ink discharge paths, wherein said ink liquid chamber is separated into plural divisions by separation walls integratedly molded with said ceiling plate member, and said orifice plate is divided into an orifice plate lower part having said discharge ports, and an orifice plate upper part excluding said discharge ports with above said discharge ports as the boundary, and said ceiling plate member comprises a first substrate provided with said grooves and said orifice plate lower part, and a part of the portion of the outer wall of said ink liquid chamber to be in close contact with said substrate member, and said separation walls with the exception of said first substrate, and a second substrate that includes a cover portion covering said grooves, and is provided with said orifice plate upper part, said ink liquid chamber with the exception of said first substrate, said separation walls with the exception of said first substrate, and said ink supply port, and said first substrate and said second substrate are joined by means of bicolor molding to be integrally molded, and said ceiling plate member is joined to said substrate member by pressing the cover portion of said second substrate with a pressing member.

* * * * *

UNITED STATES PATENT AND TRADEMARK OFFICE

CERTIFICATE OF CORRECTION

PATENT NO. : 6,382,777 B1
DATED : May 7, 2002
INVENTOR(S) : Yukuo Yamaguchi et al.

It is certified that error appears in the above-identified patent and that said Letters Patent is hereby corrected as shown below:

Column 1,
Line 53, "an" (2nd occurrence) should read -- a --.

Column 5,
Line 24, "the" (2nd occurrence) should read -- this --.

Column 8,
Line 24, "its," should read -- its --;
Line 42, "counter act" should read -- counteract --; and
Line 55, "it costs" should read -- the costs are --.

Column 13,
Line 10, "with." should read -- with --; and
Line 45, "of," should read -- of --.

Column 14,
Line 22, "above.the" should read -- above the --.

Column 21,
Line 15, "The" should read -- the --.

Column 23,
Line 5, "side sectional" should read -- side-sectional --.

Column 24,
Line 1, "dam" should read -- μm --;
Line 9, "its" should read -- their --; and
Line 10, "its" should read -- their --.

Column 25,
Line 30, "is" should read -- are --; and
Line 31, "is" should read -- are --.

Column 29,
Line 9, "becomes" should read -- become --.

UNITED STATES PATENT AND TRADEMARK OFFICE

CERTIFICATE OF CORRECTION

PATENT NO. : 6,382,777 B1
DATED : May 7, 2002
INVENTOR(S) : Yukuo Yamaguchi et al.

It is certified that error appears in the above-identified patent and that said Letters Patent is hereby corrected as shown below:

Column 31,
Line 4, "9;and" should read -- 9; and --;
Line 42, "of" should read -- with --; and
Line 62, "no" should read -- not --.

Column 32,
Line 22, "is" should read -- are --; and
Line 23, "is" should read -- are --.

Column 34,
Line 50, "wall.," should read -- wall --.

Column 36,
Line 20, "which" should read -- and --.

Column 39,
Line 18, "the~like." should read -- the like. --; and
Line 34, "side sectional" should read -- side-sectional --.

Column 41,
Line 57, "means," should read -- means --.

Column 45,
Line 33, "molding ," should read -- molding, --;
Line 39, "fist" should read -- first --; and
Line 66, "which" should read -- and --.

Column 48,
Line 41, "1Ob" should read -- 10b --.

Column 50,
Line 14, "extrusion" should read -- extrusions --.

Column 52,
Line 36, "extrusion" should read -- extrusions --.

UNITED STATES PATENT AND TRADEMARK OFFICE

CERTIFICATE OF CORRECTION

PATENT NO. : 6,382,777 B1
DATED : May 7, 2002
INVENTOR(S) : Yukuo Yamaguchi et al.

It is certified that error appears in the above-identified patent and that said Letters Patent is hereby corrected as shown below:

Column 54,
Line 4, "integrated" should read -- integrally --; and
Line 42, "extrusion" should read -- extrusions --.

Column 55,
Line 53, "extrusion" should read -- extrusions --.

Column 56,
Line 14, "pressue" should read -- pressure --; and
Line 30, "joined" should read -- joined by --.

Column 57,
Line 1, "extrusion" should read -- extrusions --; and
Line 46, "structured" should read -- structured with --.

Column 59,
Line 2, "the gate" should read -- wherein the gate --;
Line 9, "said" should read -- wherein said -- and "has" should read -- having --;
Line 12, "said second" should read -- wherein said second -- and "has" should read -- having --;
Line 31, "extrusion" should read -- extrusions --.

Signed and Sealed this

First Day of April, 2003

JAMES E. ROGAN
*Director of the United States Patent and Trademark Office*